US009748677B2

(12) United States Patent
Urano et al.

(10) Patent No.: US 9,748,677 B2
(45) Date of Patent: Aug. 29, 2017

(54) WIRE-TO-BOARD CONNECTOR

(71) Applicant: Japan Aviation Electronics Industry, Ltd., Tokyo (JP)

(72) Inventors: Tetsu Urano, Tokyo (JP); Takaaki Kudo, Tokyo (JP)

(73) Assignee: JAPAN AVIATION ELECTRONICS INDUSTRY, LTD., Tokyo (JP)

( * ) Notice: Subject to any disclaimer, the term of this patent is extended or adjusted under 35 U.S.C. 154(b) by 0 days.

(21) Appl. No.: 14/413,630

(22) PCT Filed: Mar. 29, 2013

(86) PCT No.: PCT/JP2013/002185

§ 371 (c)(1),
(2) Date: Mar. 27, 2015

(87) PCT Pub. No.: WO2014/013642

PCT Pub. Date: Jan. 23, 2014

(65) Prior Publication Data

US 2015/0207244 A1 Jul. 23, 2015

(30) Foreign Application Priority Data

Jul. 19, 2012 (JP) ..... 2012-160367
Nov. 9, 2012 (JP) ..... 2012-247586

(51) Int. Cl.
*H01R 12/57* (2011.01)
*H01R 12/91* (2011.01)
(Continued)

(52) U.S. Cl.
CPC ..... *H01R 12/57* (2013.01); *H01R 12/91* (2013.01); *H01R 13/6275* (2013.01);
(Continued)

(58) Field of Classification Search
CPC .. H01R 13/639; H01R 13/6273; H01R 12/78; H01R 12/79; H01R 12/81; H01R 12/83; H01R 12/716; H01R 12/71
See application file for complete search history.

(56) References Cited

U.S. PATENT DOCUMENTS 6,508,659 B1 * 1/2003 Howell ..... H05K 7/1007 439/259
6,869,301 B2 * 3/2005 Shimizu ..... H01R 13/6276 439/324
(Continued)

FOREIGN PATENT DOCUMENTS

CN 102237612 A 11/2011
CN 104221227 A 12/2014
(Continued)

OTHER PUBLICATIONS

International Search Report dated Jul. 2, 2013 from corresponding International Patent Application No. PCT/JP2013/002185; 3 pages.
(Continued)

*Primary Examiner* — James Harvey
*Assistant Examiner* — Oscar C Jimenez
(74) *Attorney, Agent, or Firm* — Maier & Maier, PLLC

(57) ABSTRACT

A receptacle connector includes a receptacle contact corresponding to a plug contact, a receptacle housing that holds the receptacle contact, and an assistant fitting attached to the receptacle housing, and is mounted on a connector mounting surface of a circuit board. The assistant fitting includes at least a held portion, a fixing portion, and a vertical displacement regulating portion. The held portion is a portion that is held by the receptacle housing. The fixing portion is a portion that is hooked to the plug housing to thereby fix the plug connector to the receptacle connector. The vertical displacement regulating portion is a portion that regulates a
(Continued)

displacement of the fixing portion in a direction away from the connector mounting surface of the circuit board.

23 Claims, 38 Drawing Sheets

(51) Int. Cl.

| | |
|---|---|
| ***H01R 13/627*** | (2006.01) |
| ***H01R 24/20*** | (2011.01) |
| ***H01R 13/20*** | (2006.01) |
| ***H01R 107/00*** | (2006.01) |
| ***H01R 12/70*** | (2011.01) |
| ***H01R 12/75*** | (2011.01) |
| ***H01R 24/28*** | (2011.01) |
| ***H01R 12/79*** | (2011.01) |
| ***H01R 12/71*** | (2011.01) |

(52) U.S. Cl.
CPC ..... *H01R 12/707* (2013.01); *H01R 12/716* (2013.01); *H01R 12/75* (2013.01); *H01R 12/79* (2013.01); *H01R 13/20* (2013.01); *H01R 24/20* (2013.01); *H01R 24/28* (2013.01); *H01R 2107/00* (2013.01)

(56) References Cited

U.S. PATENT DOCUMENTS

| | | | | |
|---|---|---|---|---|
| 7,258,567 | B2 * | 8/2007 | Tanaka | H01R 12/707 439/355 |
| 7,785,127 | B2 * | 8/2010 | Nagamine | H01R 13/6277 439/347 |
| 8,043,114 | B2 * | 10/2011 | Kaneko | H01R 13/65802 439/468 |
| 9,048,569 | B2 * | 6/2015 | Chen | H01R 12/716 |
| 9,240,653 | B2 * | 1/2016 | Urano | H01R 13/6273 |
| 2011/0263140 | A1 * | 10/2011 | Sato | H01R 12/7052 439/74 |
| 2011/0306229 | A1 * | 12/2011 | Katsui | H01R 24/005 439/345 |

FOREIGN PATENT DOCUMENTS

| | | | |
|---|---|---|---|
| EP | 2833484 | A1 | 2/2015 |
| JP | 2010-027532 | A | 2/2010 |
| JP | 2010-267604 | A | 11/2010 |
| JP | 2011-003292 | A | 1/2011 |
| JP | 2011-228269 | A | 11/2011 |

OTHER PUBLICATIONS

Chinese Office Action dated Feb. 3, 2016, in connection with counterpart Chinese Patent Application No. 201380031728.4 (20 pgs., including the English translation).
Korean Office Action dated Jan. 5, 2016, in connection with counterpart KR Application No. 10-2014-7035235 (9 pgs, including a partial English translation).
Extended European Search Report dated Jan. 15, 2016, including the Supplementary European Search Report and the European Search Opinion, in connection with counterpart EP Application No. 13819357 (6 pgs.).
Japanese Office Action dated Jun. 28, 2016, in connection with corresponding JP Application No. 2012-247586 (11 pgs., including English translation).
European Office Action mailed Sep. 5, 2016, in connection with corresponding EP Application No. 13 819 357.8 (5 pgs.).

* cited by examiner

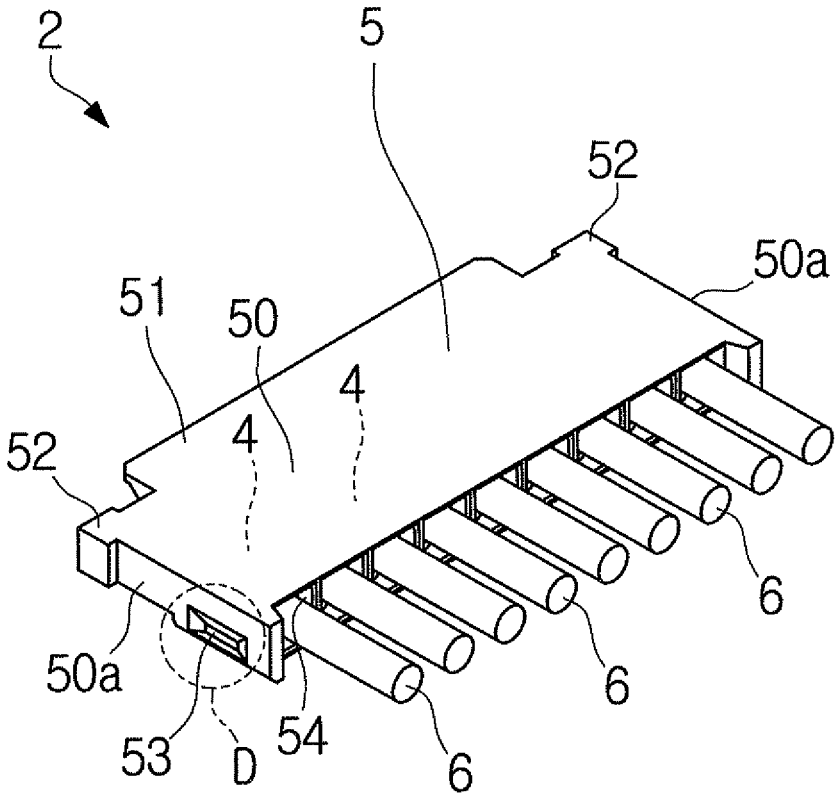
Fig. 14
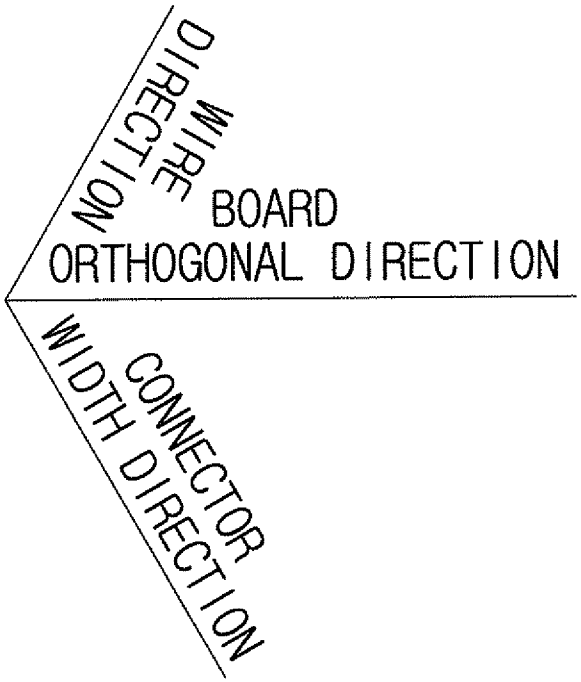

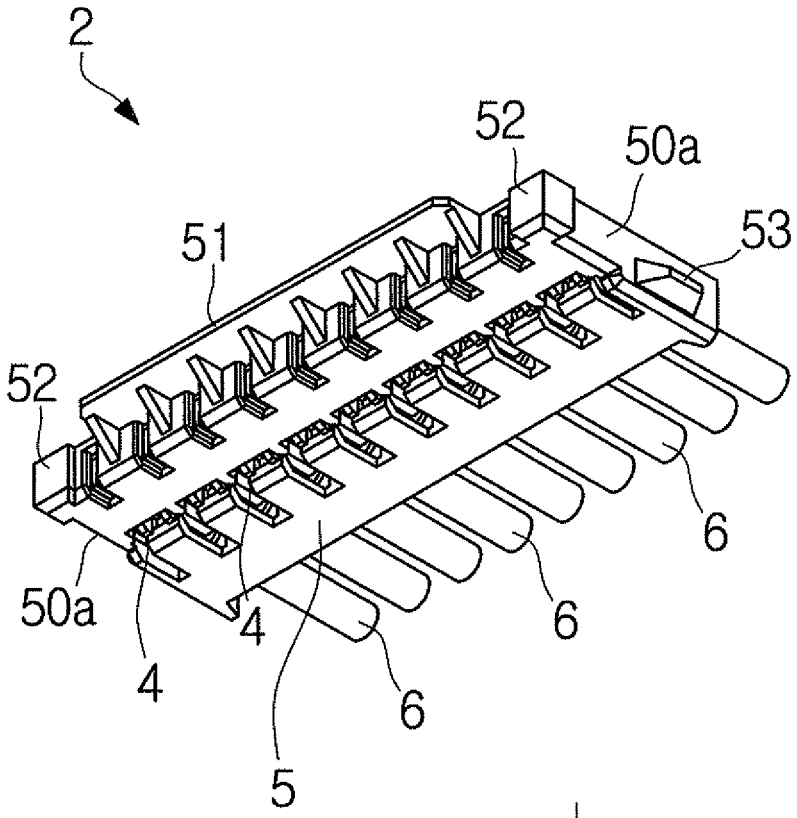
Fig. 15
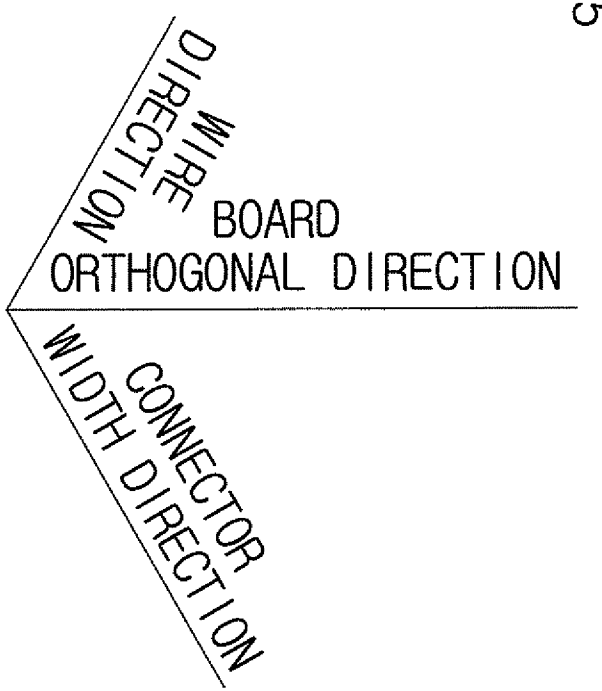

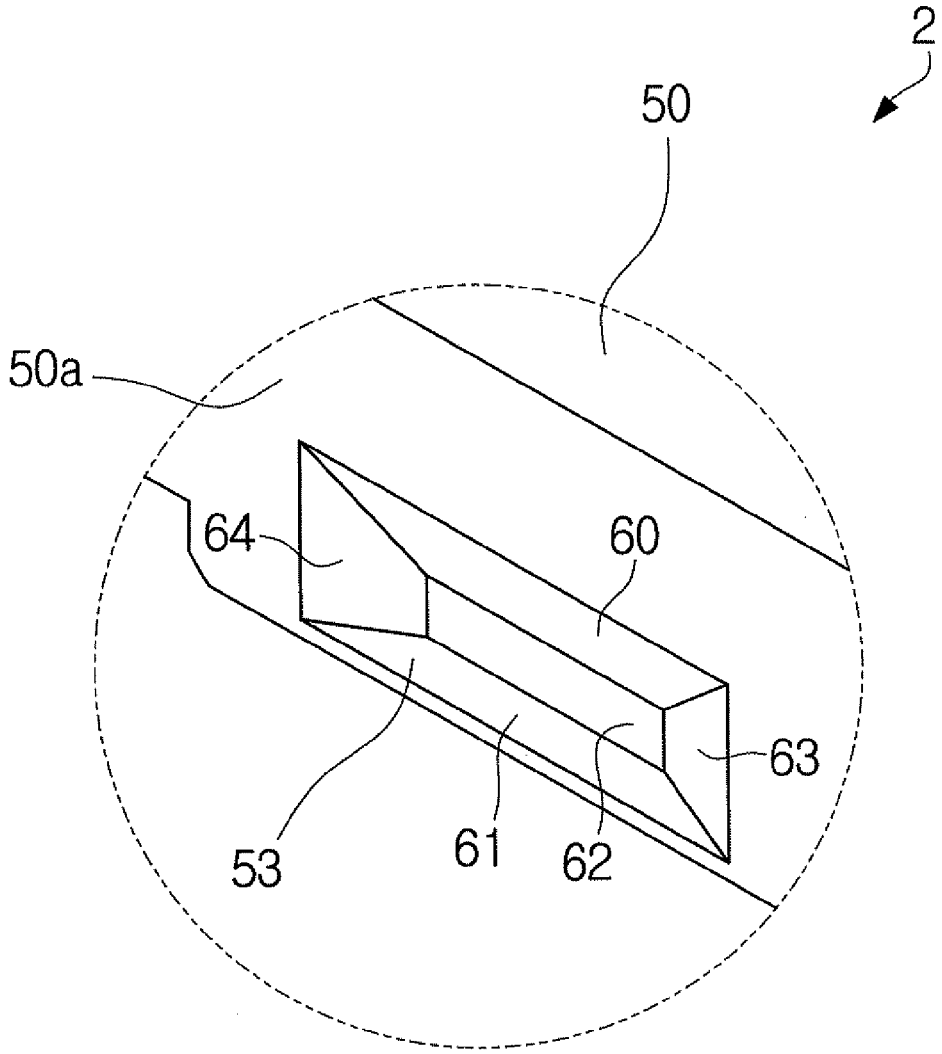
Fig. 16
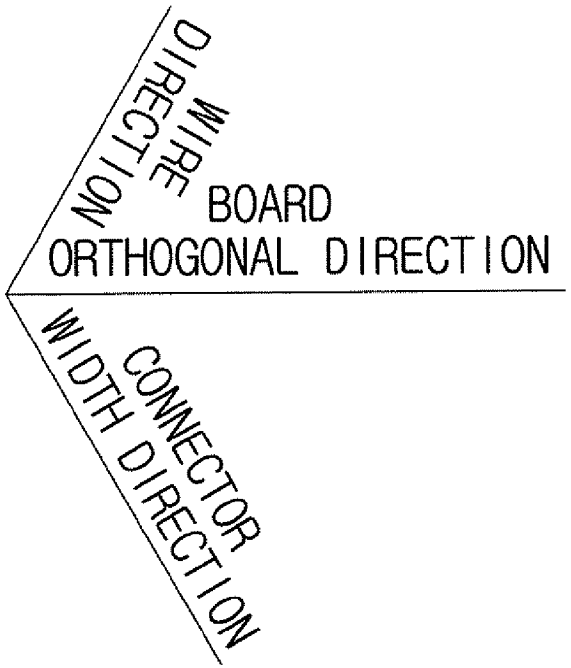

WIRE-TO-BOARD CONNECTOR

TECHNICAL FIELD

The present invention relates to a wire-to-board connector.

BACKGROUND ART

As a technique of this type, Patent Literature 1 discloses a wire-to-board connector 104 including a board connector 100, which is mounted on a circuit board, and a wire connector 103 which is connected to terminals of a plurality of wires 101. This wire-to-board connector 104 is a low-profile vertical mating connector which is a wire leveling type in which the wires 101 are pulled out in parallel to the circuit board.

The board connector 100 includes a board-side housing 105 and a mounting assistant fitting 106 which is made of metal and is attached to the board-side housing 105. The mounting assistant fitting 106 has an engaging opening 107 formed therein.

On the other hand, the wire connector 103 includes a wire-side housing 108. A side portion of the wire-side housing 108 is connected with a side lock member 109 which extends downward. A side engaging projecting portion that projects inwardly is formed on an inner surface of the side lock member 109.

The side engaging projecting portion of the side lock member 109 of the wire connector 103 is engaged with the engaging opening 107 of the mounting assistant fitting 106 of the board connector 100, thereby allowing the wire connector 103 to be locked with the board connector 100.

CITATION LIST

Patent Literature

[Patent Literature 1] Japanese Unexamined Patent Application Publication No. 2011-3292

SUMMARY OF INVENTION

Technical Problem

To prevent the mounting assistant fitting 106 from being damaged even when the wires are lifted up, there is a room for improvement in the strength of the mounting assistant fitting 106 disclosed in Patent Literature 1.

It is an object of the present invention to provide a wire-to-board connector hardly damaged even when wires are lifted up.

Solution to Problem

According to a first aspect of the present invention, provided is a wire-to-board connector including: a plug connector including a plug contact to which a wire is attached, and a plug housing that holds the plug contact; and a receptacle connector that is mounted on a connector mounting surface of a board and includes a receptacle contact corresponding to the plug contact, a receptacle housing that holds the receptacle contact, and an assistant fitting that is attached to the receptacle housing. A mating direction in which the plug connector is mated with the receptacle connector is a direction approaching the connector mounting surface of the board. The plug connector is mated with the receptacle connector to thereby bring the plug contact into contact with the receptacle contact. The assistant fitting includes: a held portion that is held by the receptacle housing; a fixing portion that is hooked to the plug housing to thereby fix the plug connector to the receptacle connector; and a first displacement regulating portion that regulates a displacement of the fixing portion in a direction away from the connector mounting surface of the board.

Preferably, the fixing portion is supported by the held portion and is formed in a cantilever shape extending in parallel to the connector mounting surface of the board.

Preferably, the fixing portion is opposed to the held portion.

Preferably, the fixing portion is formed to be elastically displaceable in a direction approaching the held portion.

Preferably, the assistant fitting further includes a second displacement regulating portion that regulates elastic displacement of the fixing portion in a direction approaching the held portion so that the elastic displacement does not exceed a predetermined amount.

Preferably, the assistant fitting includes a leg portion that is soldered to the connector mounting surface of the board.

Preferably, the leg portion is disposed in the vicinity of the first displacement regulating portion.

Preferably, the plug housing has a projecting portion projecting toward the fixing portion of the assistant fitting; the projecting portion has a plug lock surface facing in a direction away from the connector mounting surface of the board; and the fixing portion has a receptacle lock surface that faces in a direction approaching the connector mounting surface of the board and is opposed to the plug lock surface in a mated state in which the plug connector is mated with the receptacle connector.

Preferably, the wire is pulled out from the plug connector in a direction substantially parallel to the connector mounting surface of the board.

Preferably, assuming that a direction in which the plug connector is viewed from the wire is a wire connector direction, a portion of the projecting portion on the wire connector direction side is formed in such a manner that a projection amount of the projecting portion decreases toward the wire connector direction.

Preferably, assuming that a direction in which the plug connector is viewed from the wire is a wire connector direction, a flat surface or a curved surface is formed at a portion of the projecting portion on the wire connector direction side, the flat surface or the curved surface being inclined so as to be gradually separated from the fixing portion in a direction away from the connector mounting surface of the board.

Preferably, assuming that a direction in which the plug connector is viewed from the wire is a wire connector direction, a flat surface or a curved surface is formed at a portion of the fixing portion on the wire connector direction side, the flat surface or the curved surface being inclined so as to gradually approach the plug housing in a direction away from the connector mounting surface of the board.

Preferably, the plug housing has a releasing projection that allows the plug connector to be inclined so that the wire approaches the connector mounting surface of the board.

Preferably, the releasing projection is formed so as to project in the wire connector direction from an end of the plug housing on the wire connector direction side.

Preferably, the fixing portion has a mating guide surface that allows the fixing portion to be elastically displaced in a direction away from the plug connector, when the projecting portion of the plug connector is brought into contact with the fixing portion so as to mate the plug connector with the receptacle connector.

Preferably, the mating guide surface is a flat surface or a curved surface.

Preferably, a pair of the assistant fittings is provided on both sides of the receptacle connector.

According to a second aspect of the present invention, provided is a wire-to-board connector including: a plug connector including a plug contact to which a wire is attached, and a plug housing that holds the plug contact; and a receptacle connector that is mounted on a connector mounting surface of a board and includes a receptacle contact corresponding to the plug contact, a receptacle housing that holds the receptacle contact, and an assistant fitting that is attached to the receptacle housing. A mating direction in which the plug connector is mated with the receptacle connector is a direction approaching the connector mounting surface of the board. The plug connector is mated with the receptacle connector to thereby bring the plug contact into contact with the receptacle contact. The assistant fitting includes: a held portion that is held by the receptacle housing; a fixing portion that is hooked to the plug housing to thereby fix the plug connector to the receptacle connector; and a first displacement regulating portion that regulates a displacement of the fixing portion in a direction away from the connector mounting surface of the board. The fixing portion is supported by the held portion and is formed in a cantilever shape extending in parallel to the connector mounting surface of the board. The fixing portion is formed to be elastically displaceable in a direction approaching the held portion. The plug housing has a projecting portion projecting toward the fixing portion of the assistant fitting. The projecting portion has a plug lock surface facing in a direction away from the connector mounting surface of the board. The fixing portion has a receptacle lock surface that faces in a direction approaching the connector mounting surface of the board and is opposed to the plug lock surface in a mated state in which the plug connector is mated with the receptacle connector. A plug side surface serving as a side surface of the plug housing is provided with an overhanging portion that projects toward the fixing portion of the assistant fitting, and the overhanging portion is in contact with an elastically displaceable portion of the fixing portion in the mated state.

Advantageous Effects of Invention

According to the present invention, the displacement of the fixing portion in the direction away from the connector mounting surface of the board is regulated, which prevents assistant fittings from being damaged.

BRIEF DESCRIPTION OF DRAWINGS

FIG. 14 is a perspective view of a plug connector attached to wires (first embodiment);

FIG. 15 is a perspective view of the plug connector attached to wires, when viewed from another angle (first embodiment);

FIG. 16 is an enlarged view of a portion "D" shown in FIG. 14 (first embodiment);

DESCRIPTION OF EMBODIMENTS

First Embodiment

Figure 1:
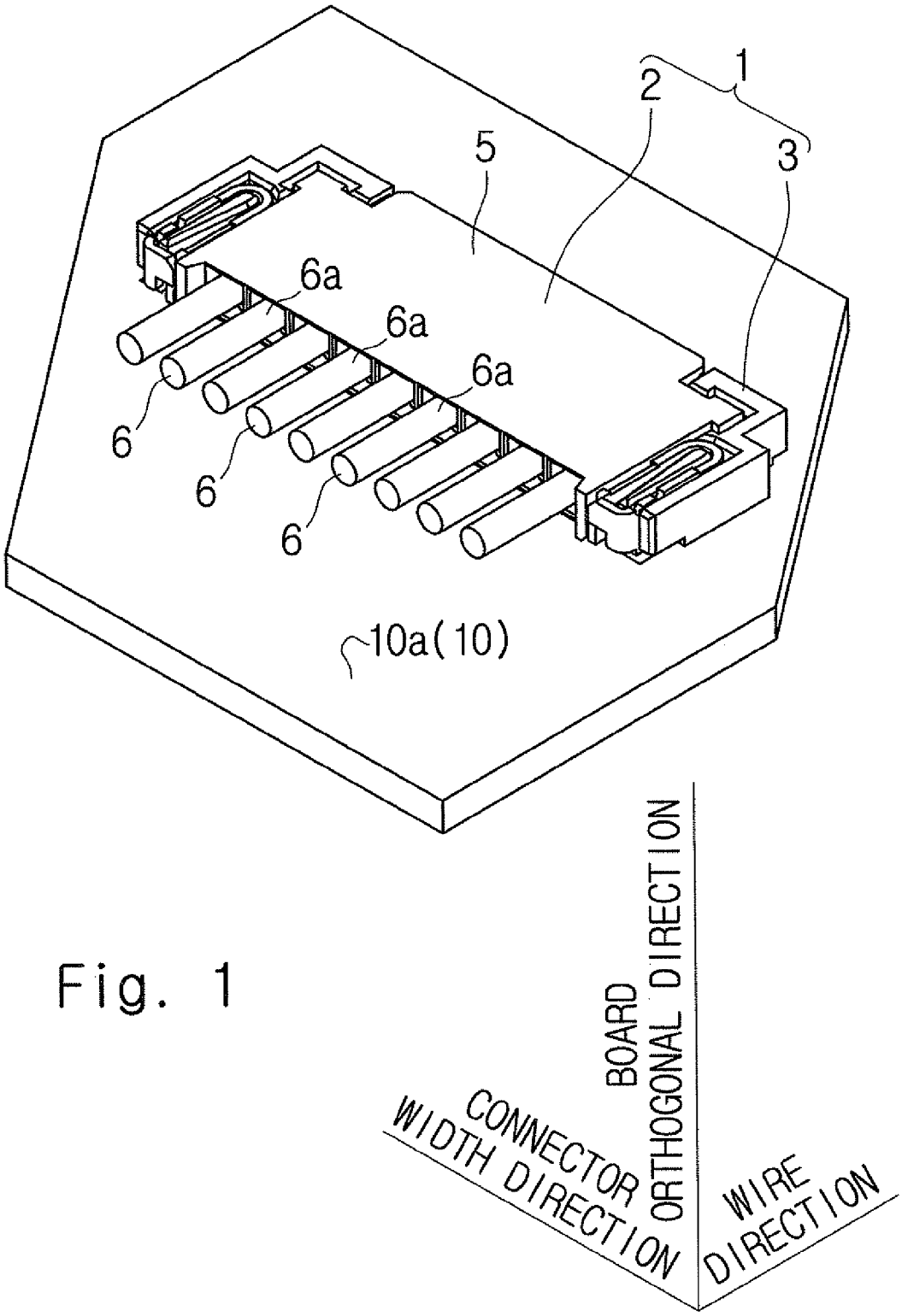
FIG. 1 is a perspective view showing a mated state of a wire-to-board connector (first embodiment)
Figure 2:
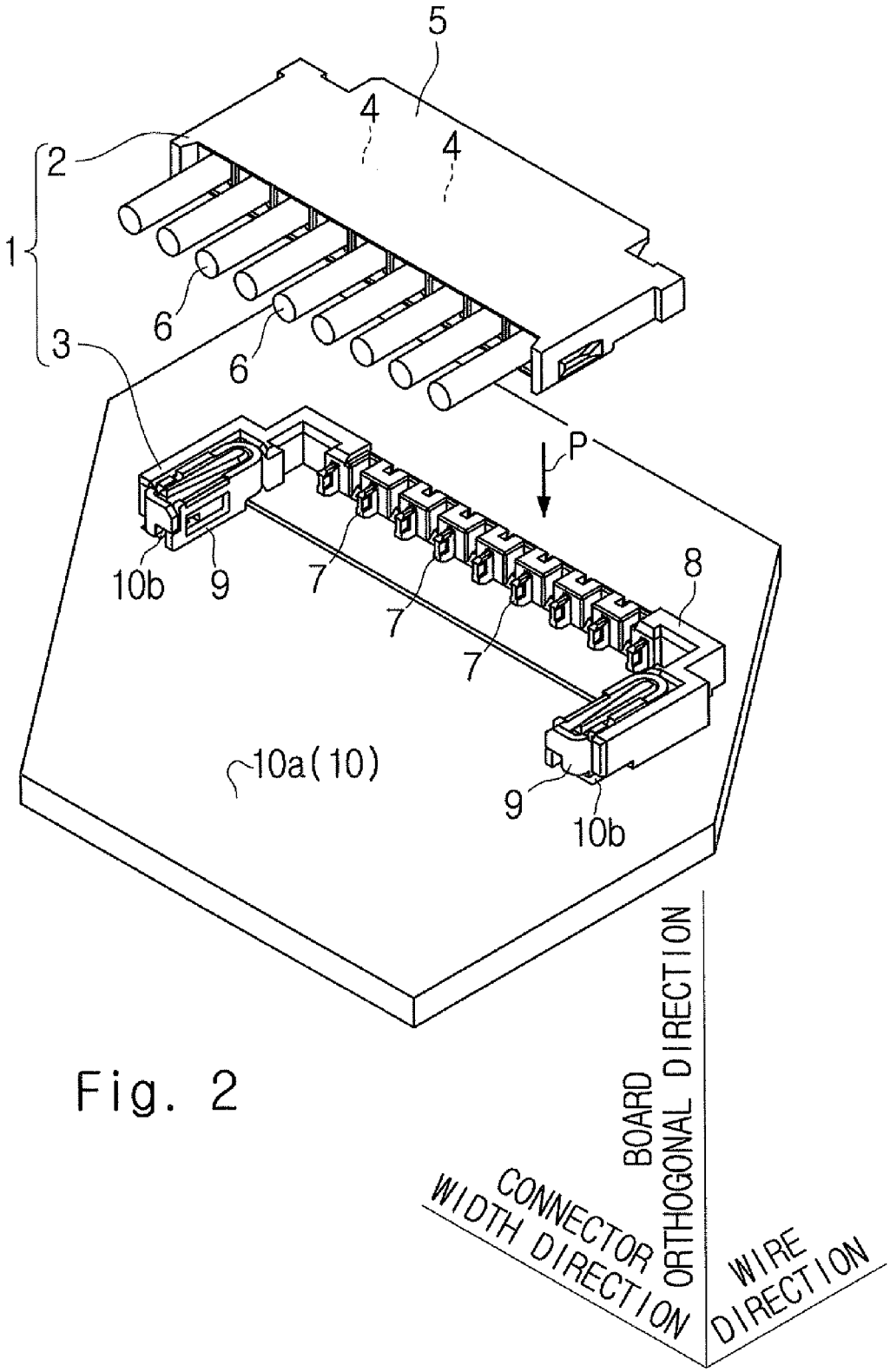
FIG. 2 is a perspective view showing a non-mated state of the wire-to-board connector (first embodiment)

A first embodiment of the present invention will be described below with reference to FIGS. 1 to 20. As shown in FIGS. 1 and 2, a wire-to-board connector 1 includes a plug connector 2 and a receptacle connector 3.

As shown in FIG. 2, the plug connector 2 includes a plurality of plug contacts 4 (also see FIG. 18) and a plug housing 5 that holds the plurality of plug contacts 4. Wires 6 are respectively attached to the plug contacts 4.

The receptacle connector 3 includes a plurality of receptacle contacts 7, a receptacle housing 8 that holds the plurality of receptacle contacts 7, and a pair of assistant fittings 9 which are attached to the receptacle housing 8. The receptacle contacts 7 respectively correspond to the plug contacts 4. The receptacle connector 3 is mounted on a connector mounting surface 10*a* of a circuit board 10 (board). In this embodiment, a mating direction P in which the plug connector 2 is mated with the receptacle connector 3 is a direction approaching the connector mounting surface 10*a* of the circuit board 10. Specifically, the mating direction P is orthogonal to the connector mounting surface 10*a* of the circuit board 10.

As shown in FIGS. 1 and 2, the plug connector 2 is mated with the receptacle connector 3, thereby allowing the plug contacts 4 to respectively contact the receptacle contacts 7.

The terms "wire direction (first direction)", "board orthogonal direction (second direction)", and "connector width direction (third direction)" will now be defined. The "wire direction", the "board orthogonal direction", and the "connector width direction" are directions orthogonal to each other.

The term "wire direction" refers to a direction parallel to the connector mounting surface 10*a* of the circuit board 10, and is specified as a longitudinal direction of vicinity portions 6*a*, each of which is a portion of the corresponding wire 6 located in the vicinity of the plug connector 2, in a mated state in which the plug connector 2 is mated with the receptacle connector 3 as shown in FIG. 1. In other words, the wires 6 are pulled out from the plug connector 2 in a direction substantially parallel to the connector mounting surface 10*a* of the circuit board 10. In the "wire direction", a direction in which the plurality of wires 6 are viewed from the plug connector 2 is defined as a connector wire direction, and a direction in which the plug connector 2 is viewed from the plurality of wires 6 is defined as a wire connector direction. The term "board orthogonal direction" refers to a direction orthogonal to the connector mounting surface 10*a* of the circuit board 10. In the "board orthogonal direction", a direction approaching the connector mounting surface 10*a* of the circuit board 10 is defined as a "board approaching direction", and a direction separating from the connector mounting surface 10*a* of the circuit board 10 is defined as a "board separating direction". The mating direction P shown in FIG. 2 coincides with the board approaching direction. The term "connector width direction" refers to a direction orthogonal to the wire direction and the board orthogonal direction. The connector width direction is parallel to the connector mounting surface 10*a* of the circuit board 10. In the "connector width direction", a direction approaching a center of the wire-to-board connector 1 is defined as a "connector width center direction", and a direction separating from the center of the wire-to-board connector 1 is defined as a "connector width anti-center direction".

In the following description, each component of the wire-to-board connector 1 will be described by using the terms "wire direction", "board orthogonal direction", and "connector width direction", which are defined in the mated state in which the plug connector 2 is mated with the receptacle connector 3.

(Receptacle Connector 3)

Next, the receptacle connector 3 will be described in detail with reference to FIGS. 3 to 13.

Figure 3:
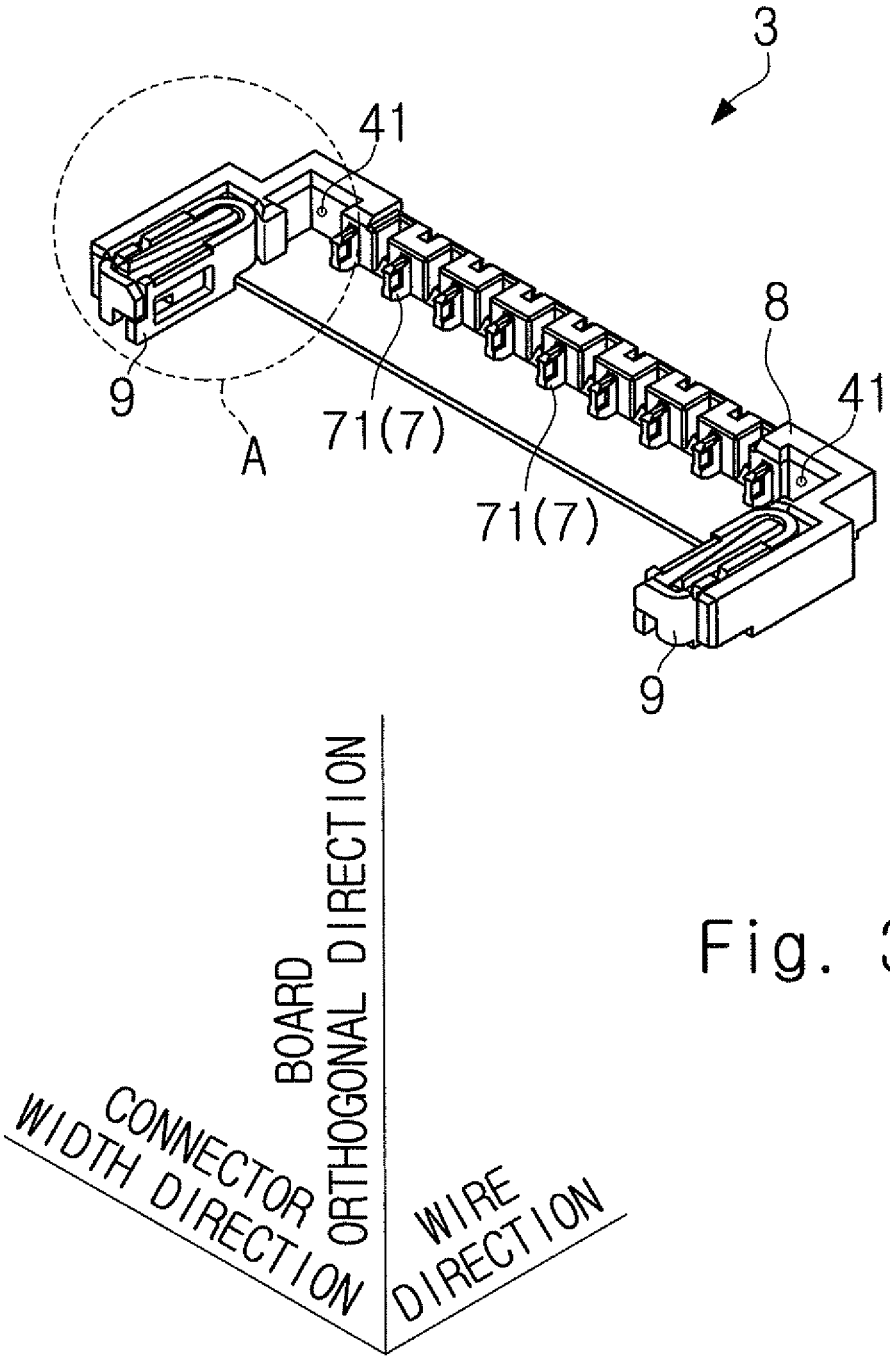
FIG. 3 is a perspective view of a receptacle connector (first embodiment)
Figure 4:
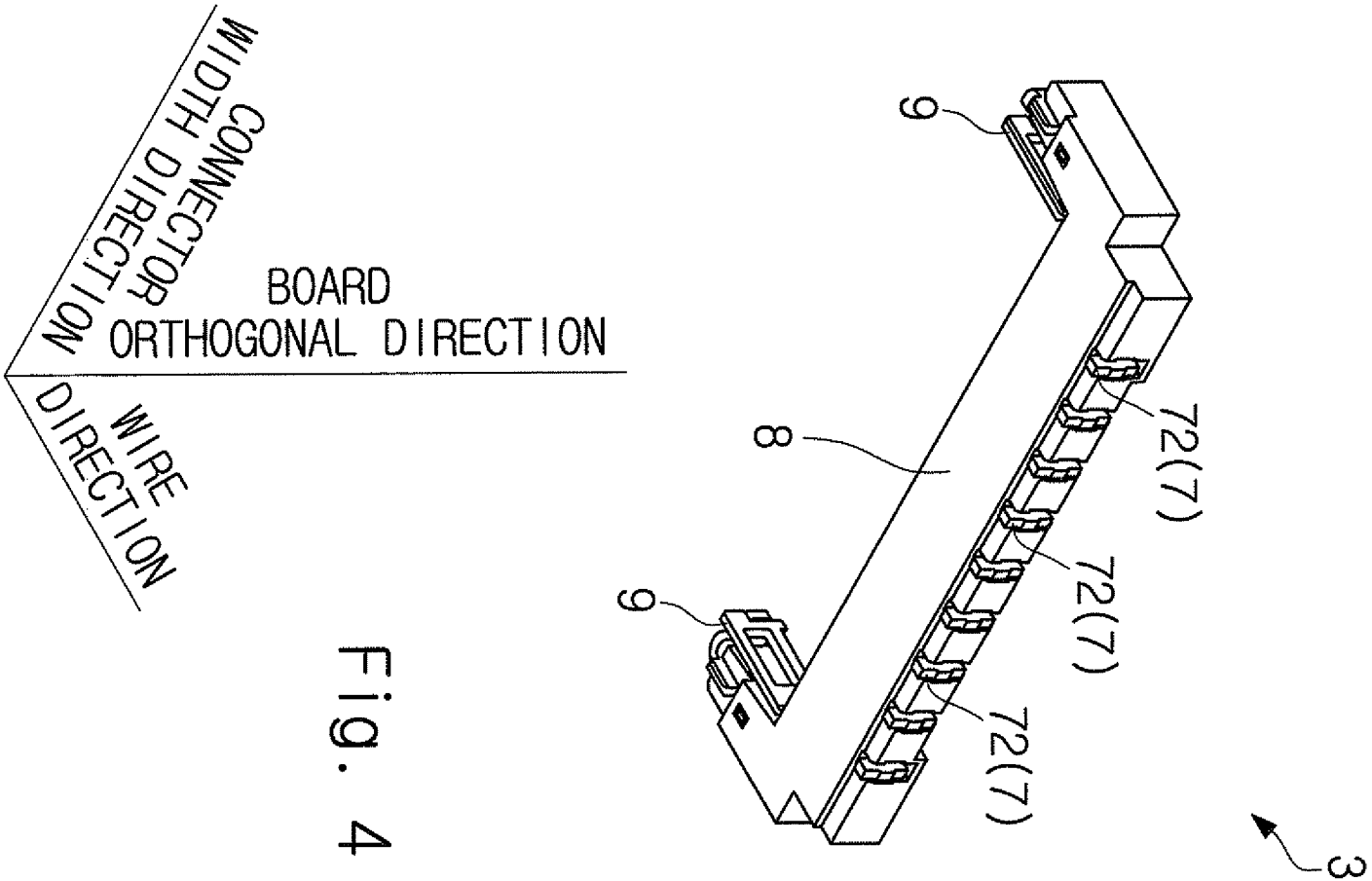
FIG. 4 is a perspective view of the receptacle connector when viewed from another angle (first embodiment)

As shown in FIGS. 3 and 4, the receptacle connector 3 includes the plurality of receptacle contacts 7, the receptacle housing 8 which holds the plurality of receptacle contacts 7, and the pair of assistant fittings 9 which are attached to the receptacle housing 8, as described above.

(Receptacle Connector 3: Receptacle Housing 8)

Figure 5:
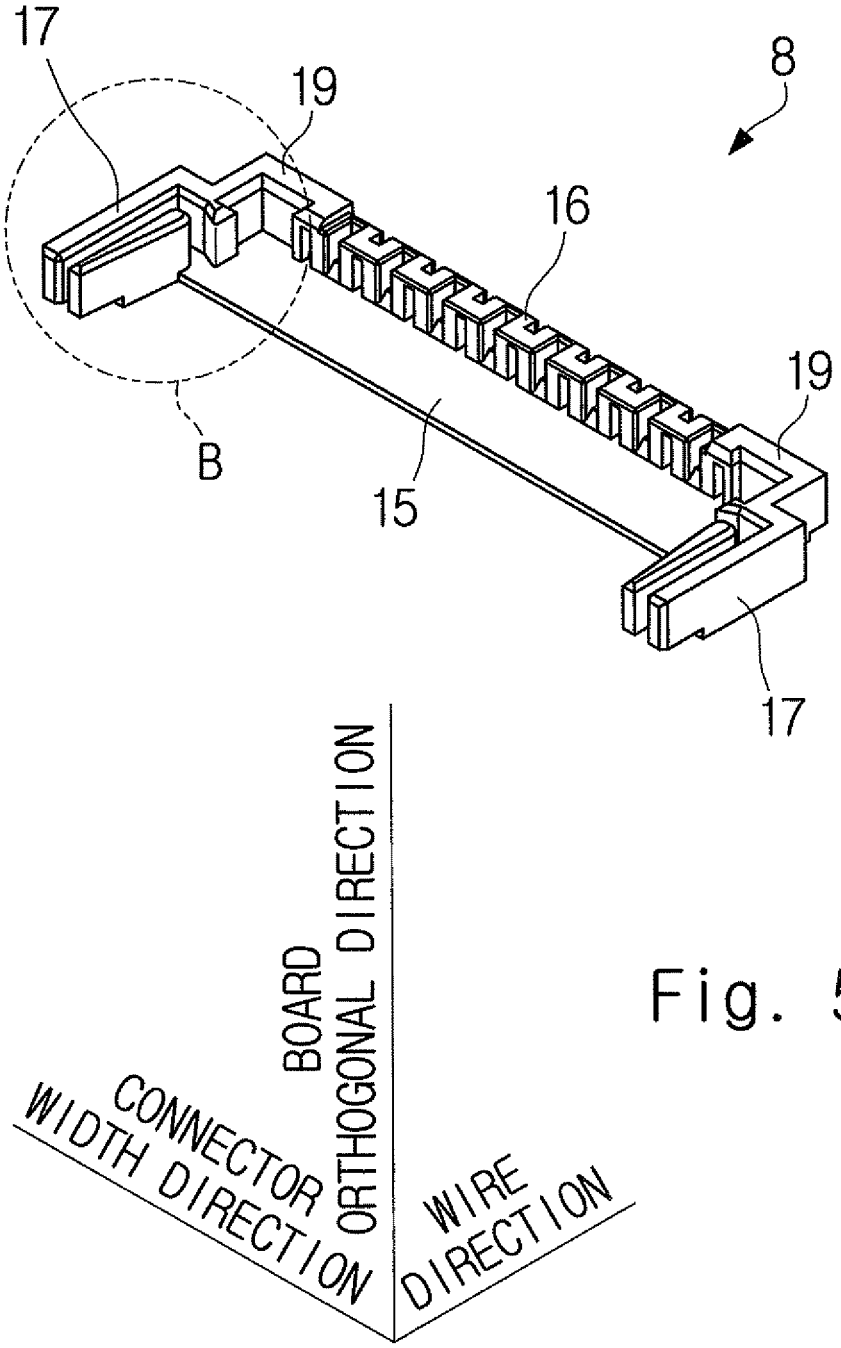
FIG. 5 is a perspective view of a receptacle housing (first embodiment)
Figure 6:
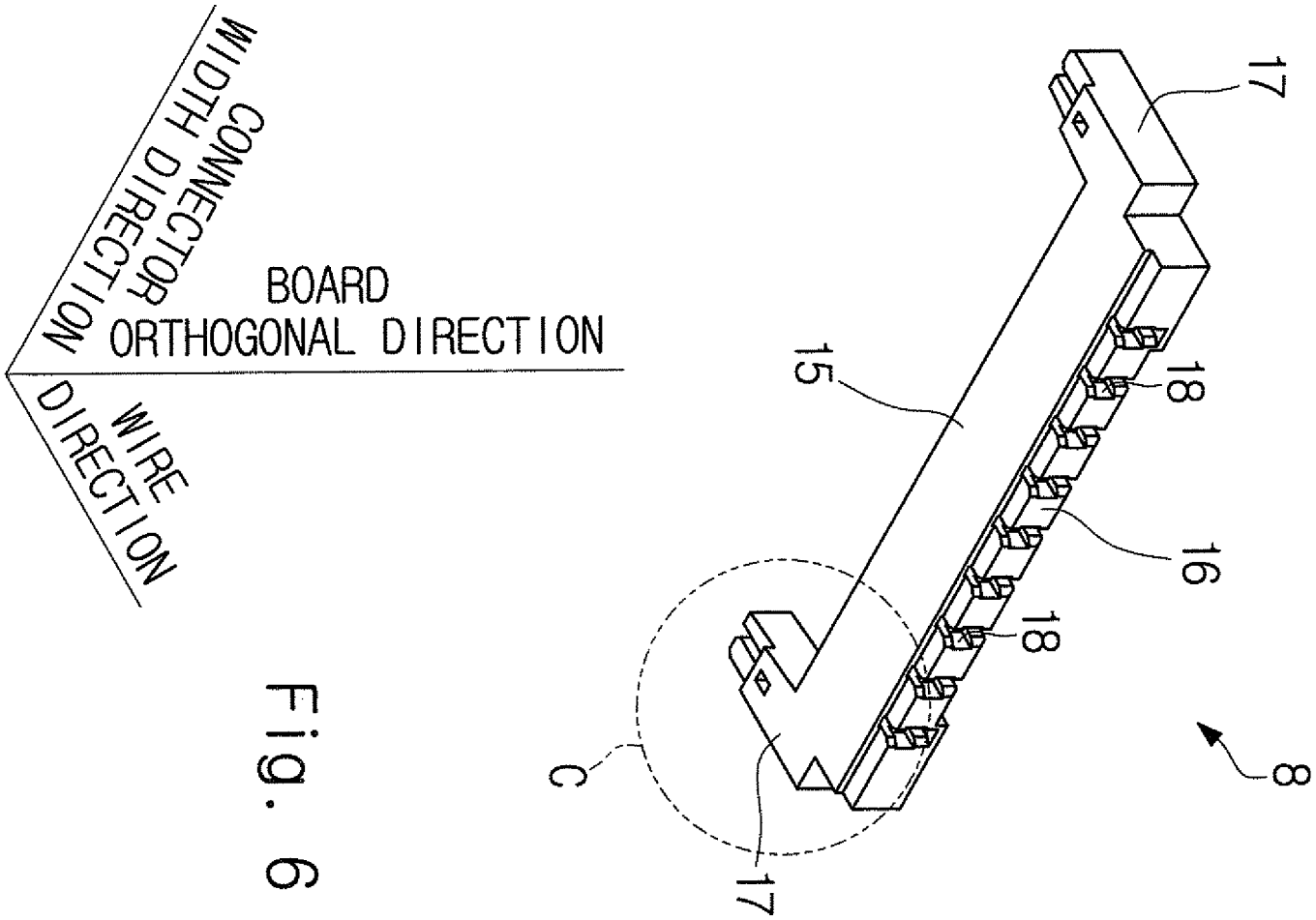
FIG. 6 is a perspective view of the receptacle housing when viewed from another angle (first embodiment)

As shown in FIGS. 5 and 6, the receptacle housing 8 includes a board opposing portion 15, a receptacle contact holding portion 16, and a pair of assistant fitting attachment portions 17. The board opposing portion 15, the receptacle contact holding portion 16, and the pair of assistant fitting attachment portions 17, which constitute the receptacle housing 8, are integrally formed of a material having an insulating property, such as resin.

The board opposing portion 15 is a flat plate parallel to the connector mounting surface 10*a* of the circuit board 10, and is formed in a rectangular shape elongated in the connector width direction.

The receptacle contact holding portion 16 is a portion that projects in the board separating direction from an end of the board opposing portion 15 on the wire connector direction side and is elongated in the connector width direction. As shown in FIG. 6, the receptacle contact holding portion 16 has a plurality of receptacle contact mounting holes 18 formed therein. Each receptacle contact mounting hole 18 is an mounting hole for attaching each receptacle contact 7 to the receptacle housing 8. The plurality of receptacle contact mounting holes 18 are formed at predetermined intervals along the connector width direction. Each receptacle contact mounting hole 18 is formed so as to penetrate the receptacle contact holding portion 16 in the wire direction. That is, each receptacle contact mounting hole 18 is formed so as to be opened in the wire connector direction and the connector wire direction. As shown in FIG. 5, the receptacle contact holding portion 16 includes a pair of ends 19. Each one of the pair of ends 19 is an end of the receptacle contact holding portion 16 in the connector width direction. Each one of the pair of ends 19 is a wall orthogonal to the wire direction.

The pair of assistant fitting attachment portions 17 is formed on both ends of the board opposing portion 15 and the receptacle contact holding portion 16 in the connector width direction. The pair of assistant fitting attachment portions 17 is formed to be elongated along the wire direction. The pair of assistant fitting attachment portions 17 is disposed on the connector wire direction side relative to the receptacle contact holding portion 16. The pair of assistant fitting attachment portions 17 is formed in a symmetrical shape with respect to the center of the wire-to-board connector 1 in the connector width direction. Accordingly, only one of the pair will be described, and the description of the other one of the pair will be omitted.

Figure 7:
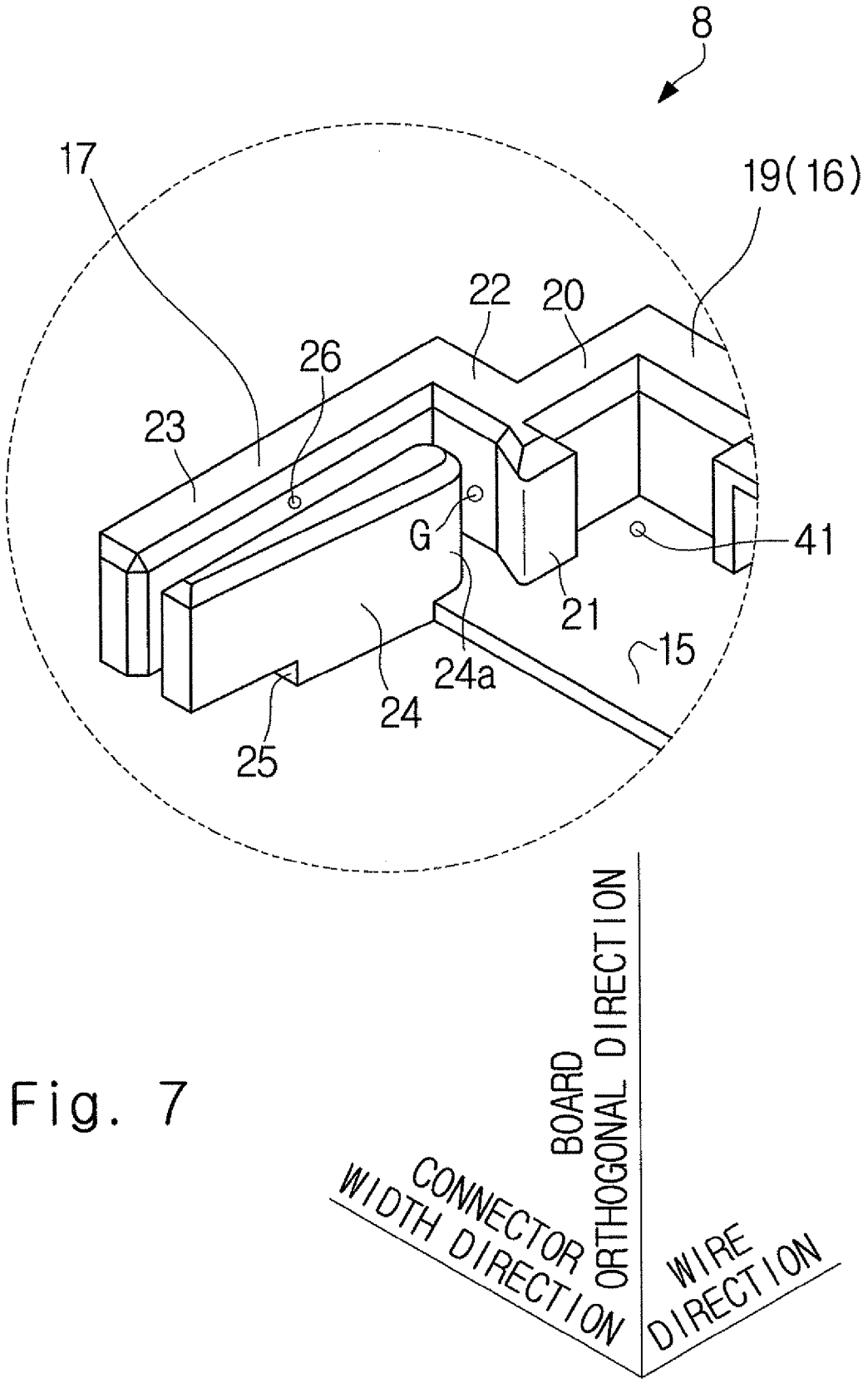
FIG. 7 is an enlarged view of a portion "B" shown in FIG. 5 (first embodiment)
Figure 8:
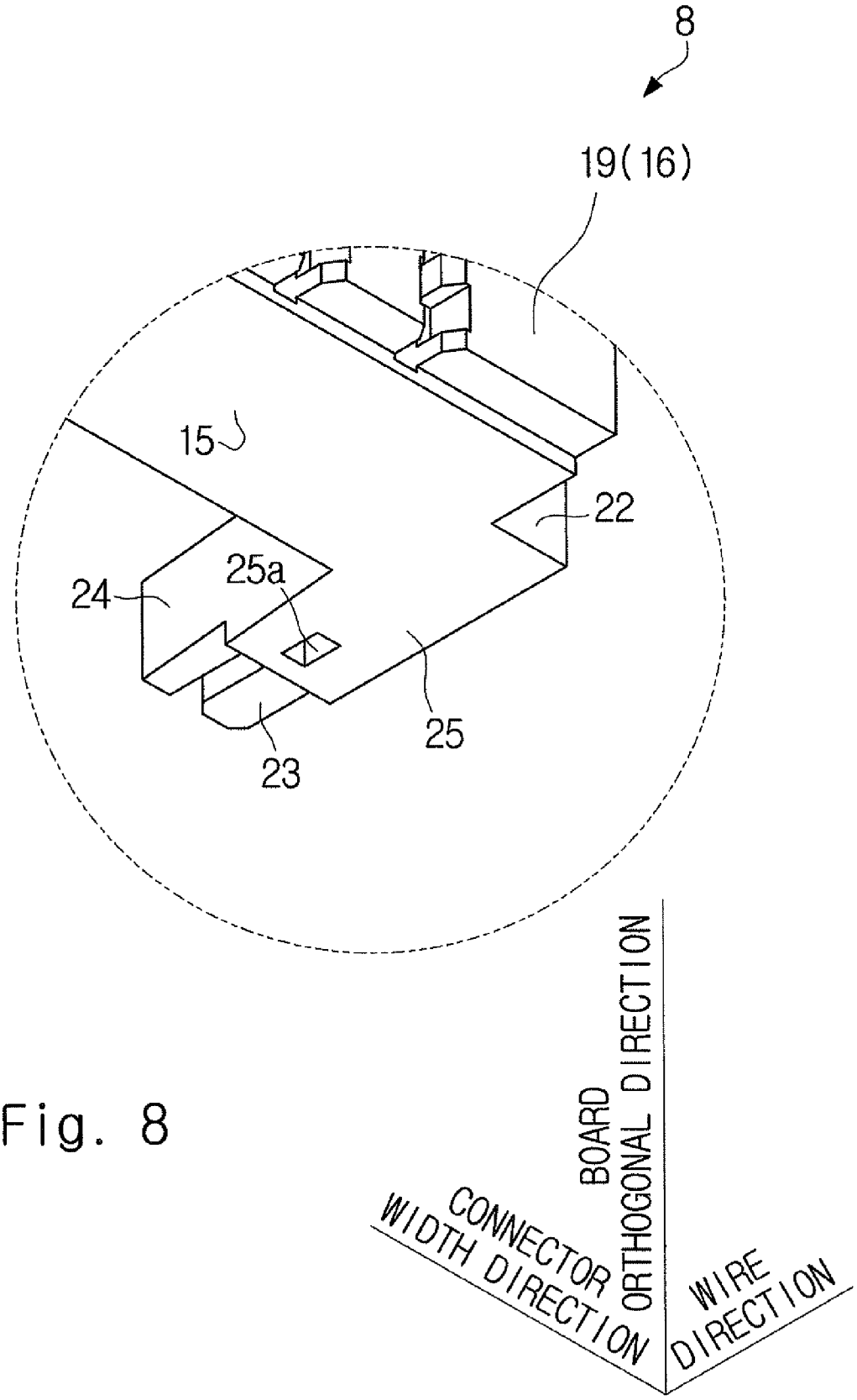
FIG. 8 is an enlarged view of a portion "C" shown in FIG. 6 (first embodiment)

As shown in FIGS. 7 and 8, the assistant fitting attachment portion 17 includes a positioning groove side partition wall portion 20, a positioning groove front partition wall portion 21, a fitting holding groove back partition wall portion 22, a fitting holding groove side partition wall portion 23, a fitting holding groove inner partition wall portion 24, and a fitting holding groove lower partition wall portion 25.

The positioning groove side partition wall portion 20 is a wall extending in the connector wire direction from an end of the corresponding end 19 of the receptacle contact holding portion 16 on the connector width anti-center direction side. The positioning groove side partition wall portion 20 is orthogonal to the connector width direction.

The positioning groove front partition wall portion 21 is a wall projecting in the connector width center direction from an end of the positioning groove side partition wall portion 20 on the connector wire direction side.

The end 19 of the receptacle contact holding portion 16 and the positioning groove side partition wall portion 20 and the positioning groove front partition wall portion 21 of the assistant fitting attachment portion 17 form a positioning groove 41. The end 19 of the receptacle contact holding portion 16 defines the positioning groove 41 in the wire connector direction. The positioning groove side partition wall portion 20 defines the positioning groove 41 in the connector width anti-center direction. The positioning groove front partition wall portion 21 defines the positioning groove 41 in the connector wire direction.

The fitting holding groove back partition wall portion 22 is a wall extending in the connector width anti-center direction from an end of the positioning groove side partition wall portion 20 on the connector wire direction side. The fitting holding groove back partition wall portion 22 is orthogonal to the wire direction.

The fitting holding groove side partition wall portion 23 is a wall extending in the connector wire direction from an end of the fitting holding groove back partition wall portion 22 in the connector width anti-center direction. The fitting holding groove side partition wall portion 23 is orthogonal to the connector width direction.

The fitting holding groove inner partition wall portion 24 is a wall which is disposed at a position slightly apart from the fitting holding groove side partition wall portion 23 in the connector width center direction and is substantially parallel to the fitting holding groove side partition wall portion 23. The fitting holding groove inner partition wall portion 24 is substantially orthogonal to the connector width direction. The fitting holding groove inner partition wall portion 24 is formed with a thickness that gradually decreases in the connector wire direction. A curved surface 24*a*, which protrudes in the wire connector direction, is formed at an end of the fitting holding groove inner partition wall portion 24 on the wire connector direction side.

The fitting holding groove lower partition wall portion 25 is a wall that couples an end of the fitting holding groove side partition wall portion 23 on the board approaching direction side with an end of the fitting holding groove inner partition wall portion 24 on the board approaching direction side. As shown in FIG. 8, the fitting holding groove lower partition wall portion 25 is orthogonal to the board orthogonal direction. The fitting holding groove lower partition wall portion 25 has a press-fit hole 25*a* formed therein. An end of the fitting holding groove side partition wall portion 23 on the connector wire direction side and an end of the fitting holding groove inner partition wall portion 24 on the connector wire direction side are each exposed in the board approaching direction.

As shown in FIG. 7, the fitting holding groove side partition wall portion 23, the fitting holding groove inner partition wall portion 24, and the fitting holding groove lower partition wall portion 25 form a fitting holding groove 26. The fitting holding groove side partition wall portion 23 defines the fitting holding groove 26 in the connector width anti-center direction. The fitting holding groove inner partition wall portion 24 defines the fitting holding groove 26 in the connector width center direction. The fitting holding groove lower partition wall portion 25 defines the fitting holding groove 26 in the board approaching direction. The fitting holding groove 26 is opened in the board separating direction. The fitting holding groove 26 is formed to be elongated along the wire direction.

The curved surface 24*a* of the fitting holding groove inner partition wall portion 24 is opposed to the fitting holding groove back partition wall portion 22 in the wire direction. A gap G is formed between the curved surface 24*a* of the fitting holding groove inner partition wall portion 24 and the fitting holding groove back partition wall portion 22.

(Receptacle Connector 3: Assistant Fittings 9)

Next, the pair of assistant fittings 9 will be described with reference to FIGS. 9 and 10. The pair of assistant fittings 9 is formed in a symmetrical shape with respect to the center of the wire-to-board connector 1 in the connector width direction. Accordingly, only one of the pair will be described, and the description of the other one of the pair will be omitted.

The assistant fitting 9 includes a held portion 30, a fixing portion 31, a coupling portion 32, and a displacement regulating portion 33. The assistant fitting 9 is formed by plate bending.

The held portion 30 is a portion that is held by the receptacle housing 8. The held portion 30 is formed so as to extend in the wire direction. The held portion 30 is orthogonal to the connector width direction. As shown in FIG. 10, the held portion 30 includes a held portion body 30*a*, a press-fitted portion 30*b*, and a leg portion 30*c*. The press-fitted portion 30*b* is a portion that is press-fitted into the press-fit hole 25*a* of the fitting holding groove lower partition wall portion 25 shown in FIG. 8. The press-fitted portion 30*b* is formed so as to project in the board approaching direction from a middle portion of the held portion body 30*a* in the wire direction. The leg portion 30*c* is a portion that is soldered to the connector mounting surface 10*a* of the circuit board 10, and projects in the board approaching direction from an end of the held portion body 30*a* on the connector wire direction side.

The fixing portion 31 is a portion that is hooked to the plug housing 5 to thereby fix the plug connector 2 to the receptacle connector 3. The fixing portion 31 is formed so as to extend in the wire direction. The fixing portion 31 is orthogonal to the connector width direction. The fixing portion 31 is opposed to the held portion 30 in the connector width direction in the state shown in FIG. 9 in which the assistant fitting 9 is not attached to the receptacle housing 8. As shown in FIG. 9, the fixing portion 31 includes a fixing portion body 34 and a regulated projection 35.

The fixing portion body 34 is formed to be elongated in the wire direction. The fixing portion body 34 has a lock hole 36 formed therein. The lock hole 36 has a substantially rectangular shape when viewed along the connector width anti-center direction. The lock hole 36 is formed to be elongated in the wire direction. Since the lock hole 36 is formed, a lock beam 37 which defines the lock hole 36 in the board separating direction is formed on the board separating direction side of the lock hole 36. The lock beam 37 includes a receptacle lock surface 38, a plug opposing surface 39, and a mating guide surface 40. The receptacle lock surface 38 is a flat surface that faces in the board approaching direction. The receptacle lock surface 38 is orthogonal to the board orthogonal direction. The receptacle lock surface 38 is formed to be elongated in the wire direction. The plug opposing surface 39 is a flat surface that is connected to an edge of the receptacle lock surface 38 on the connector width center direction side and faces in the connector width center direction. The plug opposing surface 39 is orthogonal to the connector width direction. The mating guide surface 40 is a flat surface that is connected to an edge of the plug opposing surface 39 on the board separating direction side and is inclined in the connector width center direction toward the board approaching direction.

The regulated projection 35 projects in the connector wire direction from a portion of an end of the fixing portion body 34 on the connector wire direction side, the portion being nearest to the circuit board 10.

The coupling portion 32 is a portion that couples an end of the held portion 30 on the wire connector direction side with an end of the fixing portion 31 on the wire connector direction side. The coupling portion 32 is formed to be curved in a convex shape projecting in the wire connector direction. Accordingly, the held portion 30, the fixing portion 31, and the coupling portion 32 form a substantially U-shape when viewed along the board approaching direction. It can be said that due to the presence of the coupling portion 32, the fixing portion 31 is supported by the held portion 30 with the coupling portion 32 interposed therebetween and is formed in a cantilever shape extending in parallel to the connector mounting surface 10*a* of the circuit board 10. Further, due to the presence of the coupling portion 32, the fixing portion 31 is elastically displaceable in the direction approaching the held portion 30, that is, in the connector width anti-center direction.

The displacement regulating portion 33 is a portion that regulates a displacement of the fixing portion 31. The displacement regulating portion 33 includes a vertical displacement regulating portion 42 (first displacement regulating portion) and a horizontal displacement regulating portion 43 (second displacement regulating portion). The vertical displacement regulating portion 42 and the horizontal displacement regulating portion 43 projects in the connector width center direction from an end of the held portion 30 on the connector wire direction side. The vertical displacement regulating portion 42 and the horizontal displacement regulating portion 43 are orthogonal to the wire direction. The vertical displacement regulating portion 42 is disposed on the board separating direction side relative to the horizontal displacement regulating portion 43. The horizontal displacement regulating portion 43 is disposed on the board approaching direction side relative to the vertical displacement regulating portion 42. The vertical displacement regulating portion 42 projects in the connector width center direction to a greater extent than the horizontal displacement regulating portion 43. The horizontal displacement regulating portion 43 projects in the connector width center direction to a smaller extent than the vertical displacement regulating portion 42. In other words, the horizontal displacement regulating portion 43 is recessed when viewed along the connector width anti-center direction relative to the vertical displacement regulating portion 42. The vertical displacement regulating portion 42 has a distal end 42*a*. The distal end 42*a* of the vertical displacement regulating portion 42 is a distal end portion of the vertical displacement regulating portion 42 on the connector width center direction side. The distal end 42*a* of the vertical displacement regulating portion 42 is opposed to the regulated projection 35 of the fixing portion 31 in the board orthogonal direction. The distal end 42*a* of the vertical displacement regulating portion 42 is disposed on the board separating direction side relative to the regulated projection 35 of the fixing portion 31. Accordingly, when the fixing portion 31 is displaced in the board separating direction, the regulated projection 35 of the fixing portion 31 is immediately brought into contact with the distal end 42*a* of the vertical displacement regulating portion 42 of the displacement regulating portion 33, thereby inhibiting a further displacement of the fixing portion 31. A gap H formed between the regulated projection 35 of the fixing portion 31 and the distal end 42*a* of the vertical displacement regulating portion 42 of the displacement regulating portion 33 is set to be as small as possible in this embodiment. Accordingly, the displacement of the fixing portion 31 in the board separating direction is substantially inhibited. The horizontal displacement regulating portion 43 is opposed to the regulated projection 35 of the fixing portion 31 in the connector width direction. The horizontal displacement regulating portion 43 is disposed on the connector width anti-center direction side relative to the regulated projection 35 of the fixing portion 31. Thus, when the fixing portion 31 is displaced in the connector width anti-center direction, the regulated projection 35 of the fixing portion 31 is brought into contact with the horizontal displacement regulating portion 43 of the displacement regulating portion 33, thereby inhibiting a further displacement of the fixing portion 31. A gap J formed between the regulated projection 35 of the fixing portion 31 and the horizontal displacement regulating portion 43 of the displacement regulating portion 33 is set to a relatively large value in this embodiment. Accordingly, the fixing portion 31 is allowed to be displaced to some extent in the connector width anti-center direction, and a displacement of the fixing portion 31 exceeding a predetermined amount is inhibited. As shown in FIG. 10, the vertical displacement regulating portion 42 and the horizontal displacement regulating portion 43 of the displacement regulating portion 33 are formed in the vicinity of the leg portion 30*c* of the held portion 30. In other words, the leg portion 30*c* of the held portion 30 is formed in the vicinity of the vertical displacement regulating portion 42 and the horizontal displacement regulating portion 43 of the displacement regulating portion 33.

(Receptacle Connector 3: Receptacle Contact 7)

Figure 11:
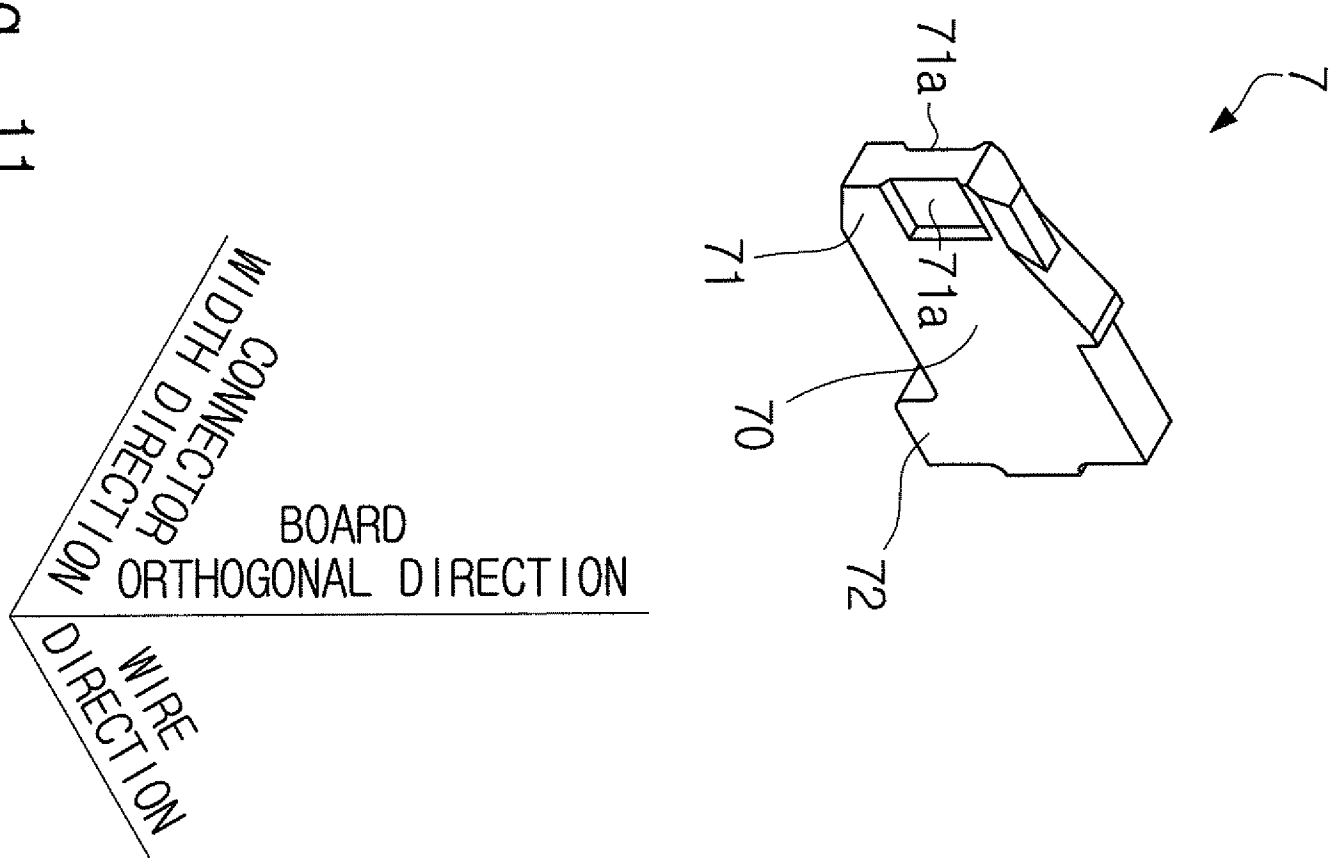
FIG. 11 is a perspective view of a receptacle contact (first embodiment)

Next, the receptacle contact 7 will be described with reference to FIG. 11. As shown in FIG. 11, the receptacle contact 7 is a plate body that is orthogonal to the connector width direction. The receptacle contact 7 includes a receptacle contact body 70, a receptacle contact point portion 71, and a receptacle contact leg portion 72. The receptacle contact body 70 is formed to be elongated in the wire direction. The receptacle contact point portion 71 projects in the connector wire direction from an end of the receptacle contact body 70 on the connector wire direction side. The receptacle contact point portion 71 has a pair of recesses 71*a* formed therein. The receptacle contact leg portion 72 projects in the board approaching direction from an end of the receptacle contact body 70 on the wire connector direction side.

(Assembly of the Receptacle Connector 3)

Next, a method for assembling the receptacle connector 3 will be described in detail.

First, as shown in FIGS. 2 to 6, the plurality of receptacle contacts 7 are respectively press-fitted into the plurality of receptacle contact mounting holes 18 of the receptacle contact holding portion 16 of the receptacle housing 8. A direction in which the receptacle contacts 7 are respectively press-fitted into the receptacle contact mounting holes 18 is equal to the connector wire direction. As shown in FIG. 3, the receptacle contact point portion 71 of each receptacle contact 7 is exposed in the connector wire direction in the state in which each receptacle contact 7 is attached to the receptacle housing 8. Similarly, as shown in FIG. 4, the receptacle contact leg portion 72 of each receptacle contact 7 is exposed in the board approaching direction in the state in which each receptacle contact 7 is attached to the receptacle housing 8.

Figure 12:
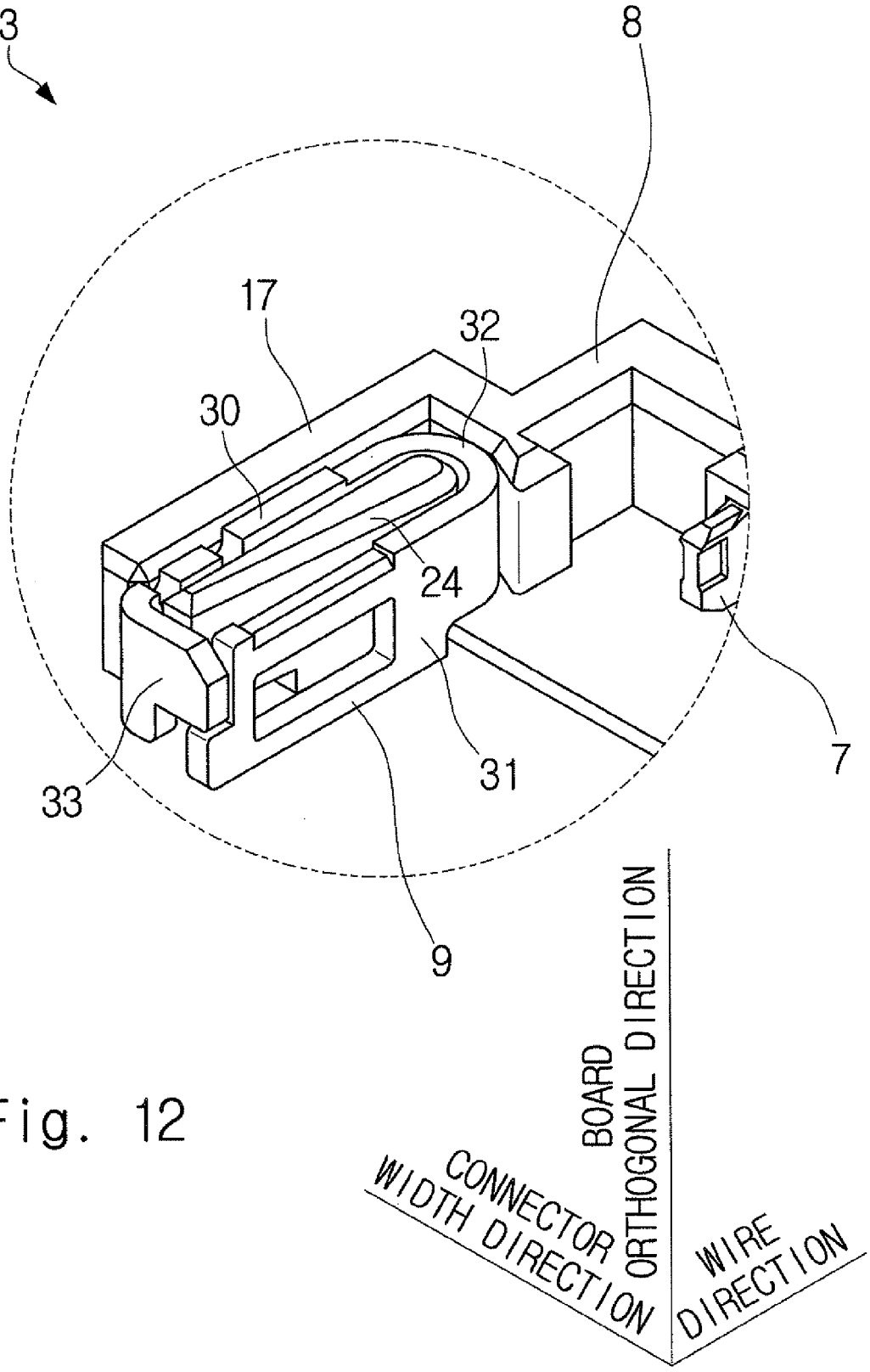
FIG. 12 is an enlarged view of a portion "A" shown in FIG. 3 (first embodiment)

Next, as shown in FIG. 12, each one of the pair of assistant fittings 9 is attached to the corresponding one of the pair of assistant fitting attachment portions 17 of the receptacle housing 8. Specifically, the assistant fittings 9 are first positioned relative to the assistant fitting attachment portions 17 in such a manner that the held portion 30 of each assistant fitting 9 shown in FIG. 9 is capable of being inserted into the fitting holding groove 26 of each assistant fitting attachment portion 17 of the receptacle housing 8 shown in FIG. 7 and the coupling portion 32 of each assistant fitting 9 shown in FIG. 9 is capable of being inserted into the gap G of each assistant fitting attachment portion 17 of the receptacle housing 8 shown in FIG. 7. In this manner, the assistant fittings 9 are positioned relative to the assistant fitting attachment portions 17, and the assistant fittings 9 are respectively pushed into the assistant fitting attachment portions 17 in the board approaching direction.

Figure 9:
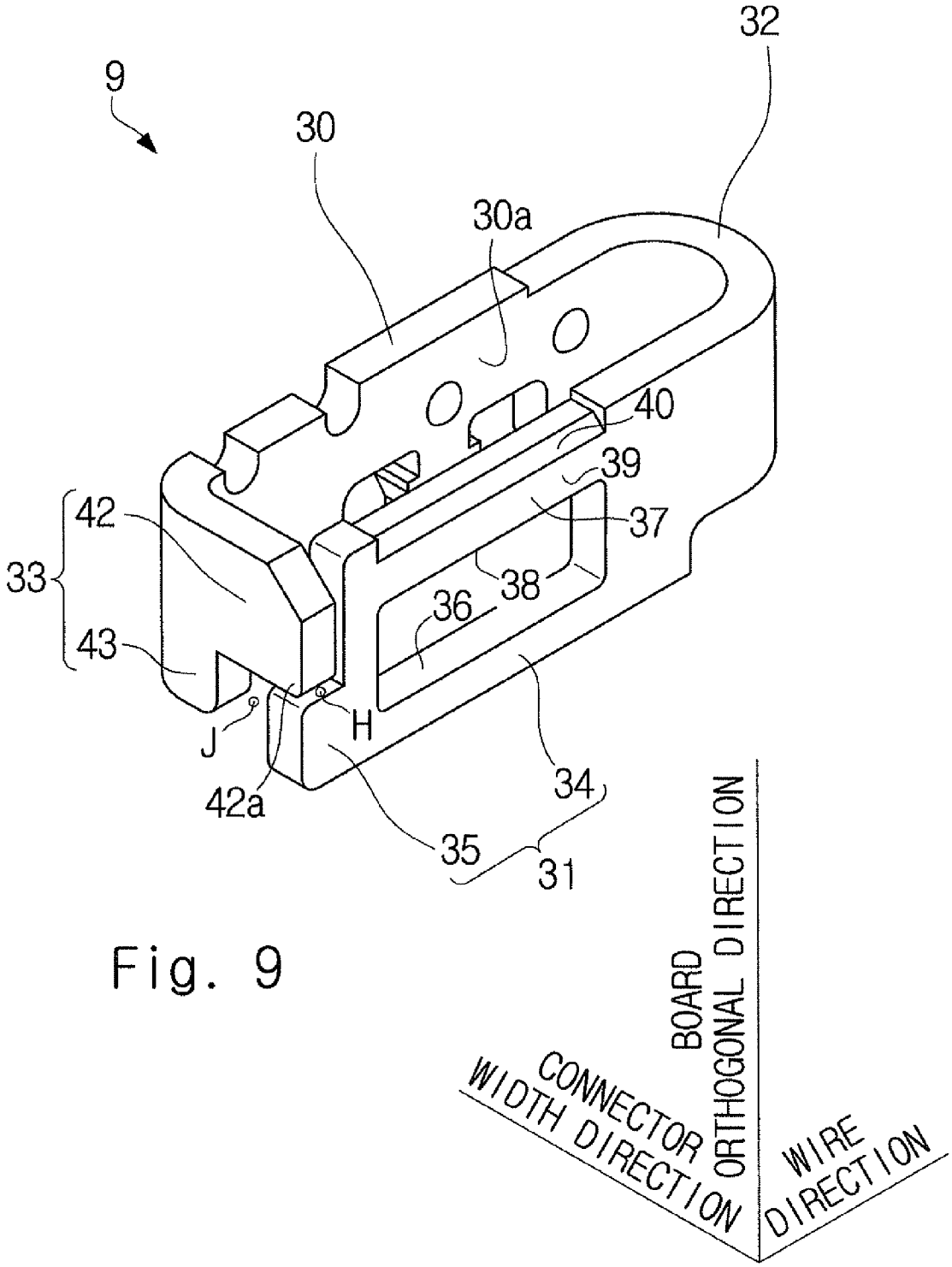
FIG. 9 is a perspective view of an assistant fitting (first embodiment)

Then, the held portion 30 of each assistant fitting 9 shown in FIG. 9 is inserted into the fitting holding groove 26 of each assistant fitting attachment portion 17 of the receptacle housing 8 shown in FIG. 7, and the coupling portion 32 of each assistant fitting 9 shown in FIG. 9 is inserted into the gap G of each assistant fitting attachment portion 17 of the receptacle housing 8 shown in FIG. 7. At this time, the press-fitted portion 30*b* of the held portion 30 of each assistant fitting 9 shown in FIG. 10 is press-fitted into the press-fit hole 25*a* of the fitting holding groove lower partition wall portion 25 of each assistant fitting attachment portion 17 of the receptacle housing 8 shown in FIG. 8. This press-fitting allows the assistant fittings 9 to be firmly fixed to the assistant fitting attachment portions 17, respectively.

Figure 13:
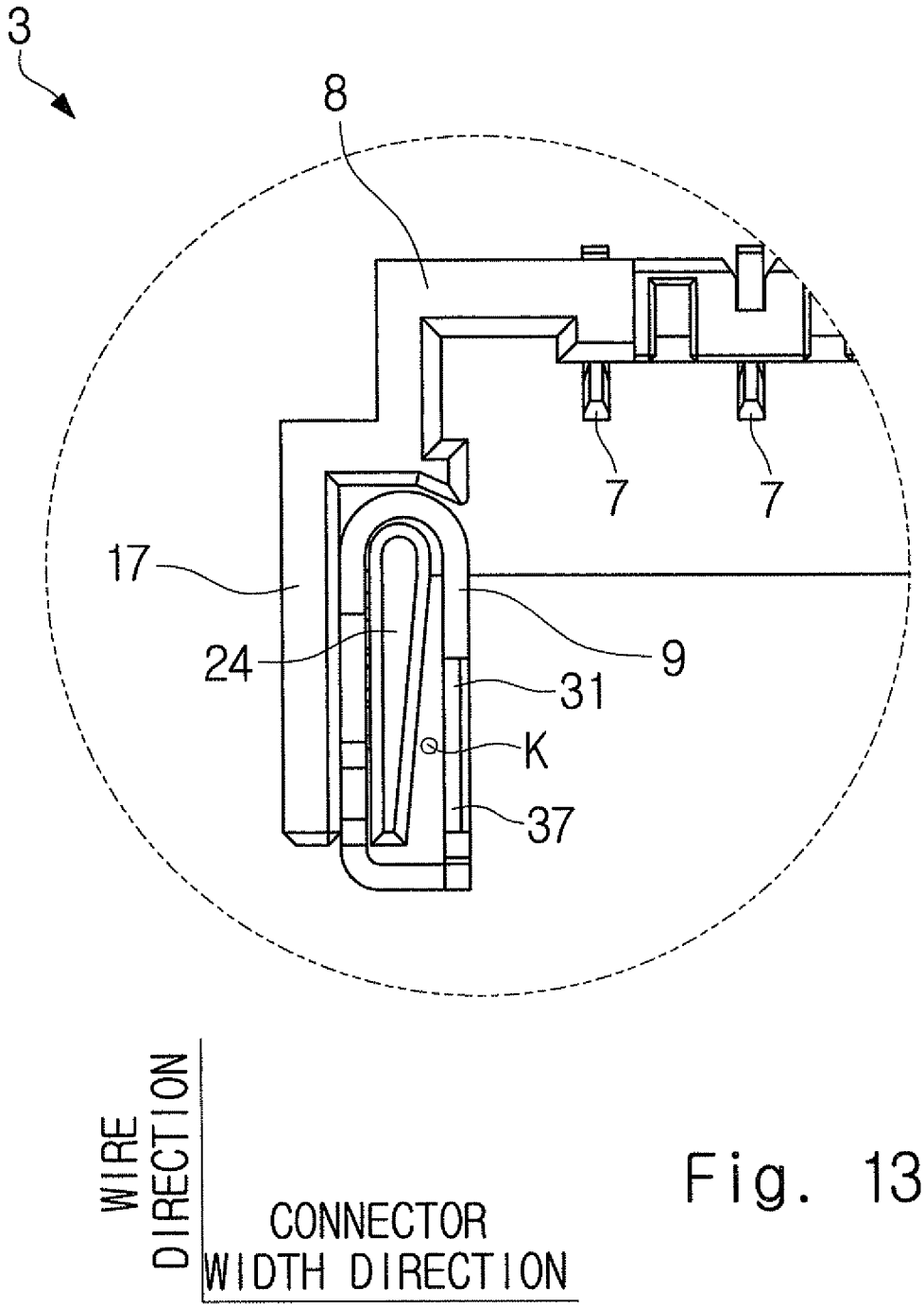
FIG. 13 is a partial plan view of the receptacle connector (first embodiment)

FIGS. 12 and 13 each show the state in which each assistant fitting 9 is attached to the corresponding assistant fitting attachment portion 17 of the receptacle housing 8. As shown in FIGS. 12 and 13, the fitting holding groove inner partition wall portion 24 is disposed so as to be surrounded by the assistant fitting 9. As shown in FIG. 13, in the state in which each assistant fitting 9 is attached to the corresponding assistant fitting attachment portion 17 of the receptacle housing 8, a gap K is formed between the fitting holding groove inner partition wall portion 24 of the corresponding assistant fitting attachment portion 17 and the fixing portion 31 of the corresponding assistant fitting 9. Accordingly, the fixing portion 31 of each assistant fitting 9 is elastically displaceable in the connector width anti-center direction. Specifically, the fixing portion 31 of each assistant fitting 9 is elastically displaceable in the connector width anti-center direction so as to be rotatable about an end of the fixing portion 31 on the wire connector direction side. As shown in FIG. 13, the fitting holding groove inner partition wall portion 24 is formed with a thickness that gradually decreases in the connector wire direction. Thus, it is ensured that the fitting holding groove inner partition wall portion 24 has a maximum thickness and has an excellent strength, while allowing an elastic displacement of the fixing portion 31 of each assistant fitting 9.

(Plug Connector 2)

Next, the plug connector 2 will be described in detail with reference to FIGS. 14 to 18.

As described above, the plug connector 2 shown in FIGS. 14 and 15 includes the plurality of plug contacts 4 and the plug housing 5 that holds the plurality of plug contacts 4.

The plug housing 5 includes a plug housing body 50, a releasing projection 51, a pair of positioning projections 52, and a pair of projecting portions 53.

As shown in FIG. 14, the plug housing body 50 is a flat body which is thin in the board orthogonal direction. The plug housing body 50 is formed in a rectangular shape when viewed along the board approaching direction and is elongated in the connector width direction. The plug housing body 50 has a plurality of plug contact mounting holes 54 formed therein. The plurality of plug contact mounting holes 54 are formed at predetermined intervals along the connector width direction. Each plug contact mounting hole 54 is formed so as to penetrate the plug housing body 50 in the wire direction. That is, each plug contact mounting hole 54 is formed so as to be opened in the wire connector direction and the connector wire direction.

The plug housing body 50 has a pair of plug side surfaces 50*a* as a pair of side surfaces of the plug housing body 50. Each one of the pair of plug side surfaces 50*a* is a flat surface substantially parallel to each of the wire direction and the board orthogonal direction. In other words, each plug side surface 50*a* is substantially orthogonal to the connector width direction.

Figure 18:
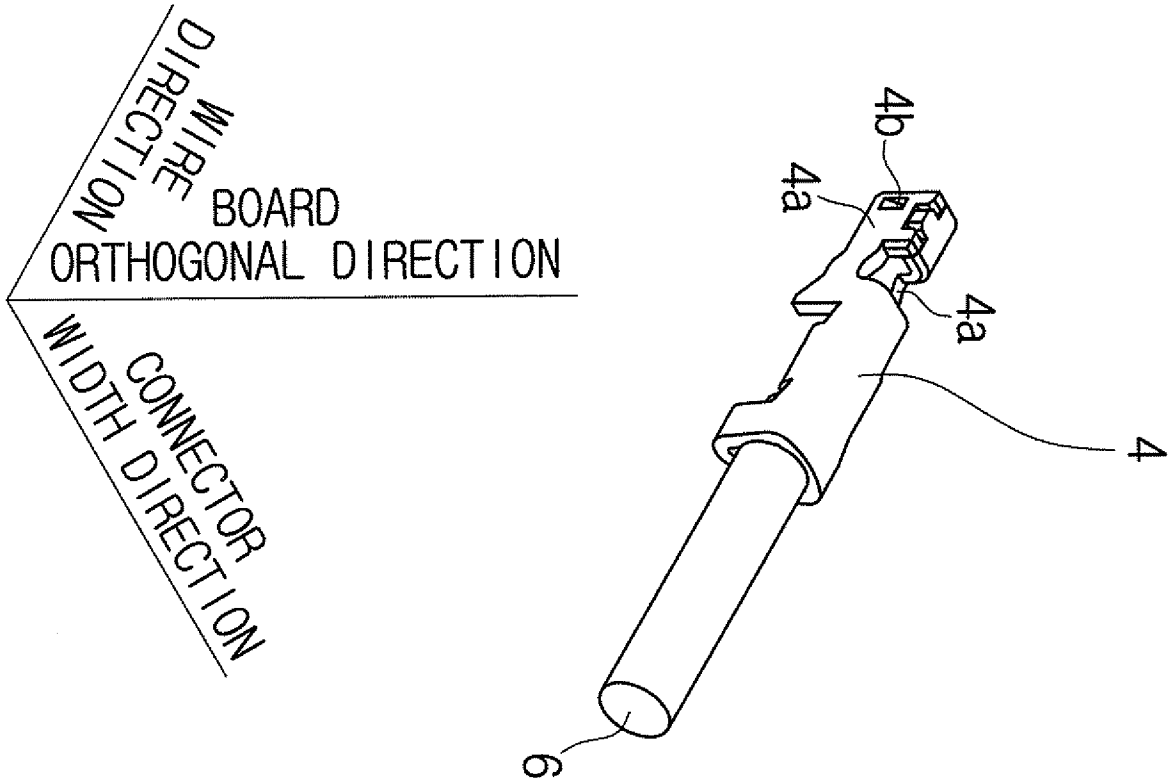
FIG. 18 is a perspective view of a plug contact attached to a wire (first embodiment)

FIG. 18 shows the plug contact 4 which is attached to an end of the corresponding wire 6. The plug contact 4 includes a pair of contact pieces 4*a* which sandwich the corresponding receptacle contact 7 and are thereby brought into contact with the receptacle contact 7. A contact point portion 4*b* which projects so as to be fitted into the corresponding recess 71*a* of the receptacle contact point portion 71 of the receptacle contact 7 shown in FIG. 11 is formed at the inner surface of each contact piece 4*a*. As shown in FIG. 15, the plurality of plug contacts 4 are arranged side by side in the connector width direction. The plurality of plug contacts 4 are sandwiched between the pair of plug side surfaces 50*a* in the connector width direction.

As shown in FIGS. 14 and 15, the releasing projection 51 is a projection that allows the plug connector 2 to be inclined so that the wires 6 approach the connector mounting surface 10*a* of the circuit board 10. The releasing projection 51 projects in the wire connector direction from a portion of an end of the plug housing body 50 on the wire connector direction side, the portion being farthest from the circuit board 10. The releasing projection 51 is formed to be elongated in the connector width direction.

Each positioning projection 52 projects in the connector width anti-center direction from an end of the plug housing body 50 in the connector width direction, the end being located on the wire connector direction side.

Figure 17:
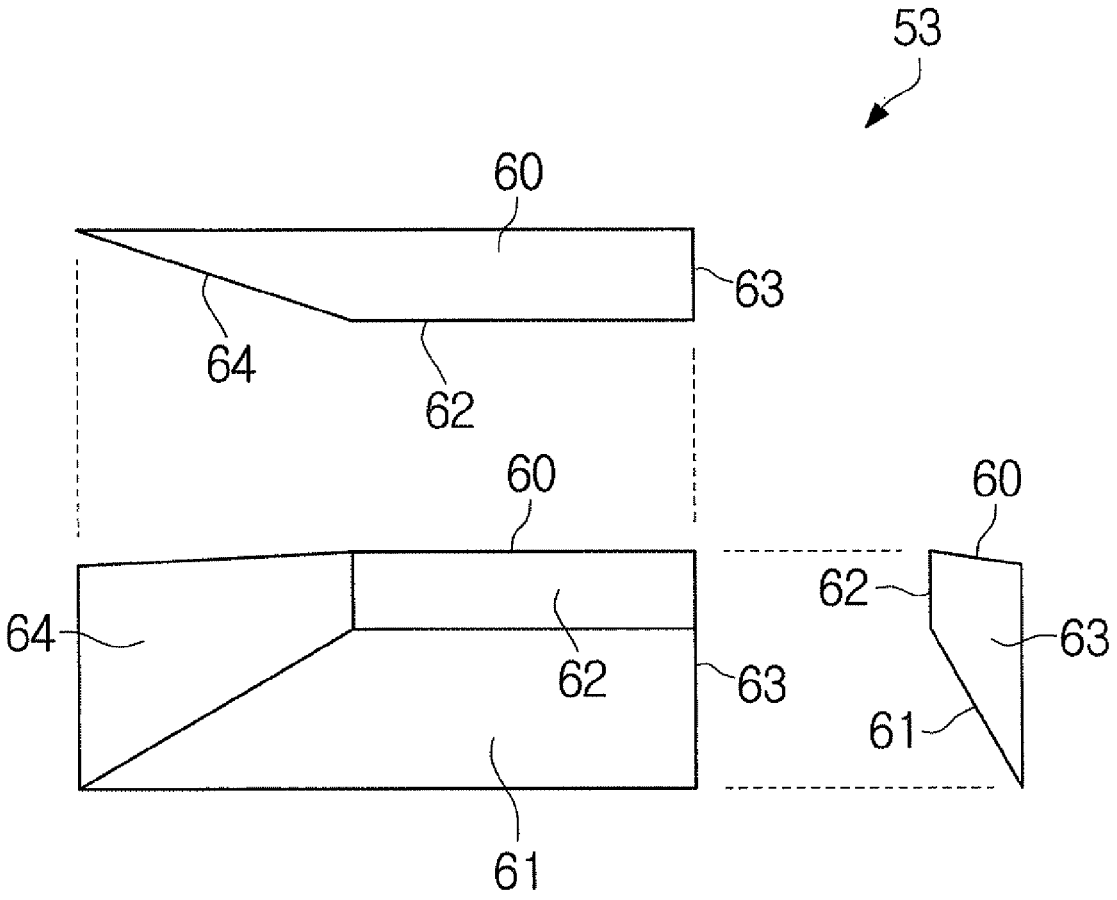
FIG. 17 is a three-view drawing showing a projecting portion (first embodiment)

The pair of projecting portions 53 is formed in a symmetrical shape with respect to the center of the wire-to-board connector 1 in the connector width direction. Accordingly, only one of the pair will be described, and the description of the other one of the pair will be omitted. The projecting portion 53 projects in the connector width anti-center direction from a portion of the corresponding plug side surface 50*a*, the portion being located on the connector wire direction side. The projecting portion 53 is formed to be elongated in the wire direction. As shown in FIG. 16, the projecting portion 53 extends along the wire direction and has a prism shape with a trapezoidal sectional shape. A portion of the projecting portion 53 on the wire connector direction side is obliquely cut off. As shown in FIGS. 16 and 17, the projecting portion 53 includes a plug lock surface 60, a mating guide surface 61, a side standing surface 62, an end standing surface 63, and an end inclined surface 64.

The plug lock surface 60 is a surface that faces in a direction away from the connector mounting surface 10*a* of the circuit board 10 and is elongated in the wire direction. An angle formed between the plug lock surface 60 and the plug side surface 50*a* is about 85 to 90 degrees.

The mating guide surface 61 is a flat surface that faces in a direction approaching the connector mounting surface 10*a* of the circuit board 10 and is elongated in the wire direction. The mating guide surface 61 is inclined in the connector width center direction toward the board approaching direction.

The side standing surface 62 is a flat surface that faces in the connector width anti-center direction and is elongated in the wire direction. The side standing surface 62 is orthogonal to the connector width direction. The side standing surface 62 is connected to each of the plug lock surface 60 and the mating guide surface 61. The side standing surface 62 is formed between the plug lock surface 60 and the mating guide surface 61.

The end standing surface 63 is a flat surface that is connected to the plug side surface 50*a* and faces in the connector wire direction. The end standing surface 63 is orthogonal to the wire direction. The end standing surface 63 is connected to each of the plug lock surface 60, the mating guide surface 61, and the side standing surface 62.

The end inclined surface 64 is a flat surface that is connected to the plug side surface 50*a* and faces in the wire connector direction and the connector width anti-center direction. The end inclined surface 64 is inclined in the connector width center direction toward the wire connector direction. The end inclined surface 64 is connected to each of the plug lock surface 60, the mating guide surface 61, and the side standing surface 62. Due to the presence of the end inclined surface 64, a portion of the projecting portion 53 on the wire connector direction side is formed in such a manner that a projection amount of the projecting portion 53 in the connector width anti-center direction decreases toward the wire connector direction.

(Wires 6)

The structure of wires 6 is not limited to the structure in which each one of the wires 6 is formed in such a manner that a conductor is individually coated as in this embodiment. The wires 6 may be an FFC (Flexible Flat Cable) or FPC (Flexible Printed Circuits).

(Assembly of the Plug Connector 2)

Next, a method for assembling the plug connector 2 will be described. To assemble the plug connector 2, each plug contact 4 is attached to an end of the corresponding wire 6 as shown in FIG. 18, and each plug contact 4 is then inserted into the corresponding plug contact mounting hole 54 of the plug housing body 50 of the plug housing 5 in the wire connector direction as shown in FIGS. 14 and 15. As a result, due to an operation of a lance, which is not shown, each plug contact 4 is inhibited from being disengaged from the corresponding plug contact mounting hole 54.

(Method for Mating the Wire-to-Board Connector 1)

Next, a method for mating the plug connector 2 with the receptacle connector 3 will be described. To mate the plug connector 2 with the receptacle connector 3, the receptacle connector 3 is preliminarily mounted on the connector mounting surface 10*a* of the circuit board 10 as shown in FIG. 2. Specifically, the leg portion 30*c* of the held portion 30 of each assistant fitting 9 shown in FIG. 10 is soldered to a corresponding assistant fitting pad 10*b* on the connector mounting surface 10*a* of the circuit board 10 shown in FIG. 2. The receptacle contact leg portion 72 of each receptacle contact 7 shown in FIG. 11 is soldered to an electrode pad, which is not shown, on the connector mounting surface 10*a* of the circuit board 10.

Next, when the plug connector 2 is caused to descend in the mating direction P toward the receptacle connector 3 as shown in FIG. 2, the following behavior is obtained.

(1) Each one of the pair of positioning projections 52 of the plug housing 5 shown in FIG. 14 is inserted into the corresponding one of the pair of positioning grooves 41 shown in FIG. 3. As a result, the position of the plug connector 2 relative to the receptacle connector 3 is adjusted. In other words, the pair of positioning projections 52 and the pair of positioning grooves 41 exert the effect of positioning the plug connector 2 relative to the receptacle connector 3. Specifically, the effect of positioning the plug connector 2 relative to the receptacle connector 3 means the effect of positioning the plug connector 2 relative to the receptacle connector 3 in a direction parallel to the connector mounting surface 10*a* of the circuit board 10. After the mating of the wire-to-board connector 1, the pair of positioning projections 52 and the pair of positioning grooves 41 exert the retaining effect that inhibits the plug connector 2 from being pulled out from the receptacle connector 3 when the wires 6 are pulled in the connector wire direction.

(2) The receptacle contact point portion 71 of each receptacle contact 7 shown in FIG. 11 is inserted between the pair of contact pieces 4*a* (also see FIG. 18) of each plug contact 4 which is held by the plug housing 5 of the plug connector 2 as shown in FIG. 15. Accordingly, the pair of contact point portions 4*b* shown in FIG. 18 is fitted into the recesses 71*a* of the receptacle contact point portion 71 of each receptacle contact 7 shown in FIG. 11. As a result, each plug contact 4 reliably comes into contact with the corresponding receptacle contact 7.

Figure 19:
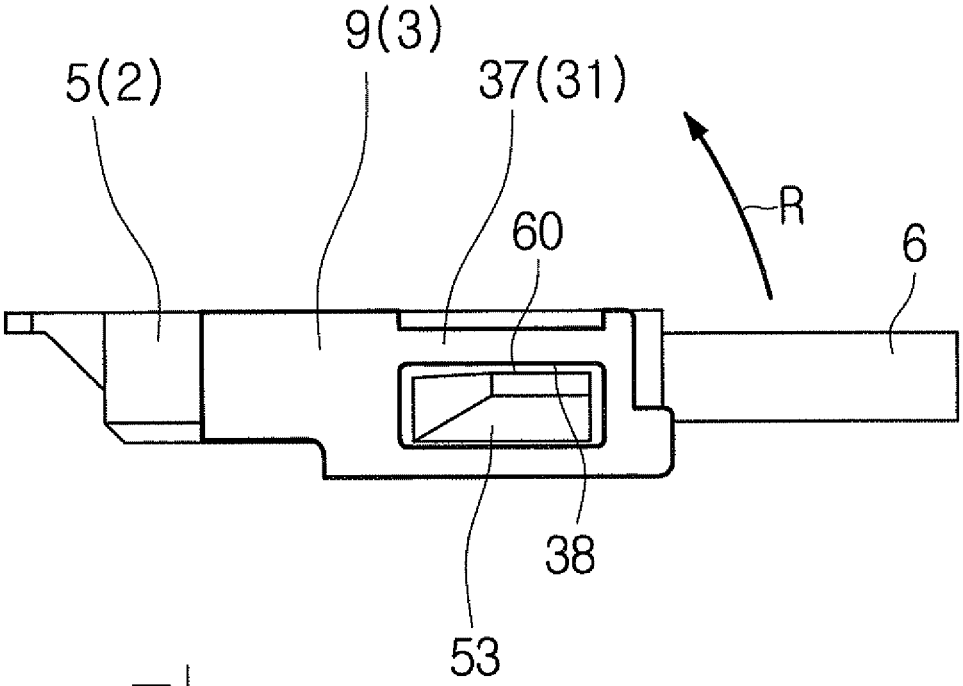
FIG. 19 is an explanatory view showing an operation to be performed when a wire is lifted up (first embodiment)
Figure 19:
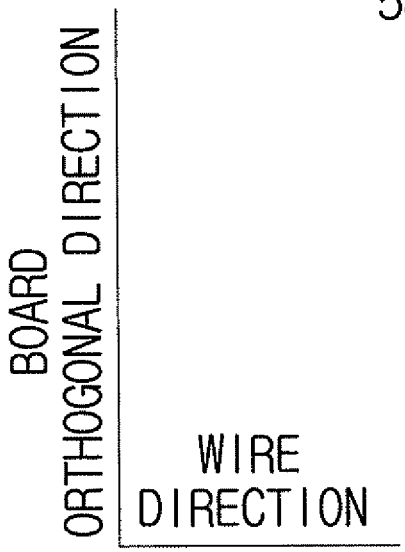

(3) As shown in FIG. 2, when the plug connector 2 is caused to descend toward the receptacle connector 3, each one of the pair of projecting portions 53 of the plug housing 5 shown in FIG. 14 is opposed to the lock beam 37 of the fixing portion 31 of the corresponding assistant fitting 9 shown in FIG. 9 in the board orthogonal direction, due to the effect of positioning the plug connector 2 relative to the receptacle connector 3, which is exerted by the pair of positioning projections 52 shown in FIG. 14 and the pair of positioning grooves 41 shown in FIG. 3. Then, the mating guide surface 61 of the projecting portion 53 shown in FIG. 16 contacts the mating guide surface 40 of the lock beam 37 shown in FIG. 9. In this state, as the plug connector 2 is pushed toward the receptacle connector 3, due to the presence of the mating guide surface 61 of the projecting portion 53 shown in FIG. 16 and the mating guide surface 40 of the lock beam 37 shown in FIG. 9, the projecting portion 53 pushes out the lock beam 37 in the connector width anti-center direction, and descends while sliding on the plug opposing surface 39 of the lock beam 37. Specifically, the mating guide surface 40 of the lock beam 37 of the fixing portion 31 exerts the function of elastically displacing the fixing portion 31 in a direction away from the plug connector 2, that is, in the connector width anti-center direction, when the projecting portion 53 of the plug connector 2 contacts the fixing portion 31 so as to mate the plug connector 2 with the receptacle connector 3. Eventually, when the projecting portion 53 passes over the lock beam 37, the fixing portion 31 is allowed to return in the connector width center direction by the spring restoring force of the assistant fitting 9 and the projecting portion 53 is accommodated in the lock hole 36. As a result, as shown in FIG. 19, the plug lock surface 60 of the projecting portion 53 of the plug housing 5 of the plug connector 2 is opposed to the receptacle lock surface 38 of the lock beam 37 of the fixing portion 31 of the assistant fitting 9 of the receptacle connector 3 in the board orthogonal direction. The plug lock surface 60 and the receptacle lock surface 38 are opposed to each other in the board orthogonal direction, thereby locking the plug connector 2 with respect to the receptacle connector 3 and thus inhibiting the plug connector 2 from being disengaged from the receptacle connector 3.

Specifically, in the mated state shown in FIG. 19, the plurality of wires 6 may be raised in the direction away from the connector mounting surface 10*a* of the circuit board 10 due to some cause. In other words, in the mated state shown in FIG. 19, the plurality of wires 6 may be lifted up due to some cause. If the wires 6 are lifted up, the plug housing 5 is inclined so as to rotate in a direction indicated by an arrow R, with the result that the plug lock surface 60 comes into contact with the receptacle lock surface 38.

(Method for Disengaging the Wire-to-Board Connector 1)

Figure 20:
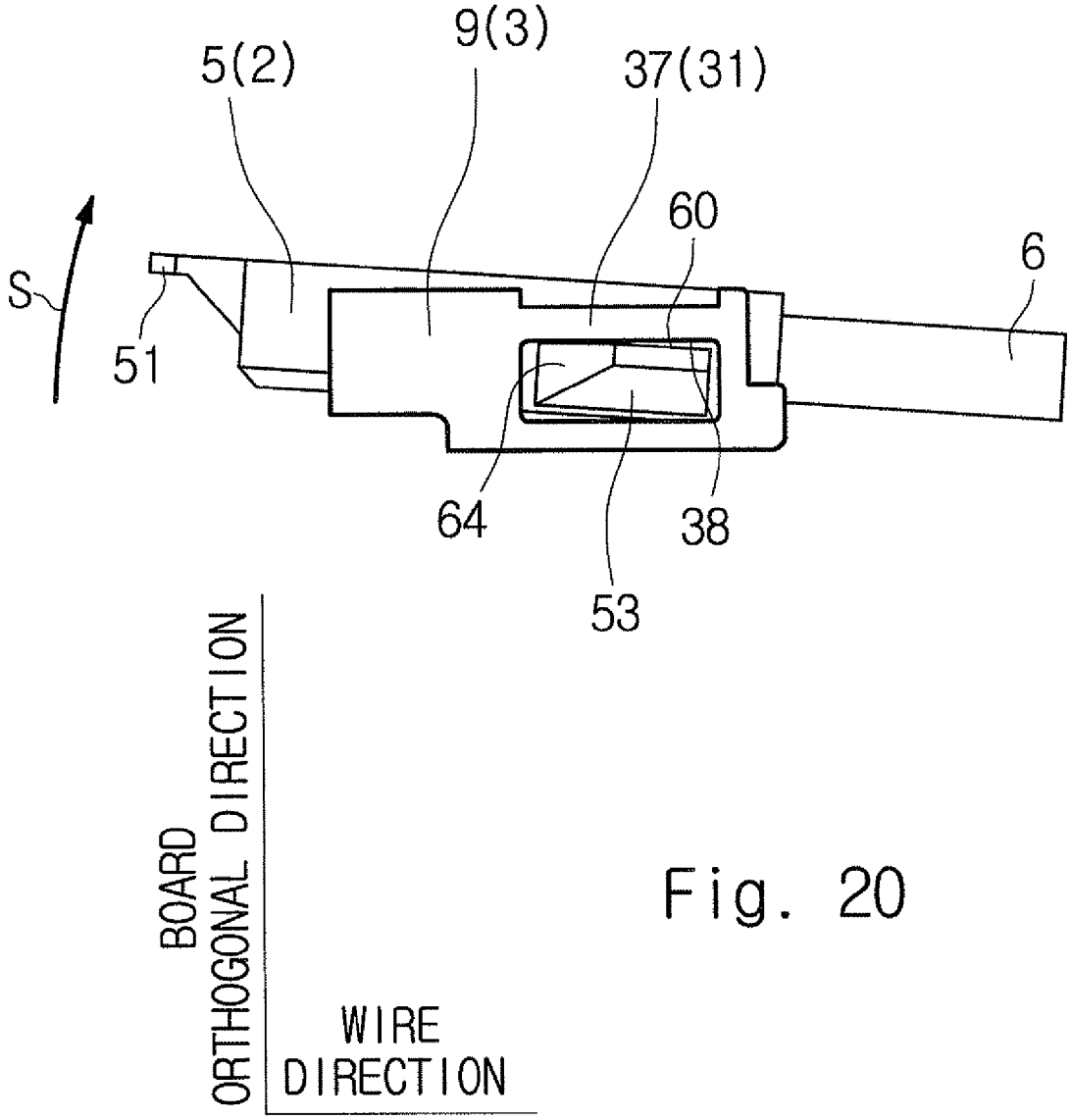
FIG. 20 is an explanatory view showing an operation to be performed when the plug connector is disengaged from the receptacle connector (first embodiment)

Next, a method for disengaging the plug connector 2 from the receptacle connector 3 will be described. As shown in FIG. 20, when a fingernail, a tool, a jig, or the like is hooked on the releasing projection 51 of the plug housing 5 of the plug connector 2 and the plug connector 2 is intentionally inclined so as to rotate in a direction indicated by an arrow S so that the wires 6 approach the connector mounting surface 10*a* of the circuit board 10, the end inclined surface 64 pushes out the lock beam 37 in the connector width anti-center direction. When the end inclined surface 64 pushes out the lock beam 37 in the connector width anti-center direction, the opposed relationship between the plug lock surface 60 and the receptacle lock surface 38 is released, and the locked state of the wire-to-board connector 1 is released. After the locked state of the wire-to-board connector 1 is released, the plug connector 2 may be disengaged from the receptacle connector 3 in the board separating direction.

In summary, the preferred embodiment of the present invention described above has the following features.

(1) The wire-to-board connector 1 includes: the plug connector 2 including the plug contacts 4 to which the wires 6 are respectively attached, and the plug housing 5 that holds the plug contacts 4; and the receptacle connector 3 that is mounted on the connector mounting surface 10*a* of the circuit board 10 (board), and includes: the receptacle contacts 7 respectively corresponding to the plug contacts 4; the receptacle housing 8 that holds the receptacle contacts 7; and the assistant fittings 9 that are attached to the receptacle housing 8. As shown in FIG. 2, the mating direction P in which the plug connector 2 is mated with the receptacle connector 3 is a direction approaching the connector mounting surface 10*a* of the circuit board 10. The plug connector 2 is mated with the receptacle connector 3 to thereby bring the plug contacts 4 into contact with the receptacle contacts 7. The assistant fittings 9 each include at least the held portion 30, the fixing portion 31, and the vertical displacement regulating portion 42 (first displacement regulating portion). The held portion 30 is a portion that is held by the receptacle housing 8. The fixing portion 31 is a portion that is hooked to the plug housing 5 to thereby lock the plug connector 2 with respect to the receptacle connector 3. The vertical displacement regulating portion 42 is a portion that regulates a displacement of the fixing portion 31 in a direction away from the connector mounting surface 10*a* of the circuit board 10. According to the structure described above, the displacement of the fixing portion 31 in the direction away from the connector mounting surface 10*a* of the circuit board 10 is regulated, thereby preventing each assistant fitting 9 from being damaged even when the wires 6 are lifted up. Note that the state in which "assistant fitting 9 is damaged" indicates that, for example, the fixing portion 31 of the assistant fitting 9 is excessively deformed in the board separating direction and is thus plastically deformed.

(2) As shown in FIG. 9, the fixing portion 31 is supported by the held portion 30 and is formed in a cantilever shape extending in parallel to the connector mounting surface 10*a* of the circuit board 10.

(3) As shown in FIG. 9, the fixing portion 31 is opposed to the held portion 30.

(4) As shown in FIG. 9, the fixing portion 31 is formed to be elastically displaceable in a direction approaching the held portion 30.

(5) The assistant fitting 9 further includes the horizontal displacement regulating portion 43 (second displacement regulating portion) that regulates elastic displacement of the fixing portion 31 in the direction approaching the held portion 30 so that the elastic displacement does not exceed a predetermined amount. The above structure prevents the assistant fittings 9 from being excessively deformed. Note that the state in which "assistant fitting 9 is damaged" indicates that, for example, the fixing portion 31 of the assistant fitting 9 is excessively deformed in the connector width anti-center direction and is thus plastically deformed.

Figure 10:
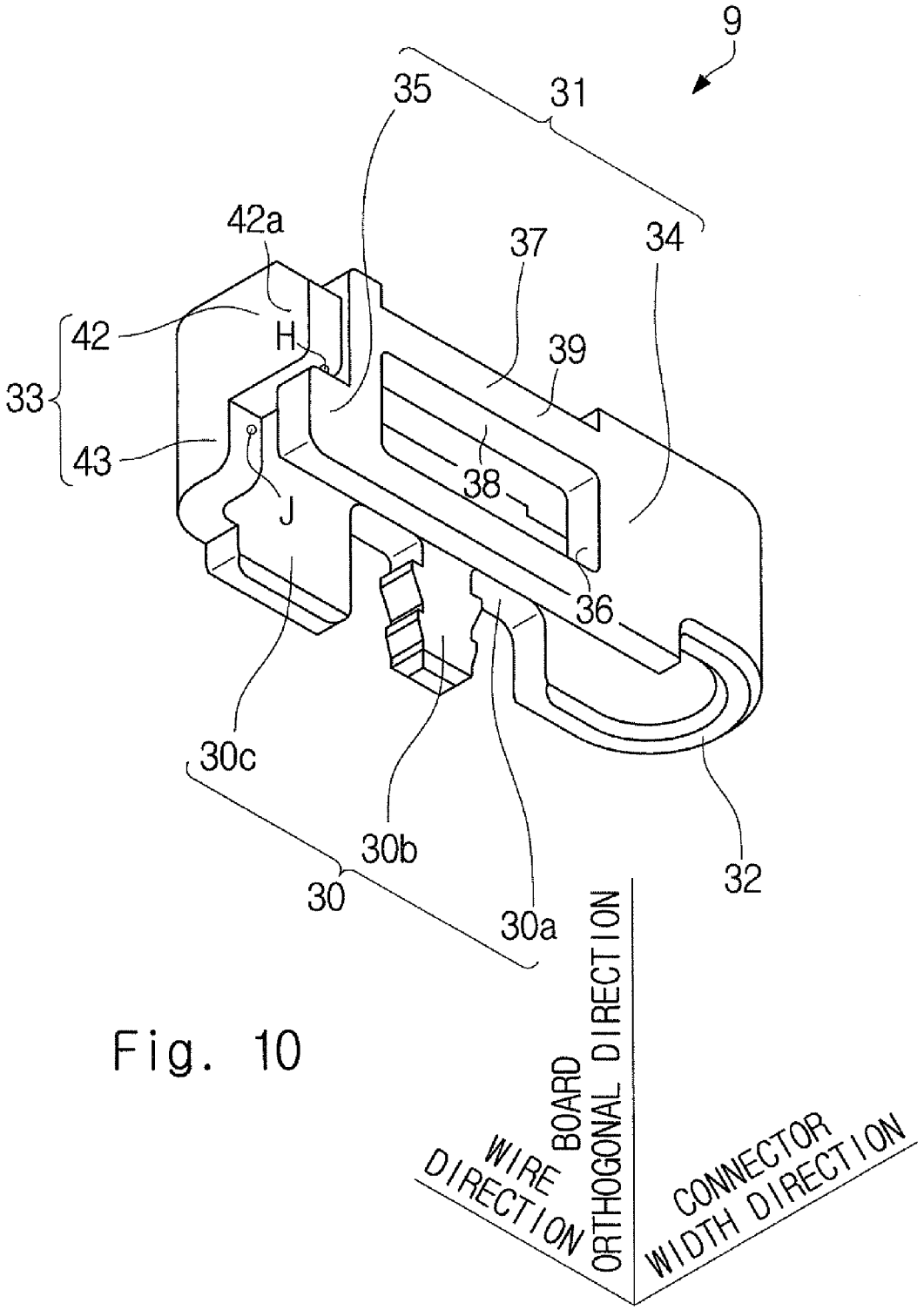
FIG. 10 is a perspective view of the assistant fitting when viewed from another angle (first embodiment)

(6) As shown in FIG. 10, each assistant fitting 9 includes the leg portion 30*c* that is soldered to the connector mounting surface 10*a* of the circuit board 10.

(7) As shown in FIG. 10, the leg portion 30*c* is disposed in the vicinity of the vertical displacement regulating portion 42. According to the above structure, a displacement regulating effect is exerted by the vertical displacement regulating portion 42, without causing any problem.

(8) As shown in FIG. 16, the plug housing 5 has the projecting portion 53 projecting toward the fixing portion 31 of the corresponding assistant fitting 9. The projecting portion 53 has the plug lock surface 60 facing in the direction away from the connector mounting surface 10*a* of the circuit board 10. As shown in FIGS. 10 and 19, the fixing portion 31 has the receptacle lock surface 38 that faces in the direction approaching the connector mounting surface 10*a* of the circuit board 10 and is opposed to the plug lock surface 60 in the mated state in which the plug connector 2 is mated with the receptacle connector 3. According to the above structure, the plug connector 2 can be reliably locked with respect to the receptacle connector 3.

(9) As shown in FIG. 1, the wires 6 are pulled out from the plug connector 2 in a direction substantially parallel to the connector mounting surface 10*a* of the circuit board 10.

(10) As shown in FIG. 16, assuming that the direction in which the plug connector 2 is viewed from the wires 6 corresponds to the wire connector direction, a portion of the projecting portion 53 on the wire connector direction side is formed in such a manner that a projection amount of the projecting portion 53 decreases toward the wire connector direction. The above structure can provide the wire-to-board connector 1 capable of maintaining the locked state, without causing any problem, even when the wires 6 are raised in the direction away from the connector mounting surface 10*a* of the circuit board 10, and capable of intentionally releasing the locked state, as shown in FIGS. 19 and 20.

(13) As shown in FIG. 14, the plug housing 5 has the releasing projection 51 that allows the plug connector 2 to be inclined so that the wires 6 approach the connector mounting surface 10*a* of the circuit board 10.

(14) As shown in FIG. 14, the releasing projection 51 is formed so as to project in the wire connector direction from an end of the plug housing 5 on the wire connector direction side.

(15) As shown in FIG. 9, the fixing portion 31 has the mating guide surface 40 that allows the fixing portion 31 to be elastically displaced in a direction away from the plug connector 2 when the projecting portion 53 of the plug connector 2 is brought into contact with the fixing portion 31 so as to mate the plug connector 2 with the receptacle connector 3.

(17) As shown in FIG. 3, the pair of assistant fittings 9 is provided on both sides of the receptacle connector 3 in the connector width direction.

It is preferable that the timing when the end inclined surface 64 of the projecting portion 53 shown in FIG. 20 pushes out the lock beam 37 in the connector width anti-center direction be matched with the timing when the contact point portion 4*b* of the plug contact 4 shown in FIG. 18 is disengaged from the corresponding recess 71*a* of the receptacle contact 7 shown in FIG. 11. The above-mentioned two timings can be matched by, for example, forming the portion of the projecting portion 53 on the wire connector direction side into a shape that curves upward or downward.

The first embodiment described above can be modified as follows.

That is, as shown in FIG. 9, the fixing portion body 34 of the fixing portion 31 of each assistant fitting 9 has the lock hole 36 formed therein, and the lock beam 37 is formed as a result of the formation of the lock hole 36. However, the lock beam 37 is not based on the condition that the lock hole 36 is present. The lock beam 37 can be formed without forming the lock hole 36. Accordingly, it is also possible to employ a structure in which, for example, the beam present on the board approaching direction side of the lock hole 36 is removed.

Second Embodiment

Next, a second embodiment of the present invention will be described with reference to FIGS. 21 to 25. Here, differences between this embodiment and the first embodiment will be mainly described, while a repeat of previous descriptions is omitted as appropriate. Components of this embodiment corresponding to the components of the first embodiment described above are denoted by the same reference numerals as those of the first embodiment as a rule.

Figure 21:
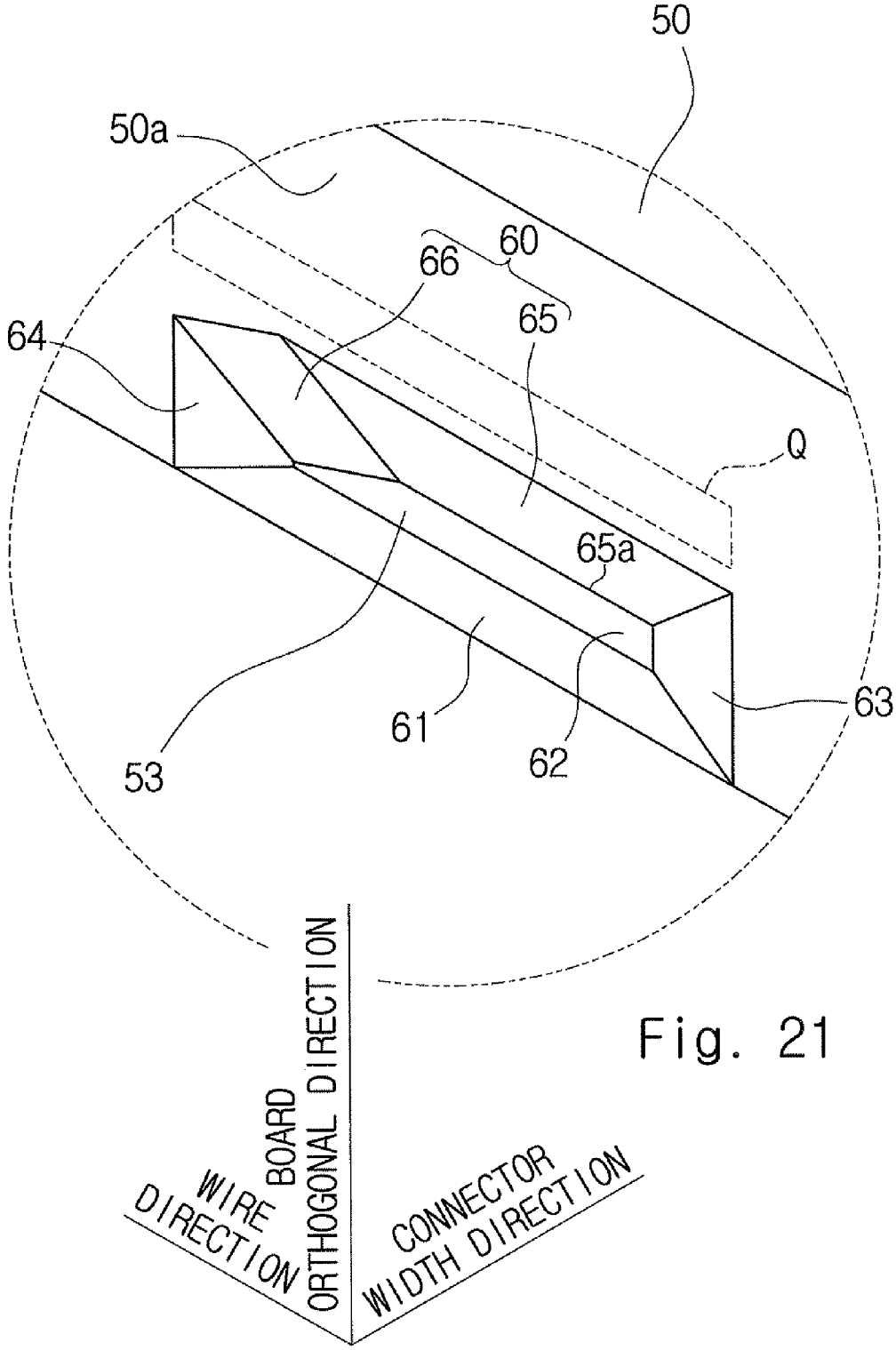
FIG. 21 is an enlarged perspective view of a projecting portion (second embodiment)

As shown in FIG. 21, in this embodiment, the plug lock surface 60 includes a lock maintaining surface 65 that is disposed on the connector wire direction side, and an unlocking surface 66 that is disposed on the wire connector direction side. The lock maintaining surface 65 is a flat surface that is connected to the plug side surface 50*a* and is substantially orthogonal to a board orthogonal direction. The unlocking surface 66 is a flat surface that is connected to the plug side surface 50*a*, is inclined in the connector width center direction toward the board separating direction, and is inclined in the connector width center direction toward the wire connector direction. The lock maintaining surface 65 and the unlocking surface 66 are connected to each other. The lock maintaining surface 65 and the unlocking surface 66 are adjacent to each other in the wire direction. The lock maintaining surface 65 is disposed on the connector wire direction side of the unlocking surface 66. That is, the unlocking surface 66 is disposed on the wire connector direction side of the lock maintaining surface 65. The unlocking surface 66 is connected to an edge 65*a* of the lock maintaining surface 65, the edge 65*a* being located farthest from the plug side surface 50*a*. In other words, the unlocking surface 66 is connected to the edge 65*a* of the lock maintaining surface 65 on the connector width anti-center direction side.

The plug side surface 50*a* has a reference plane Q as indicated by an alternate long and two short dashes line in FIG. 21. The reference plane Q is a part of the plug side surface 50*a*. The reference plane Q is a portion of the plug side surface 50*a*, the portion being located farther from the connector mounting surface 10*a* of the circuit board 10 than the projecting portion 53. The reference plane Q is a portion of the plug side surface 50*a*, the portion being located on the board separating direction side of the projecting portion 53.

Figure 22:
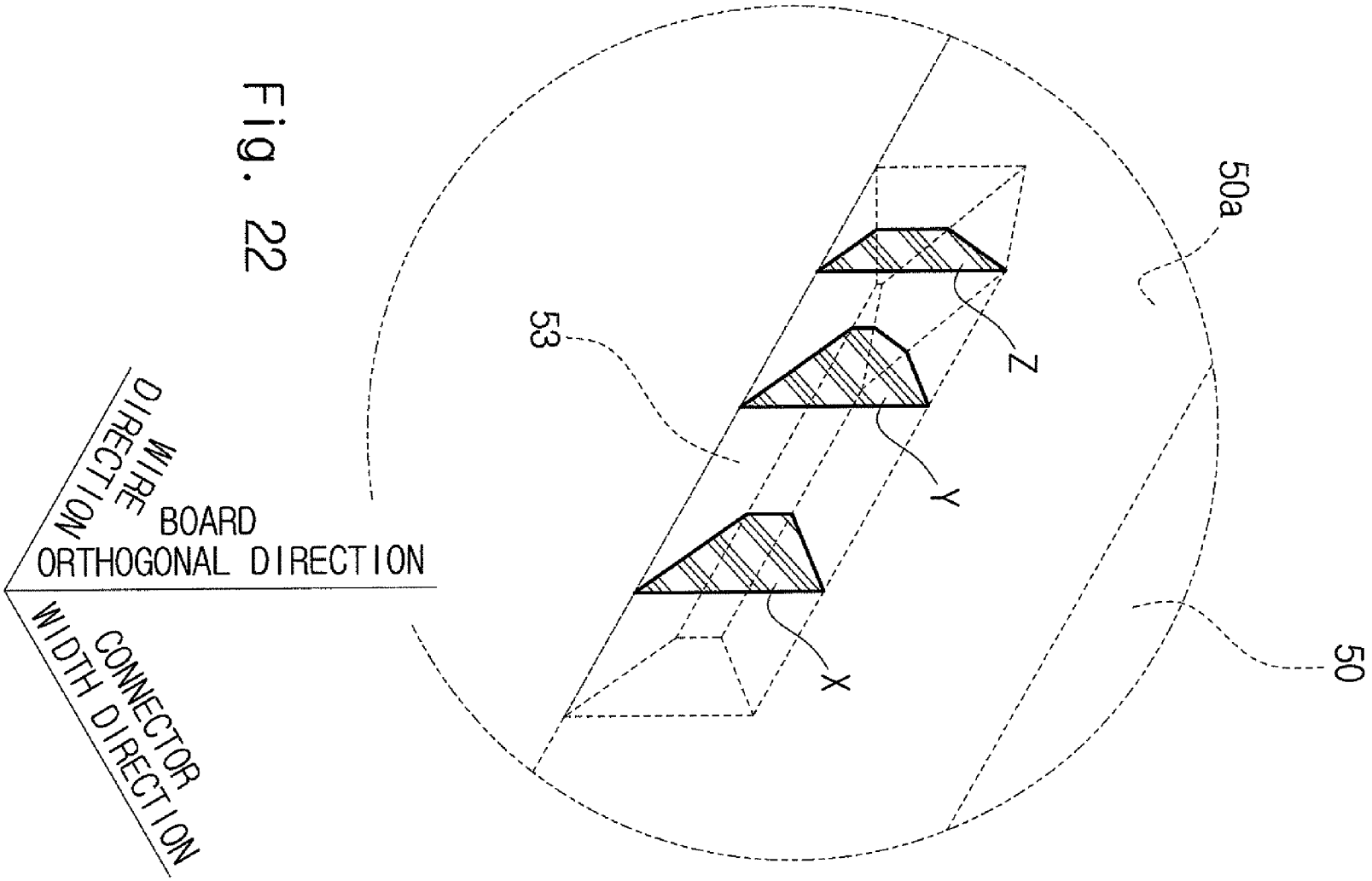
FIG. 22 is a perspective view for explaining cross-sections of the projecting portion (second embodiment)

FIG. 22 shows three cross-sections, i.e., a cross-section X, a cross-section Y, and a cross-section Z, of the projecting portion 53. The cross-section X is located on the connector wire direction side of the cross-section Y. The cross-section Y is located on the connector wire direction side of the cross-section Z. The cross-section X, the cross-section Y, and the cross-section Z are cross-sections orthogonal to the wire direction. The shape of the projecting portion 53 will be described below in more detail by using the cross-section X, the cross-section Y, and the cross-section Z.

Figure 23:
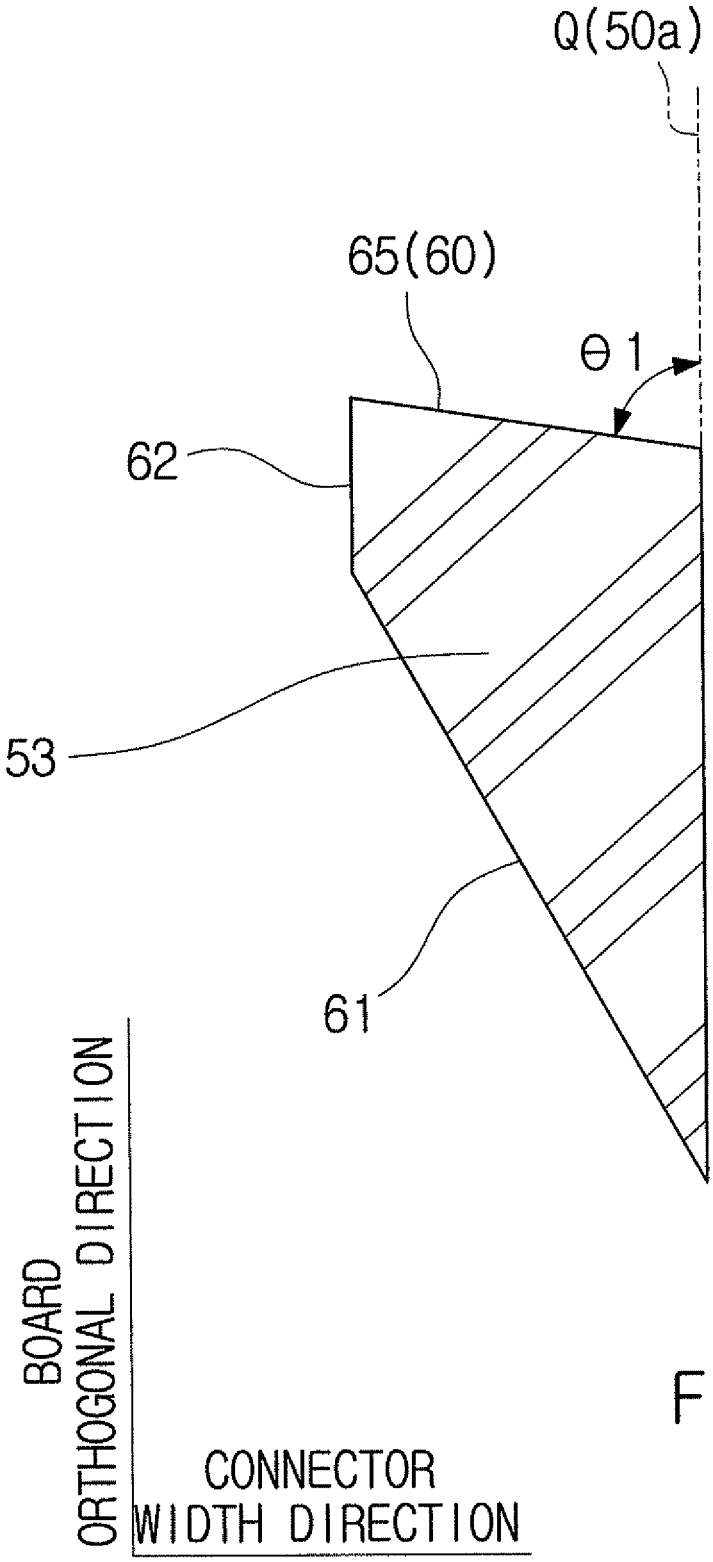
FIG. 23 is a sectional view showing a cross-section X of the projecting portion (second embodiment)

In the cross-section X shown in FIG. 23, only the lock maintaining surface 65 of the plug lock surface 60 appears. In the cross-section Y shown in FIG. 24, both the lock maintaining surface 65 and the unlocking surface 66 of the plug lock surface 60 appear. In other words, in the cross-section Y, the lock maintaining surface 65 and the unlocking surface 66 are adjacent to each other in the connector width direction. In the cross-section Z shown in FIG. 25, only the unlocking surface 66 of the plug lock surface 60 appears. In the cross-section X shown in FIG. 23 and the cross-section Y shown in FIG. 24, the side standing surface 62 appears. On the other hand, in the cross-section Z shown in FIG. 25, the end inclined surface 64 appears instead of the side standing surface 62.

Figure 24:
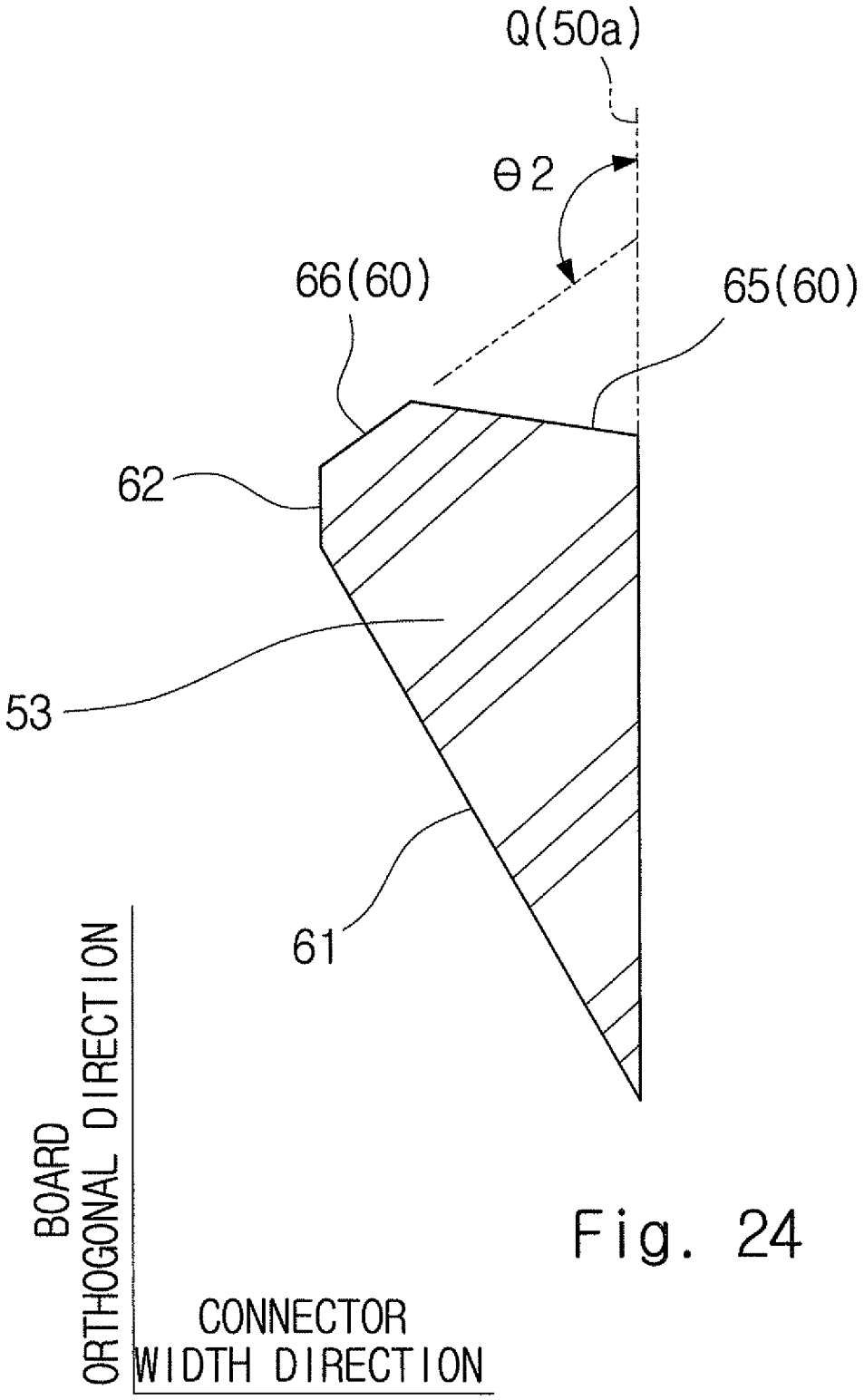
FIG. 24 is a sectional view showing a cross-section Y of the projecting portion (second embodiment)
Figure 25:
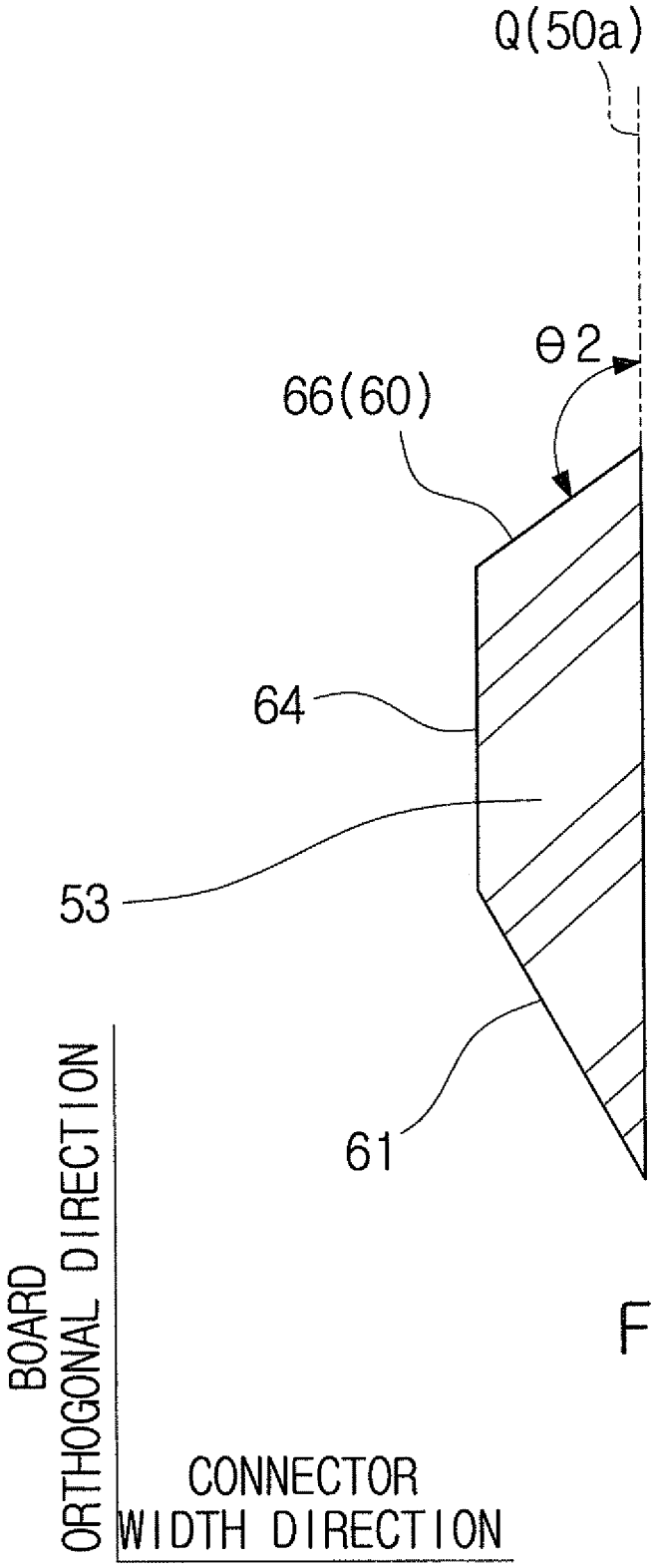
FIG. 25 is a sectional view showing a cross-section Z of the projecting portion (second embodiment)

As shown in FIG. 23, an angle formed between the reference plane Q and the lock maintaining surface 65 is defined as a lock maintaining angle θ1. As shown in FIGS. 24 and 25, an angle formed between the reference plane Q and the unlocking surface 66 is defined as an unlocking angle θ2. In this embodiment, the lock maintaining angle θ1 is smaller than the unlocking angle θ2. Specifically, the lock maintaining angle θ1 is equal to or smaller than 90 degrees. Preferably, the lock maintaining angle θ1 has a range of 70 to 90 degrees. More preferably, the lock maintaining angle θ1 has a range of 80 to 85 degrees. In this embodiment, the lock maintaining angle θ1 is 85 degrees. The unlocking angle θ2 is greater than 90 degrees. Preferably, the unlocking angle θ2 has a range of 95 to 165 degrees. More preferably, the unlocking angle θ2 has a range of 120 to 150 degrees. In this embodiment, the unlocking angle θ2 is 135 degrees.

The second embodiment described above has the following features.

(11) The unlocking surface 66 which is inclined so as to be gradually separated from the fixing portion 31 in the direction away from the connector mounting surface 10*a* of the circuit board 10, that is, in the connector width center direction, is formed at a portion of the projecting portion 53 on the wire connector direction side. The above structure makes it possible to achieve the wire-to-board connector 1 capable of maintaining the locked state, without causing any problem, even when the wires 6 are raised in the direction away from the connector mounting surface 10*a* of the circuit board 10, and capable of intentionally releasing the locked state.

In the second embodiment, the projecting portion 53 includes both the unlocking surface 66 and the end inclined surface 64. Alternatively, the projecting portion 53 may include only the end inclined surface 64 as in the first embodiment, or may include only the unlocking surface 66.

Third Embodiment

Figure 26:
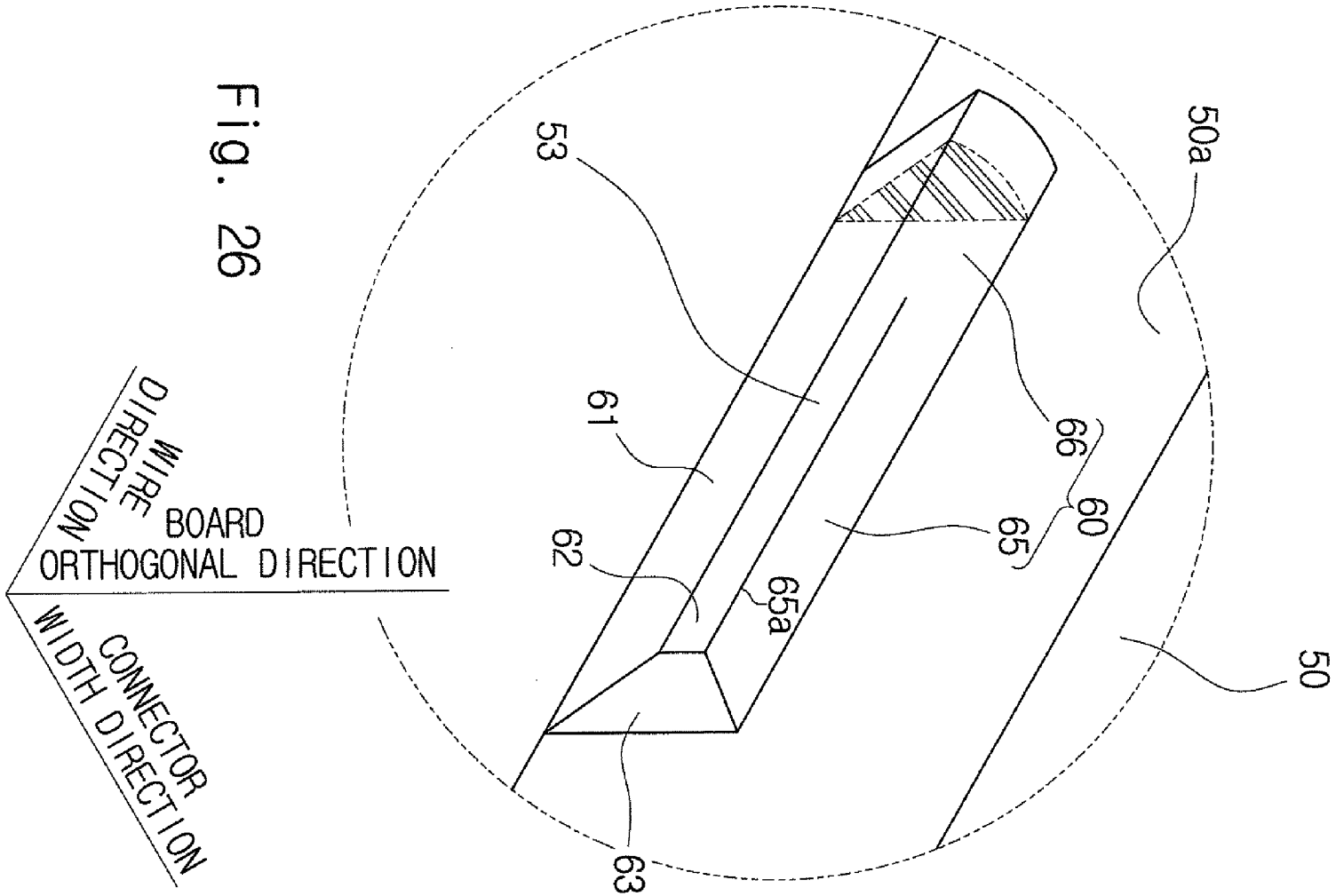
FIG. 26 is an enlarged perspective view of a projecting portion (third embodiment)

Next, a third embodiment of the present invention will be described with reference to FIG. 26. Here, differences between this embodiment and the first embodiment will be mainly described, while a repeat of previous descriptions is omitted as appropriate. Components of this embodiment corresponding to the components of the first embodiment described above are denoted by the same reference numerals as those of the first embodiment as a rule.

In the second embodiment, the unlocking surface 66 of the plug lock surface 60 is formed with a flat surface. Alternatively, as shown in FIG. 26, the unlocking surface 66 may be formed with a curved surface that is inclined so as to be gradually separated from the fixing portion 31 in the direction away from the connector mounting surface 10*a* of the circuit board 10, that is, in the connector width center direction. In FIG. 26, the sectional shape of the projecting portion 53 is indicated by a hatched area. Also in this case, it is possible to achieve the wire-to-board connector 1 capable of maintaining the locked state, without causing any problem, even when the wires 6 are raised in the direction away from the connector mounting surface 10*a* of the circuit board 10, and capable of intentionally releasing the locked state.

In the third embodiment, the end inclined surface 64 is omitted. However, also in the third embodiment, the projecting portion 53 may include the end inclined surface 64.

Fourth Embodiment

Next, a fourth embodiment of the present invention will be described with reference to FIGS. 27 and 28. Here, differences between this embodiment and the first embodiment will be mainly described, while a repeat of previous descriptions is omitted as appropriate. Components of this embodiment corresponding to the components of the first embodiment described above are denoted by the same reference numerals as those of the first embodiment as a rule.

In this embodiment, the projecting portion 53 does not include the end inclined surface 64 shown in FIG. 16. Instead of the end inclined surface 64, as shown in FIG. 27, a curved surface 80 which is inclined so as to approach the plug housing 5 in the direction away from the connector mounting surface 10*a* of the circuit board 10 is formed at a portion of the lock beam 37 of the fixing portion 31 of the corresponding assistant fitting 9, the portion being located on the wire connector direction side. The curved surface 80 is continuous with the receptacle lock surface 38 and the plug opposing surface 39. Further, instead of the flat mating guide surface 40 shown in FIG. 9, a mating guide surface 81 having a curved shape is formed on the lock beam 37 as shown in FIG. 27. The curved surface 80 and the mating guide surface 81 are formed by, for example, round finishing.

The fourth embodiment described above has the following features.

(12) The curved surface 80 which is inclined so as to approach the plug housing 5 in the direction away from the connector mounting surface 10*a* of the circuit board 10 is formed at a portion of the fixing portion 31 on the wire connector direction side. The above structure makes it possible to achieve the wire-to-board connector 1 capable of maintaining the locked state, without causing any problem, even when the wires 6 are raised in the direction away from the connector mounting surface 10*a* of the circuit board 10, and capable of intentionally releasing the locked state.

Fifth Embodiment

Figure 29:
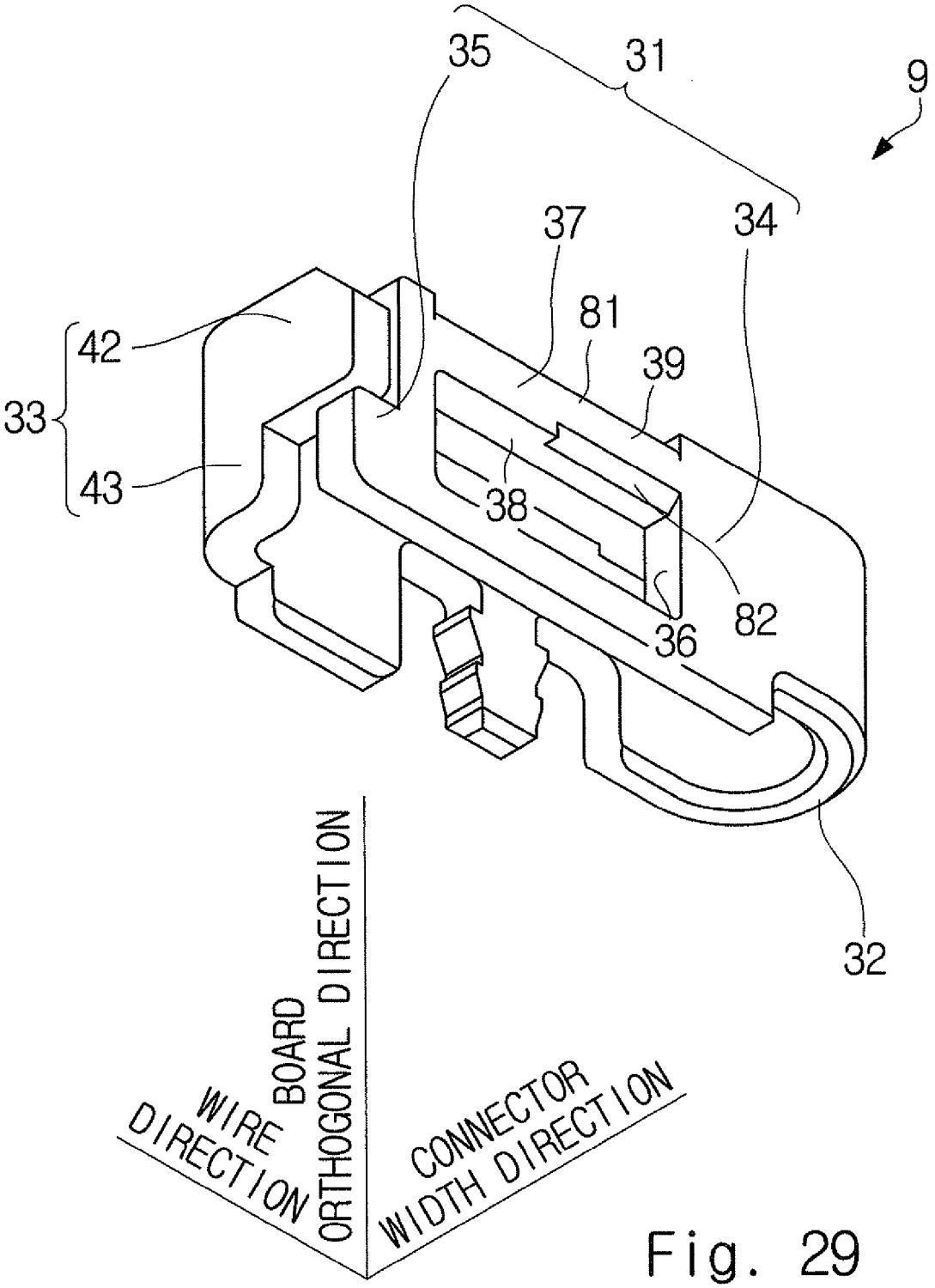
FIG. 29 is a perspective view of an assistant fitting (fifth embodiment)

Next, a fifth embodiment of the present invention will be described with reference to FIG. 29. Here, differences between this embodiment and the fourth embodiment will be mainly described, while a repeat of previous descriptions is omitted as appropriate. Components of this embodiment corresponding to the components of the fourth embodiment described above are denoted by the same reference numerals as those of the fourth embodiment as a rule.

A flat surface 82 may be adopted instead of the curved surface 80 of the fourth embodiment.

The fifth embodiment has the following features.

(12) The flat surface 82 which is inclined so as to approach the plug housing 5 in the direction away from the connector mounting surface 10*a* of the circuit board 10 is formed at a portion of the fixing portion 31 on the wire connector direction side. The above structure makes it possible to achieve the wire-to-board connector 1 capable of maintaining the locked state, without causing any problem, even when the wires 6 are raised in the direction away from the connector mounting surface 10*a* of the circuit board 10, and capable of intentionally releasing the locked state.

Sixth Embodiment

Figure 30:
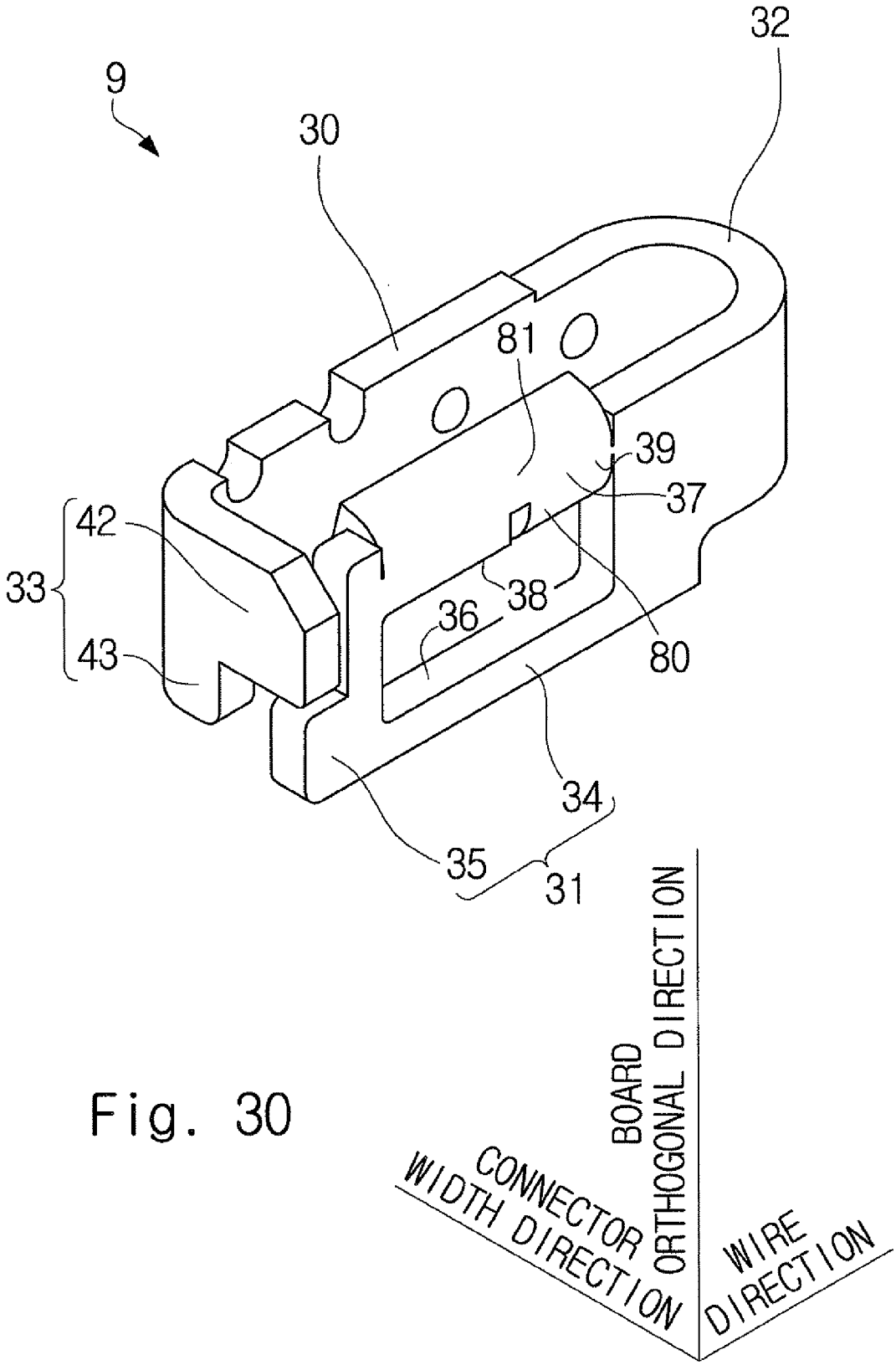
FIG. 30 is a perspective view of an assistant fitting (sixth embodiment)
Figure 31:
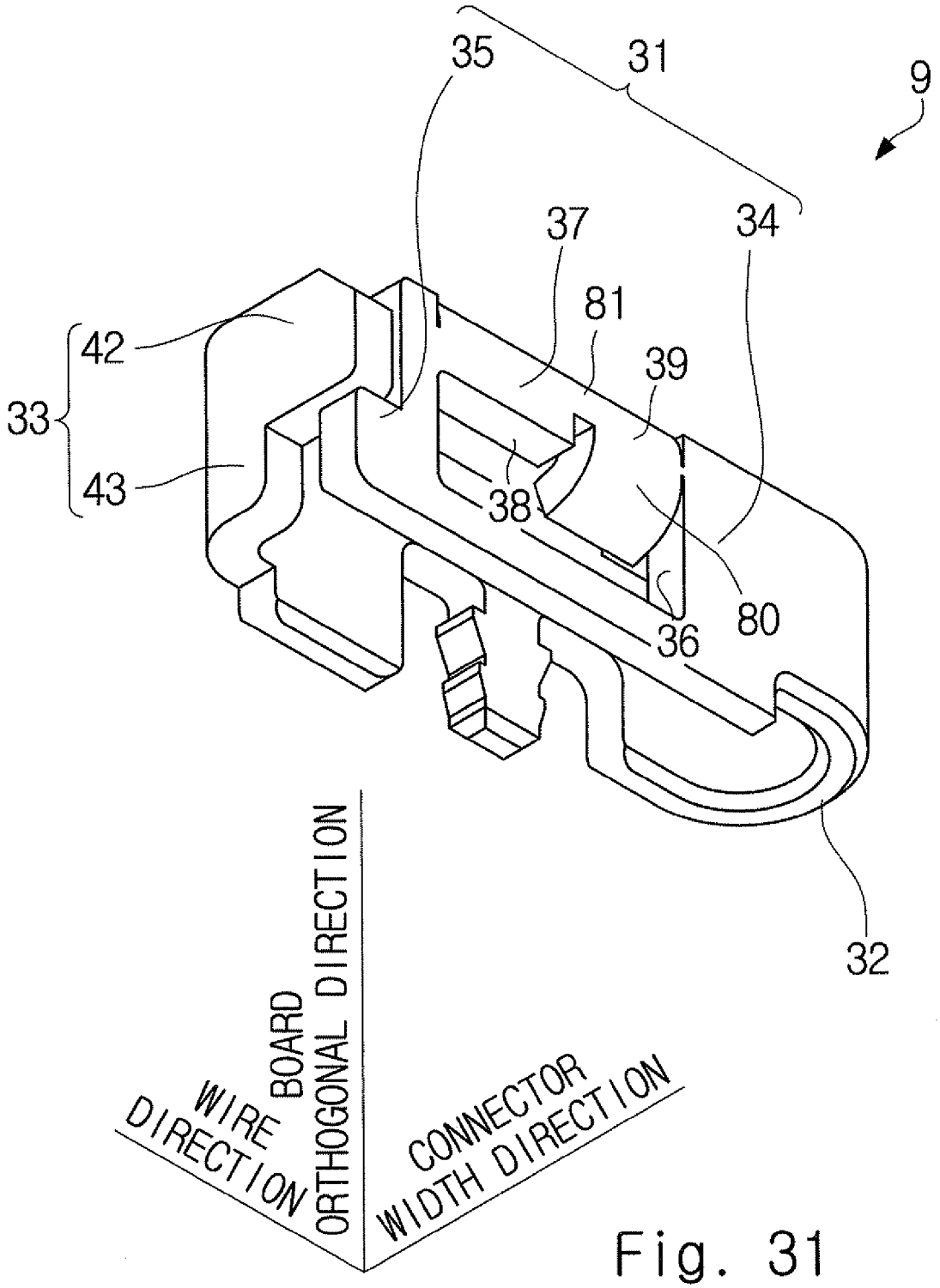
FIG. 31 is a perspective view of the assistant fitting when viewed from another angle (sixth embodiment)
Figure 32:
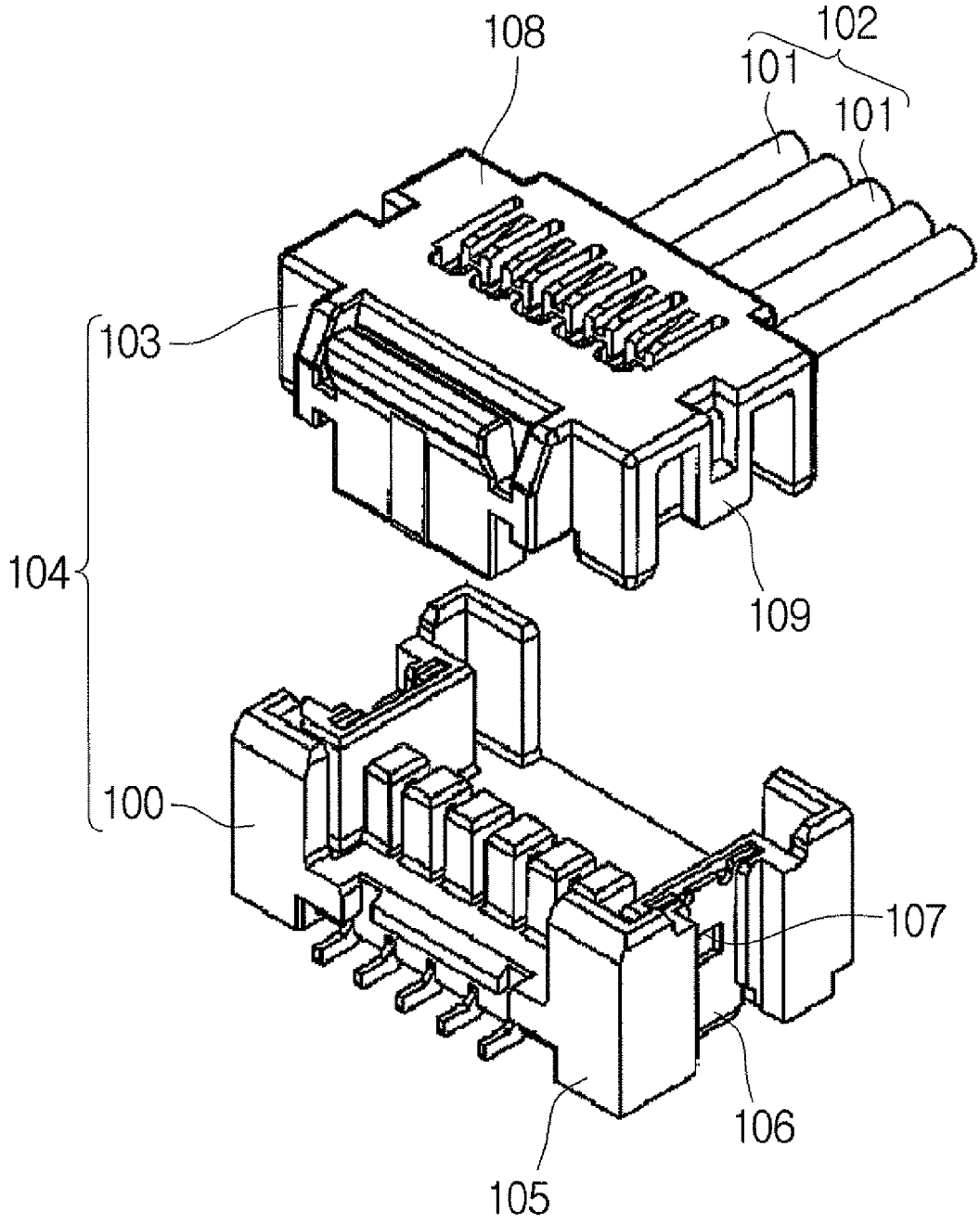
FIG. 32 is a view corresponding to FIG. 1 of Patent Literature 1.

Next, a sixth embodiment of the present invention will be described with reference to FIGS. 30 and 31. Here, differences between this embodiment and the fourth embodiment will be mainly described, while a repeat of previous descriptions is omitted as appropriate. Components of this embodiment corresponding to the components of the fourth embodiment described above are denoted by the same reference numerals as those of the fourth embodiment as a rule.

Figure 27:
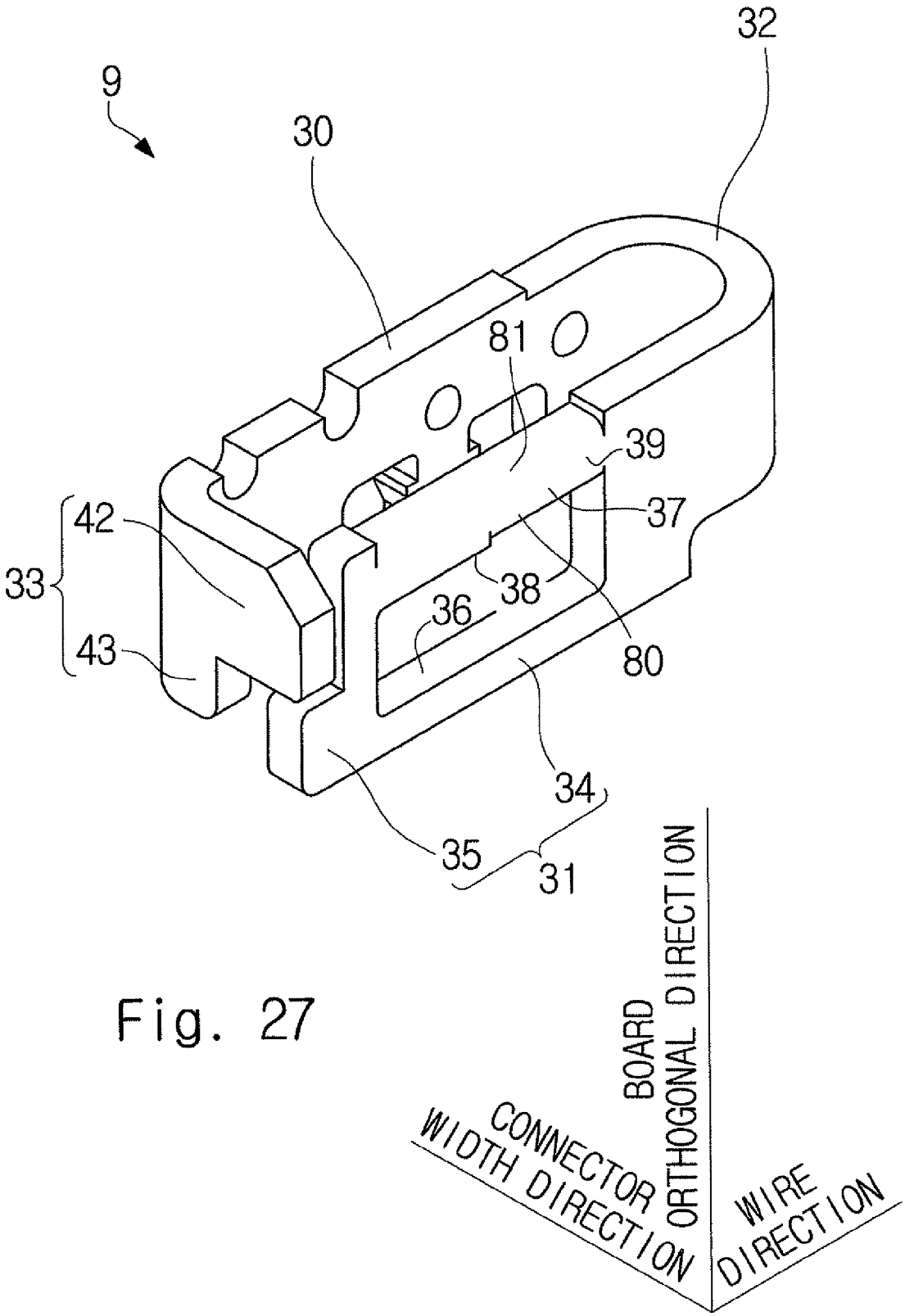
FIG. 27 is a perspective view of an assistant fitting (fourth embodiment)
Figure 28:
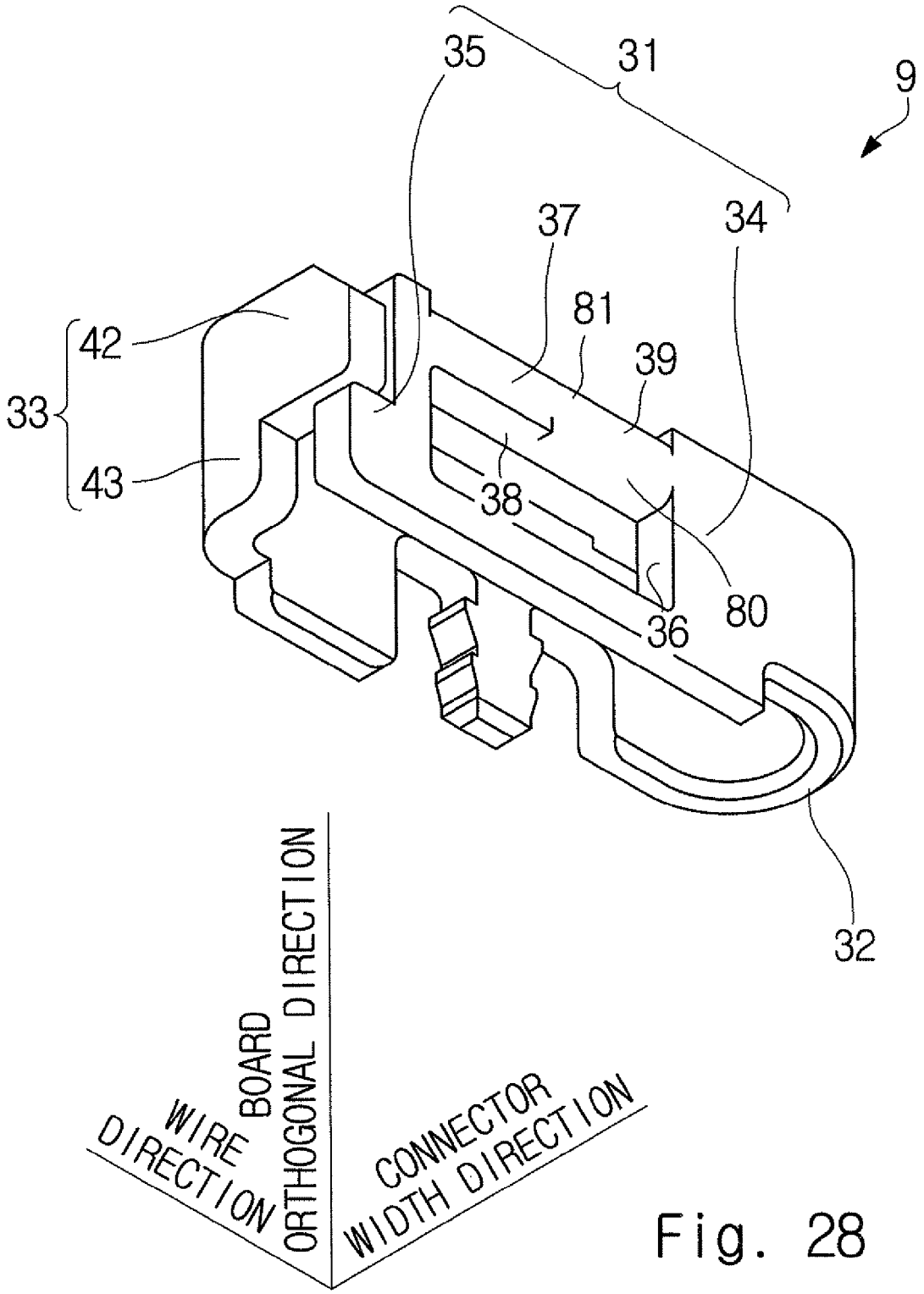
FIG. 28 is a perspective view of the assistant fitting viewed from another angle (fourth embodiment)

As shown in FIG. 27, in the fourth embodiment, the curved surface 80 and the mating guide surface 81 are formed by round finishing. However, in this embodiment, these surfaces are formed by bending a metallic plate into a curved shape as shown in FIGS. 30 and 31.

Seventh Embodiment

Next, a seventh embodiment of the present invention will be described with reference to FIGS. 33 to 36. Here, differences between this embodiment and the second embodiment will be mainly described, while a repeat of previous descriptions is omitted as appropriate. Components of this embodiment corresponding to the components of the second embodiment described above are denoted by the same reference numerals as those of the second embodiment as a rule.

Figure 33:
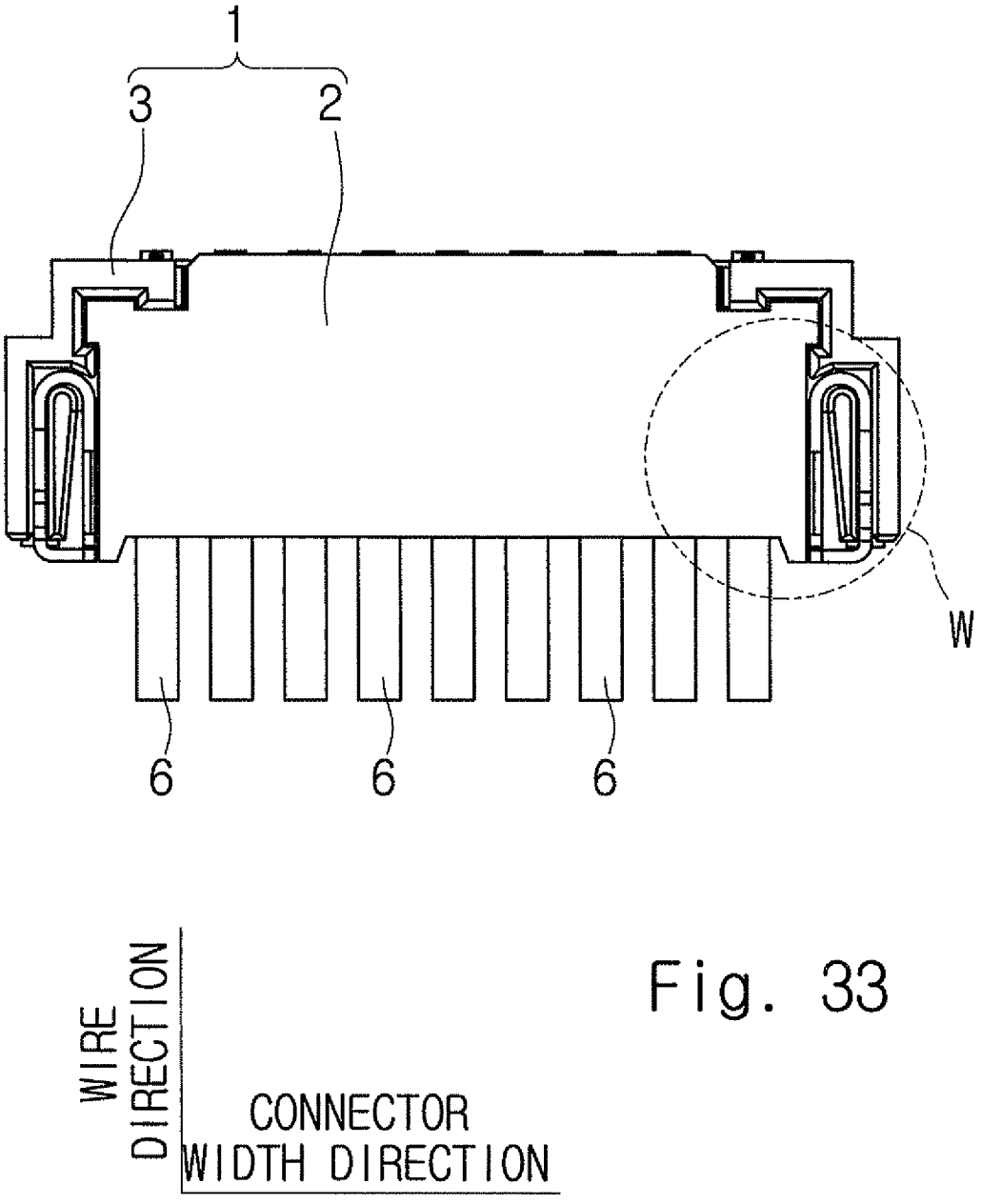
FIG. 33 is a plan view showing a mated state of a wire-to-board connector according to the second embodiment.
Figure 34:
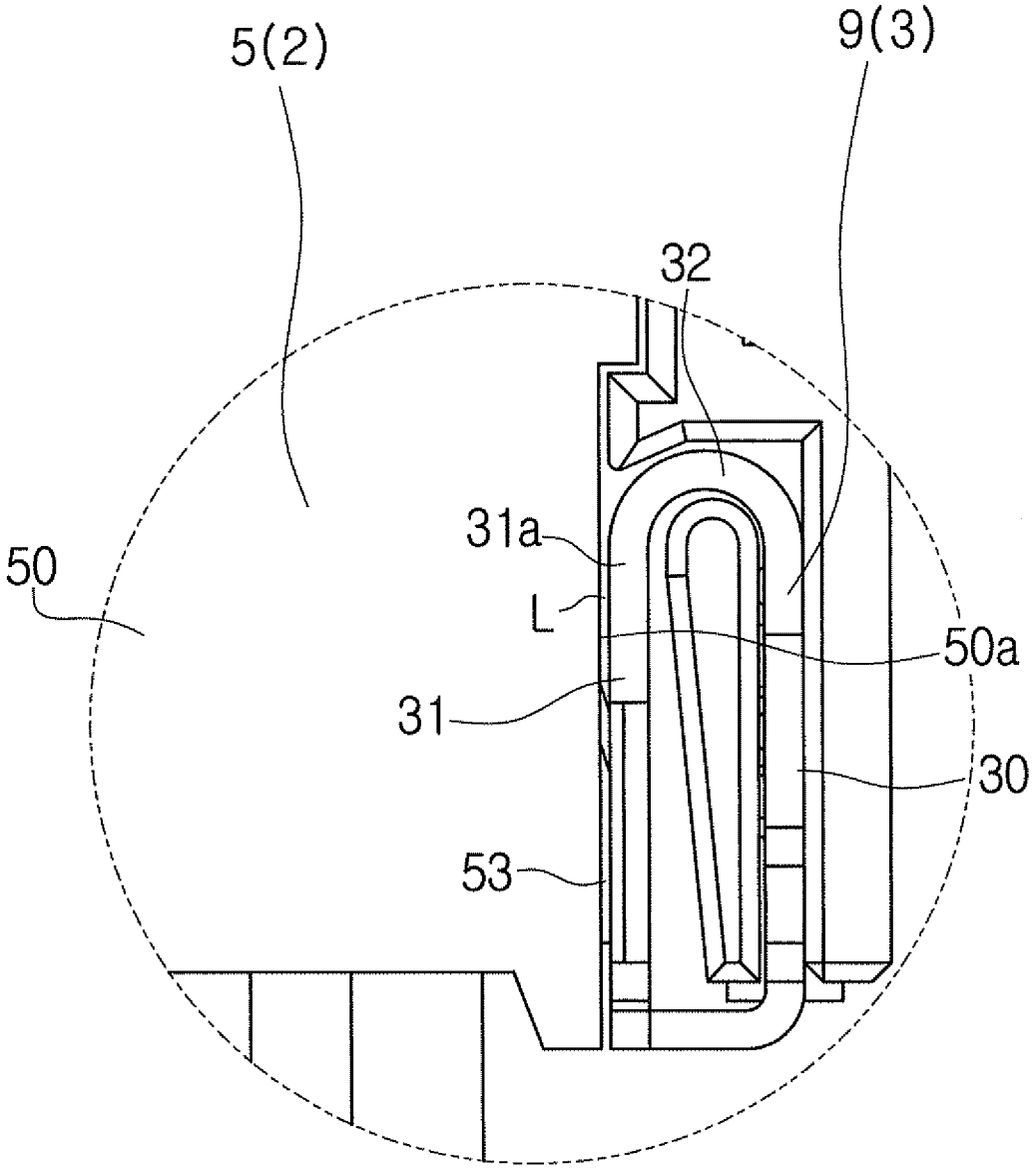
FIG. 34 is an enlarged view of a portion "W" shown in FIG. 33.
Figure 34:
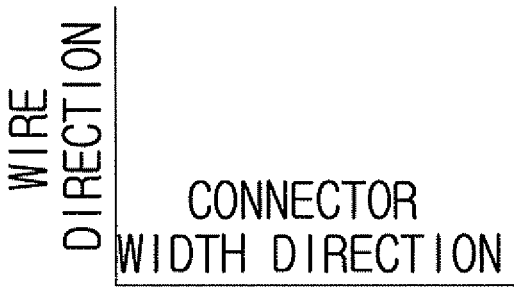

FIG. 33 shows the mated state of the wire-to-board connector 1. FIG. 34 is an enlarged view of a portion "W" shown in FIG. 33.

As shown in FIG. 34, the fixing portion 31 of each assistant fitting 9 of the receptacle connector 3 is supported in a cantilever manner. Accordingly, an end 31*a* which corresponds to the root of the fixing portion 31 and is located near the coupling portion 32 is less likely to be elastically displaced in the connector width anti-center direction. If the plug housing body 50 of the plug housing 5 of the plug connector 2 happens to contact the end 31*a* of the fixing portion 31 of the assistant fitting 9 of the receptacle connector 3, the end 31*a* being located near the coupling portion 32, when the plug connector 2 is mated with the receptacle connector 3, the mating of the plug connector 2 with the receptacle connector 3 is considerably inhibited because the end 31*a* is less likely to be elastically displaced in the connector width anti-center direction as described above.

To avoid such a problem, in the second embodiment described above, a gap L is left between the plug side surface 50*a* of the plug housing body 50 of the plug housing 5 of the plug connector 2 and the fixing portion 31 of each assistant fitting 9 of the receptacle connector 3 in the mated state of the wire-to-board connector 1.

However, due to the presence of the gap L, the movement of the plug housing 5 of the plug connector 2 in the connector width direction is allowed within the receptacle connector 3 in the mated state of the wire-to-board connector 1 shown in FIG. 34. When the plug housing 5 of the plug connector 2 is moved in the connector width direction within the receptacle connector 3, the opposed relationship in the board orthogonal direction between the receptacle lock surface 38 of the fixing portion 31 of the assistant fitting 9 shown in FIG. 9 and the lock maintaining surface 65 of the plug lock surface 60 of the projecting portion 53 shown in FIG. 21 is weakened. This results in a problem that the plug connector 2 is liable to be disengaged from the receptacle connector 3.

Figure 35:
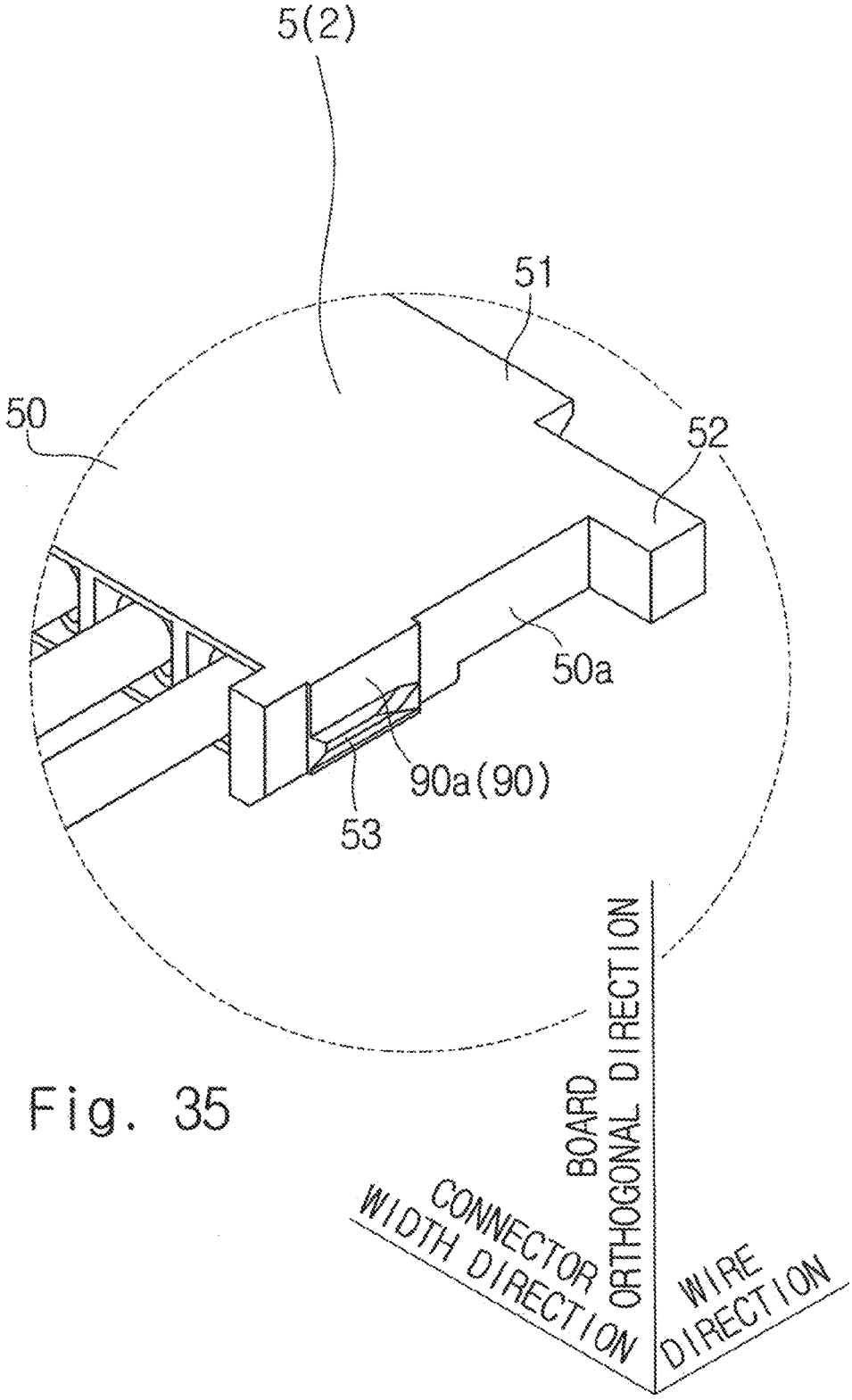
FIG. 35 is a partial perspective view of a plug connector to which a plurality of wires are attached (seventh embodiment)

As shown in FIG. 35, in this embodiment, each plug side surface 50*a* of the plug housing body 50 of the plug housing 5 of the plug connector 2 is provided with an overhanging portion 90 which projects toward the fixing portion 31 of the assistant fitting 9. That is, the overhanging portion 90 projects in the connector width anti-center direction from the corresponding plug side surface 50*a* of the plug housing body 50. In the mated state of the wire-to-board connector 1 shown in FIG. 36, the overhanging portion 90 is in contact with an elastically displaceable portion of the fixing portion 31. According to the structure described above, in the mated state of the wire-to-board connector 1, the movement of the plug housing 5 of the plug connector 2 in the connector width direction within the receptacle connector 3 is suppressed by an elastic force N of the fixing portion 31 of the assistant fitting 9 of the receptacle connector 3 in the connector width center direction. As a result, the opposed relationship in the board orthogonal direction between the receptacle lock surface 38 of the fixing portion 31 of the assistant fitting 9 shown in FIG. 9 and the lock maintaining surface 65 of the plug lock surface 60 of the projecting portion 53 shown in FIG. 21 is maintained, thereby preventing the plug connector 2 from being easily disengaged from the receptacle connector 3.

Specifically, as shown in FIG. 35, the plug housing 5 of the plug connector 2 includes a pair of overhanging portions 90 in addition to the plug housing body 50, the releasing projection 51, the pair of positioning projections 52, and the pair of projecting portions 53. Each overhanging portion 90 projects in the connector width anti-center direction from the corresponding plug side surface 50*a*. The overhanging portion 90 is formed at a location as far as possible from the corresponding positioning projection 52. The overhanging portion 90 includes an overhanging surface 90*a* that faces in the connector width anti-center direction. The overhanging surface 90*a* is orthogonal to the connector width direction. Since the overhanging portions 90 are respectively formed on the plug side surfaces 50*a* of the plug housing body 50, the overhanging surface 90*a* of each overhanging portion 90 can be regarded as being a part of each plug side surface 50*a* of the plug housing body 50. Each projecting portion 53 is formed on the corresponding overhanging portion 90. Specifically, each projecting portion 53 is formed on the overhanging surface 90*a* of the corresponding overhanging portion 90. Each projecting portion 53 projects in the connector width anti-center direction from the overhanging surface 90*a* of the corresponding overhanging portion 90.

Figure 36:
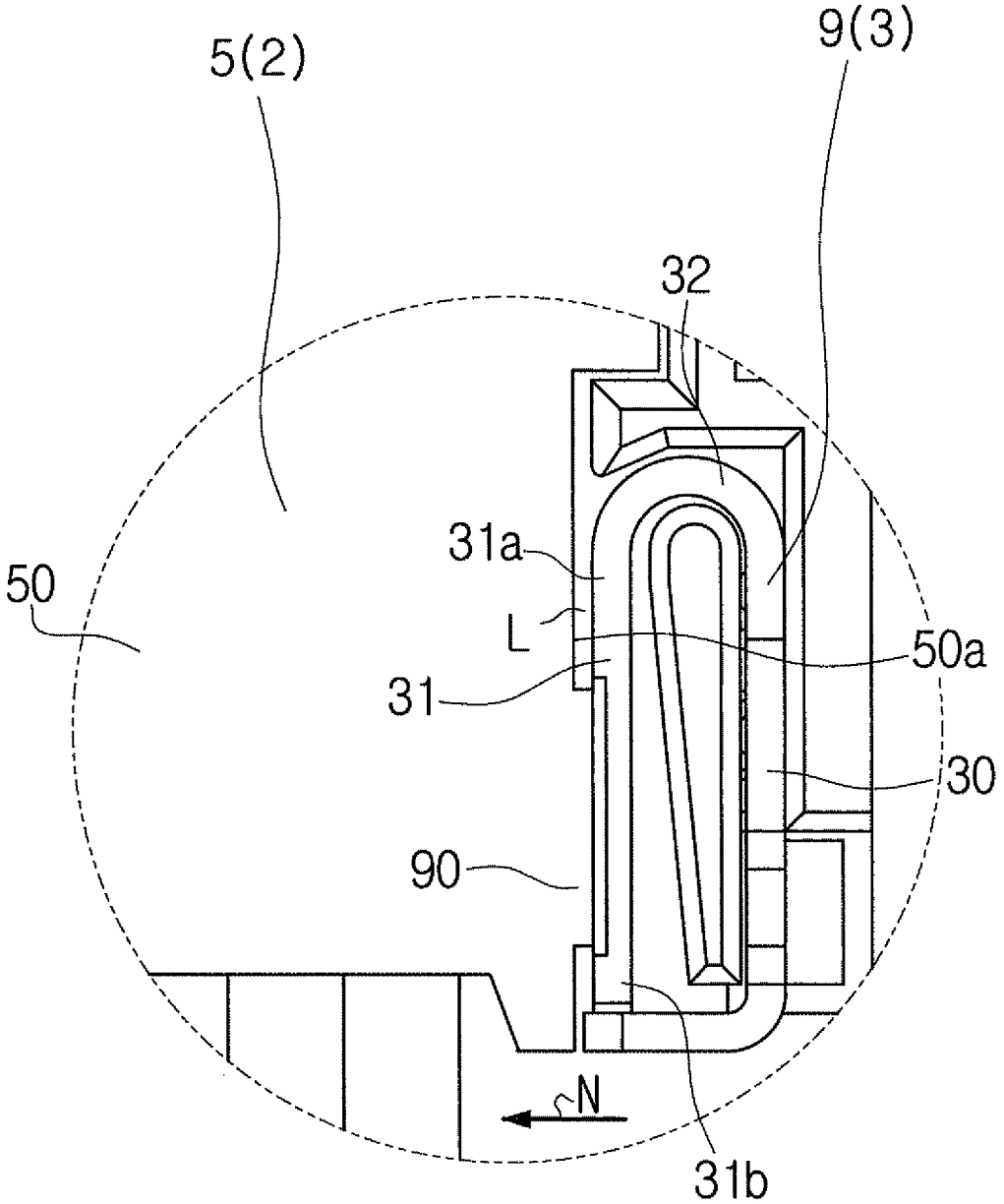
FIG. 36 is a view corresponding to FIG. 34 (seventh embodiment)
Figure 36:
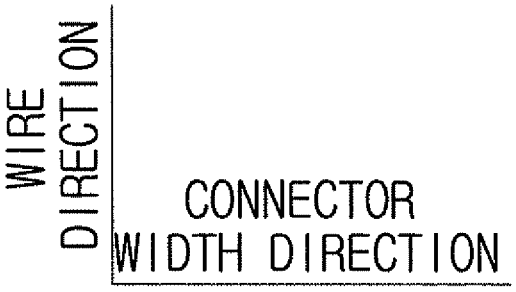

Since each overhanging portion 90 is formed at a location as far as possible from the corresponding positioning projection 52 as shown in FIG. 35, the overhanging portion 90 is apart from the end 31*a* of the fixing portion 31 in the connector wire direction in the mated state of the wire-to-board connector 1 as shown in FIG. 36. As a result, in the mated state of the wire-to-board connector 1, the overhanging portion 90 is constantly in contact with the elastically displaceable portion of the fixing portion 31. On the other hand, the above-mentioned gap L still exists between the plug side surface 50*a* and the vicinity of the end 31*a* of the fixing portion 31. Accordingly, also in this embodiment in which the overhanging portions 90 are provided, it is possible to effectively prevent the plug housing body 50 of the plug housing 5 of the plug connector 2 from contacting the end 31*a* of the fixing portion 31 of the assistant fitting 9 of the receptacle connector 3, the end 31*a* being located near the coupling portion 32, when the plug connector 2 is mated with the receptacle connector 3, as in the second embodiment described above. Therefore, the mating of the plug connector 2 with the receptacle connector 3 is not inhibited.

The seventh embodiment has been described above in comparison with the second embodiment. The seventh embodiment can also be applied to other embodiments including the first embodiment.

Eighth Embodiment

Next, an eighth embodiment of the present invention will be described with reference to FIGS. 37 and 38. Here, differences between this embodiment and the seventh embodiment will be mainly described, while a repeat of previous descriptions is omitted as appropriate. Components of this embodiment corresponding to the components of the seventh embodiment described above are denoted by the same reference numerals as those of the seventh embodiment as a rule.

Figure 37:
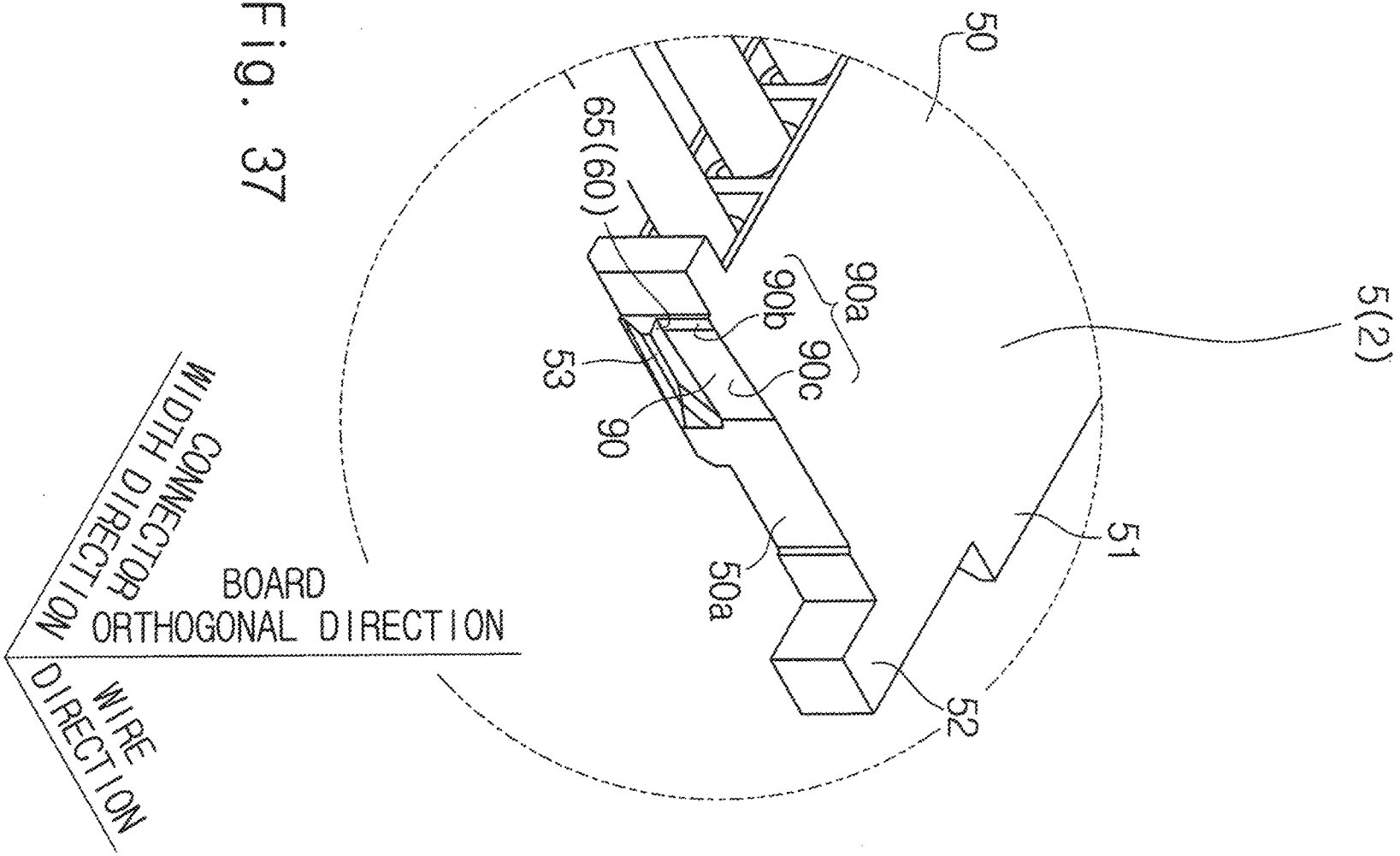
FIG. 37 is a partial perspective view of a plug connector to which a plurality of wires are attached (eighth embodiment)

As shown in FIG. 37, in this embodiment, the overhanging surface 90*a* of the overhanging portion 90 includes a first overhanging surface 90*b* and a second overhanging surface 90*c*. The first overhanging surface 90*b* is connected to an end of the second overhanging surface 90*c* on the connector wire direction side. That is, the second overhanging surface 90*c* is connected to an end of the first overhanging surface 90*b* on the wire connector direction side. The first overhanging surface 90*b* faces in the connector width anti-center direction. The first overhanging surface 90*b* is orthogonal to the connector width direction. The first overhanging surface 90*b* is connected to an end of the lock maintaining surface 65 of the plug lock surface 60 of the projecting portion 53, the end being located on the connector wire direction side. The second overhanging surface 90*c* is inclined in the connector width center direction toward the wire connector direction.

Figure 38:
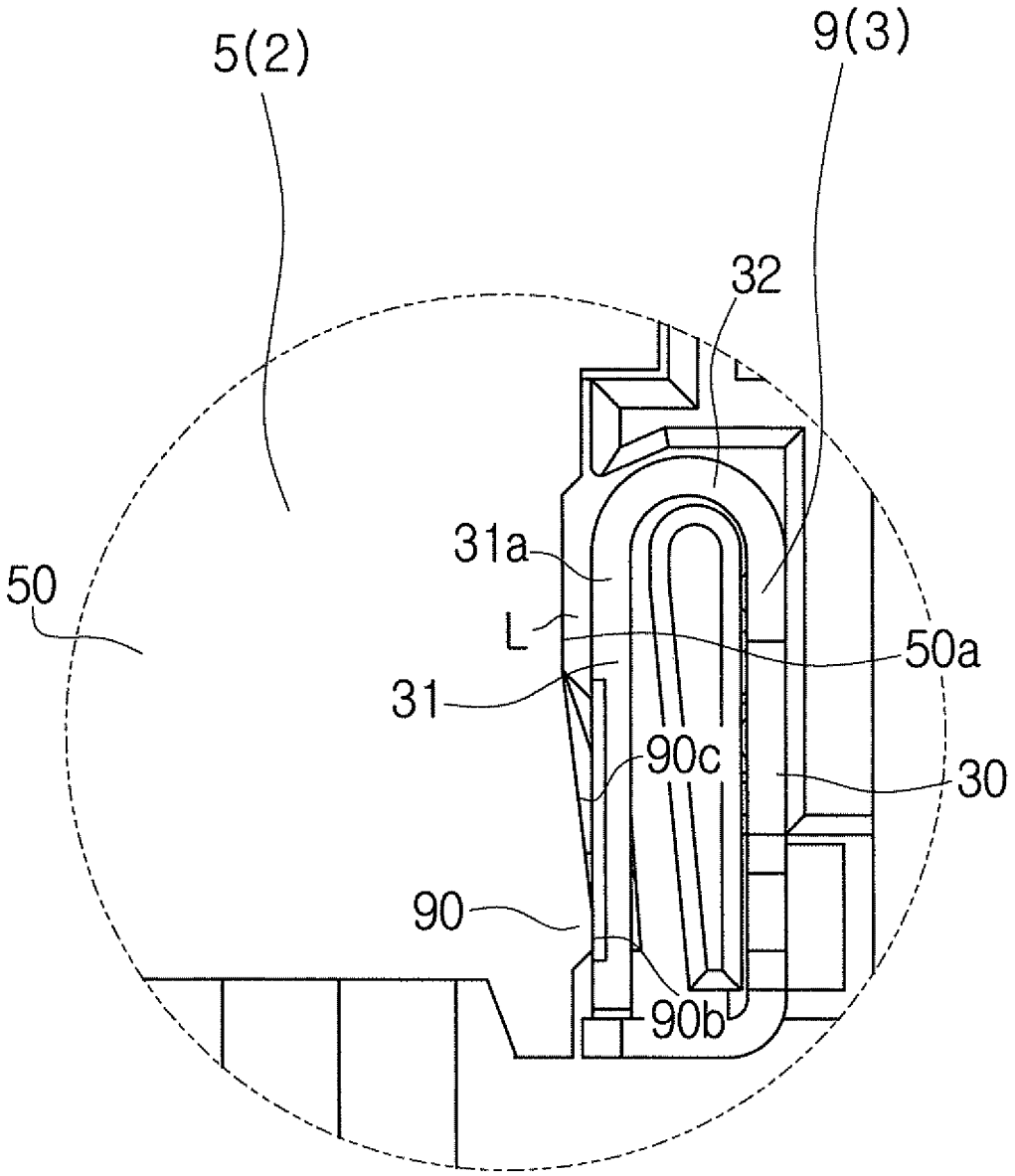
FIG. 38 is a view corresponding to FIG. 34 (eighth embodiment).
Figure 38:
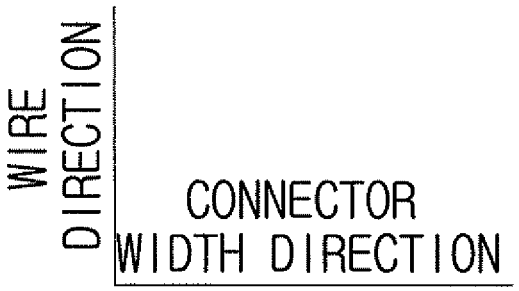

In this structure, as shown in FIG. 38, when the plug connector 2 is mated with the receptacle connector 3, only the first overhanging surface 90*b* of the overhanging portion 90 is constantly in contact with the fixing portion 31, and the second overhanging surface 90*c* of the overhanging portion 90 does not contact the fixing portion 31. Further, the first overhanging surface 90*b* is connected to the end of the lock maintaining surface 65 of the projecting portion 53, the end being located on the connector wire direction side. Accordingly, regardless of how much the fixing portion 31 is elastically displaced in the connector width anti-center direction due to the contact between the overhanging portion 90 and the fixing portion 31, the elastic displacement has no influence on the opposed relationship in the board orthogonal direction between the receptacle lock surface 38 of the fixing portion 31 of the assistant fitting 9 shown in FIG. 9 and the lock maintaining surface 65 of the plug lock surface 60 of the projecting portion 53 shown in FIG. 21.

The eighth embodiment has been described above in comparison with the seventh embodiment. The eighth embodiment can also be applied to other embodiments including the first embodiment.

This application is based upon and claims the benefit of priority from Japanese patent application No. 2012-160367, filed on Jul. 19, 2012, and Japanese patent application No. 2012-247586, filed on Nov. 9, 2012, the disclosure of which is incorporated herein in its entirety by reference.

REFERENCE SIGNS LIST

1 WIRE-TO-BOARD CONNECTOR
2 PLUG CONNECTOR
3 RECEPTACLE CONNECTOR
4 PLUG CONTACT
4*a* CONTACT PIECE
4*b* CONTACT POINT PORTION
5 PLUG HOUSING
6 WIRE
6*a* VICINITY PORTION
7 RECEPTACLE CONTACT
8 RECEPTACLE HOUSING
9 ASSISTANT FITTING
10 CIRCUIT BOARD (BOARD)
10*a* CONNECTOR MOUNTING SURFACE
10*b* ASSISTANT FITTING PAD
15 BOARD OPPOSING PORTION
16 RECEPTACLE CONTACT HOLDING PORTION
17 ASSISTANT FITTING ATTACHMENT PORTION
18 RECEPTACLE CONTACT MOUNTING HOLE
19 END
20 POSITIONING GROOVE SIDE PARTITION WALL PORTION
21 POSITIONING GROOVE FRONT PARTITION WALL PORTION
22 FITTING HOLDING GROOVE BACK PARTITION WALL PORTION
23 FITTING HOLDING GROOVE SIDE PARTITION WALL PORTION
24 FITTING HOLDING GROOVE INNER PARTITION WALL PORTION
24*a* CURVED SURFACE
25 FITTING HOLDING GROOVE LOWER PARTITION WALL PORTION
25*a* PRESS-FIT HOLE
26 FITTING HOLDING GROOVE
30 HELD PORTION
30*a* HELD PORTION BODY
30*b* PRESS-FITTED PORTION
30*c* LEG PORTION
31 FIXING PORTION
31*a* END
33 COUPLING PORTION
33 DISPLACEMENT REGULATING PORTION
34 FIXING PORTION BODY
35 REGULATED PROJECTION
36 LOCK HOLE
37 LOCK BEAM
38 RECEPTACLE LOCK SURFACE
39 PLUG OPPOSING SURFACE
40 MATING GUIDE SURFACE
41 POSITIONING GROOVE
42 VERTICAL DISPLACEMENT REGULATING PORTION
42*a* DISTAL END
43 HORIZONTAL DISPLACEMENT REGULATING PORTION
50 PLUG HOUSING BODY
50*a* PLUG SIDE SURFACE
51 RELEASING PROJECTION
52 POSITIONING PROJECTION
53 PROJECTING PORTION
54 PLUG CONTACT MOUNTING HOLE
60 PLUG LOCK SURFACE
61 MATING GUIDE SURFACE
62 SIDE STANDING SURFACE
63 END STANDING SURFACE
64 END INCLINED SURFACE
65 LOCK MAINTAINING SURFACE
65*a* EDGE
66 UNLOCKING SURFACE
70 RECEPTACLE CONTACT BODY
71 RECEPTACLE CONTACT POINT PORTION
71*a* RECESS
72 RECEPTACLE CONTACT LEG PORTION
80 CURVED SURFACE
81 MATING GUIDE SURFACE
82 FLAT SURFACE
90 OVERHANGING PORTION
90*a* OVERHANGING SURFACE
90*b* FIRST OVERHANGING SURFACE
90*c* SECOND OVERHANGING SURFACE
θ1 LOCK MAINTAINING ANGLE
θ2 UNLOCKING ANGLE
G GAP
H GAP
L GAP
J GAP
K GAP
N ELASTIC FORCE
P MATING DIRECTION
Q REFERENCE PLANE
S ARROW
R ARROW
X CROSS-SECTION
Y CROSS-SECTION
Z CROSS-SECTION

The invention claimed is:

1. A wire-to-board connector comprising:

a plug connector including a plug contact to which a wire is attached, and a plug housing that holds the plug contact; and a receptacle connector that is mounted on a connector mounting surface of a board and includes a receptacle contact corresponding to the plug contact, a receptacle housing that holds the receptacle contact, and an assistant fitting that is attached to the receptacle housing, wherein a mating direction in which the plug connector is mated with the receptacle connector is at least a direction orthogonal to the connector mounting surface of the board, the plug connector is mated with the receptacle connector to thereby bring the plug contact into contact with the receptacle contact, and the assistant fitting includes:

a held portion that is held by the receptacle housing;

a fixing portion that is hooked to the plug housing to thereby fix the plug connector to the receptacle connector; and a first displacement regulating portion that regulates a displacement of the fixing portion in a direction away from the connector mounting surface of the board, wherein assuming that a direction in which the plug connector is viewed from the wire is a wire connector direction, the receptacle housing further includes a fitting holding groove inner partition wall portion that is surrounded by the assistant fitting and formed with a thickness that gradually increases in the wire connector direction.

2. The wire-to-board connector according to claim 1, wherein the fixing portion is supported by the held portion and is formed in a cantilever shape extending in parallel to the connector mounting surface of the board.

3. The wire-to-board connector according to claim 2, wherein the fixing portion is opposed to the held portion.

4. The wire-to-board connector according to claim 3, wherein the fixing portion is formed to be elastically displaceable in a direction approaching the held portion.

5. The wire-to-board connector according to claim 4, wherein the assistant fitting further includes a second displacement regulating portion that regulates elastic displacement of the fixing portion in a direction approaching the held portion so that the elastic displacement does not exceed a predetermined amount.

6. The wire-to-board connector according to claim 1, wherein the assistant fitting includes a leg portion that is soldered to the connector mounting surface of the board.

7. The wire-to-board connector according to claim 6, wherein the leg portion is disposed in the vicinity of the first displacement regulating portion.

8. The wire-to-board connector according to claim 1, wherein the plug housing has a projecting portion projecting toward the fixing portion of the assistant fitting, the projecting portion has a plug lock surface facing away from the board in at least a direction orthogonal to the connector mounting surface of the board, and the fixing portion has a receptacle lock surface that faces toward the board in at least a direction orthogonal to the connector mounting surface of the board and is opposed to the plug lock surface in a mated state in which the plug connector is mated with the receptacle connector.

9. The wire-to-board connector according to claim 8, wherein the wire is pulled out from the plug connector in a direction substantially parallel to the connector mounting surface of the board.

10. The wire-to-board connector according to claim 9, wherein a portion of the projecting portion on the wire connector direction side is formed in such a manner that a projection amount of the projecting portion decreases toward the wire connector direction.

11. The wire-to-board connector according to claim 10, wherein the plug housing has a releasing projection that allows the plug connector to be inclined so that the wire approaches the connector mounting surface of the board.

12. The wire-to-board connector according to claim 11, wherein the releasing projection is formed so as to project in the wire connector direction from an end of the plug housing on the wire connector direction side.

13. The wire-to-board connector according to claim 9, wherein one of a flat surface or a curved surface is formed at a portion of the projecting portion on the wire connector direction side, the flat surface or the curved surface being inclined so as to be gradually separated from the fixing portion in a direction away from the connector mounting surface of the board.

14. The wire-to-board connector according to claim 13, wherein the plug housing has a releasing projection that allows the plug connector to be inclined so that the wire approaches the connector mounting surface of the board.

15. The wire-to-board connector according to claim 9, wherein one of a flat surface or a curved surface is formed at a portion of the fixing portion on the wire connector direction side, the flat surface or the curved surface being inclined so as to gradually approach the plug housing in a direction away from the connector mounting surface of the board.

16. The wire-to-board connector according to claim 15, wherein the plug housing has a releasing projection that allows the plug connector to be inclined so that the wire approaches the connector mounting surface of the board.

17. The wire-to-board connector according to claim 8, wherein the fixing portion has a mating guide surface that allows the fixing portion to be elastically displaced in a direction away from the plug connector, when the projecting portion of the plug connector is brought into contact with the fixing portion so as to mate the plug connector with the receptacle connector.

18. The wire-to-board connector according to claim 17, wherein the mating guide surface is a flat surface or a curved surface.

19. The wire-to-board connector according to claim 1, wherein a pair of the assistant fittings is provided on both sides of the receptacle connector.

20. The wire-to-board connector according to claim 1, wherein the fixing portion is supported by the held portion and is formed in a cantilever shape extending in parallel to the connector mounting surface of the board, the fixing portion is formed to be elastically displaceable in a direction approaching the held portion, the plug housing has a projecting portion projecting toward the fixing portion of the assistant fitting, the projecting portion has a plug lock surface facing away from the board in at least a direction orthogonal to the connector mounting surface of the board, the fixing portion has a receptacle lock surface that faces toward the board in at least a direction orthogonal to the connector mounting surface of the board and is opposed to the plug lock surface in a mated state in which the plug connector is mated with the receptacle connector, and a plug side surface serving as a side surface of the plug housing is provided with an overhanging portion that projects toward the fixing portion of the assistant fitting, and the overhanging portion is in contact with an elastically displaceable portion of the fixing portion in the mated state.

21. The wire-to-board connector according to claim 1, wherein the mating direction is a direction that intersects the connector mounting surface of the board.

22. The wire-to-board connector according to claim 1, wherein the first displacement regulating portion projects from the held portion.

23. The wire-to-board connector according to claim 22, wherein the first displacement regulating portion is opposed to the fixing portion in the mating direction, and when the fixing portion is displaced in a direction separating from the connector mounting surface of the board, the fixing portion is brought into contact with the first displacement regulating portion, thereby inhibiting a further displacement of the fixing portion.

* * * * *